US007371708B2

(12) United States Patent
Arai et al.

(10) Patent No.: US 7,371,708 B2
(45) Date of Patent: May 13, 2008

(54) THERMOREVERSIBLE RECORDING MEDIUM, THERMOREVERSIBLE RECORDING LABEL AND THERMOREVERSIBLE RECORDING MEMBER, AND, IMAGE PROCESSING APPARATUS AND IMAGE PROCESSING METHOD

(75) Inventors: Satoshi Arai, Shizuoka (JP); Atsushi Kutami, Shizuoka (JP); Hideo Sakurai, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/024,277

(22) Filed: Dec. 28, 2004

(65) Prior Publication Data

US 2005/0176582 A1 Aug. 11, 2005

(30) Foreign Application Priority Data

Jan. 8, 2004 (JP) ..... 2004-002942

(51) Int. Cl.
*B41M 5/40* (2006.01)

(52) U.S. Cl. ..... 503/201; 503/200; 503/207; 503/226

(58) Field of Classification Search ..... 503/201
See application file for complete search history.

(56) References Cited

U.S. PATENT DOCUMENTS 4,882,310 A 11/1989 Arai et al.
5,278,128 A 1/1994 Hotta et al.
5,283,220 A 2/1994 Kawaguchi et al.
5,310,718 A 5/1994 Amano et al.
5,407,890 A 4/1995 Ishikawa
5,448,065 A 9/1995 Masubuchi et al.
5,583,554 A 12/1996 Masubuchi et al.
5,614,461 A 3/1997 Itoh et al.
5,700,746 A 12/1997 Kutami et al.
5,801,743 A 9/1998 Itoh et al.

(Continued)

FOREIGN PATENT DOCUMENTS

EP 1208995 A2 5/2002

(Continued)

OTHER PUBLICATIONS

Apr. 4, 2005 Communication and European Search Report in connection with corresponding European Application No. EP 05 00 0278.

*Primary Examiner*—Bruce H. Hess
(74) *Attorney, Agent, or Firm*—Cooper & Dunham, LLP

(57) ABSTRACT

The object of the present invention is to provide a thermoreversible recording medium which possesses not only such an excellent property that the electrostatic charge on the thermoreversible recording medium can be prevented and the curling of the thermoreversible recording medium caused by repeating heating for the printing and erasing of the thermoreversible recording medium can be also prevented, but also an excellent conveyability which is not affected by repeating the use of the thermoreversible recording medium and by an using condition thereof. For attaining the object, the present invention provides a thermoreversible recording medium comprising a support, a thermosensitive layer disposed on the support which reversibly changes the color depending on the temperature, a protective layer disposed on the thermosensitive layer, and a back layer disposed on a surface of the support which is opposite to another surface of the support on which the thermosensitive layer is disposed, wherein the back layer comprises a needle-like conductive filler.

21 Claims, 13 Drawing Sheets

U.S. PATENT DOCUMENTS

| | | | |
|---|---|---|---|
| 5,869,421 | A | 2/1999 | Kutami et al. |
| 5,869,422 | A | 2/1999 | Kazumi et al. |
| 5,965,484 | A | 10/1999 | Kohno et al. |
| 6,096,683 | A | 8/2000 | Amano et al. |
| 6,140,268 | A | 10/2000 | Yamazaki et al. |
| 6,154,243 | A | 11/2000 | Tatewaki et al. |
| 6,177,383 | B1 | 1/2001 | Amano et al. |
| 6,579,826 | B2 | 6/2003 | Furuya et al. |
| 6,613,715 | B2 | 9/2003 | Kutami et al. |
| 6,693,061 | B2 | 2/2004 | Shimbo et al. |
| 6,818,591 | B2 | 11/2004 | Arai et al. |

FOREIGN PATENT DOCUMENTS

| | | | |
|---|---|---|---|
| JP | 55-154198 | | 12/1980 |
| JP | 1-133781 | | 5/1989 |
| JP | 2-188293 | | 7/1990 |
| JP | 2-188294 | | 7/1990 |
| JP | 3-169590 | | 7/1991 |
| JP | 4-224996 | | 8/1992 |
| JP | 4-247985 | | 9/1992 |
| JP | 4-267190 | | 9/1992 |
| JP | 5-124360 | | 5/1993 |
| JP | 6-48034 | | 2/1994 |
| JP | 6-210954 | | 8/1994 |
| JP | 6-286312 | | 10/1994 |
| JP | 8-187941 | | 7/1996 |
| JP | 10-250239 | | 9/1998 |
| JP | 11-78255 | | 3/1999 |
| JP | 11-91243 | | 4/1999 |
| JP | 11-254822 | | 9/1999 |
| JP | 2000-94866 | | 4/2000 |
| JP | 2000-251042 | | 9/2000 |
| JP | 2001-63228 | | 3/2001 |
| JP | 2002-103654 | | 4/2002 |
| WO | WO03/091041 | A1 | 11/2003 |

THERMOREVERSIBLE RECORDING MEDIUM, THERMOREVERSIBLE RECORDING LABEL AND THERMOREVERSIBLE RECORDING MEMBER, AND, IMAGE PROCESSING APPARATUS AND IMAGE PROCESSING METHOD

BACKGROUND OF THE INVENTION

1. Field of the Invention

The present invention relates to a thermoreversible recording medium which possesses an excellent property that accumulation of electrostatic charge on the thermoreversible recording medium may be prevented and the curling of the thermoreversible recording medium caused by repeated heating for printing and erasing of the thermoreversible recording medium also may be prevented, and in addition possesses an excellent conveyability which is not affected by repeated use of the thermoreversible recording medium and by a condition of use thereof, and also relates to a thermoreversible recording label, a thermoreversible recording member, an image processing apparatus and a process which employ the thermoreversible recording medium respectively.

2. Description of the Related Art

In recent years, a thermoreversible recording medium (hereinafter, sometimes referred as "reversible thermosensitive recording medium" or "recording medium") on which a temporary image may be formed and the formed image may be also erased, when the image is not necessary more, attracts much attention. As a representative example of such cording media, a thermoreversible recording medium produced by dispersing a color developer, such as an organic phosphorus compound, aliphatic carboylic acid compound and phenol compound which contain a long-chain aliphatic hydrocarbon group and a coloring agent, such as a leuco dye in a resin composition, is well-known (see Japanese Patent Application Laid-Open (JP-A) Nos. 5-124360 and 6-210954).

Many of such thermoreversible recording media comprise PET film having a magnetic recording layer as a support and are used commercially as a material for mainly a point card. On the other hand, many methods for producing a thermoreversible recording medium are proposed, wherein the thermoreversible recording medium is produced by laminating a multi-layer unit in which a thermoreversible recording layer is disposed on a surface of a thin support and an adhesive layer is disposed on another surface of the support, on various kinds of substrates with applying heat or pressure. A multi-layer unit comprises a thermoreversible recording layer, a thin support and an adhesive layer, wherein a thermoreversible recording layer is disposed on a surface of the support and the adhesive layer is disposed on another reverse surface of the support (see JP-A Nos. 2000-94866, 2000-251042, 2001-63228 and 2002-103654).

However, in these proposed methods, examples of the above-noted substrates included substrates for optical memory, contact type IC, non-contact type IC and magnetic recording and since these substrates were mostly very thick, the size of cards produced by using these substrates was limited and the application purpose of these cards was also limited. In other words, these cards were not suitable for an enter-exit ticket, stickers for containers of frozen foods, industrial products and various medicines, and wide screens indicating various informations for controls of product distribution and production process.

Therefore, for above-noted application purposes, a thermoreversible recording medium having a size of "sheet size" which is larger than card size is necessary to be used. Here, "sheet size" means a size which is larger than card size (54 mm×85 mm).

When the above-noted thermoreversible recording medium is used as a sheet, the size of the recording medium becomes larger than the size of a point card or a card made of a thick substrate. Accordingly, when such a thermoreversible recording medium is conveyed by the printer, the recording medium becomes easily electrostatically charged by the contact of a recording medium with another recording medium or with a conveying roller of the printer and a static charge accumulated on a thermoreversible recording medium becomes larger, because of a larger contacting area of a thermoreversible recording medium with another thermoreversible recording medium or with a conveying roller of the printer. As a result, thermoreversible recording media stick to each other and the thermoreversible recording medium may be difficultly conveyed by the printer. On the other hand, a thermoreversible recording medium having a large size poses a problem that since the thermoreversible recording medium is shrunk by repeating the printing and erasing by heating, the curling is caused on the thermoreversible recording medium and a large curling may cause a defect in conveyance of the thermoreversible recording medium.

There is reported a thermoreversible recording medium in which an anti-static effect thereof is improved for solving the above-noted problem. For example, in JP-A No. 11-254822, there is proposed a thermoreversible recording medium having a surface resistance of $1\times10^{13}$ ohm/square or less (measured at 20° C. and under a relative humidity of 65%) and a surface static friction coefficient of 0.65 or less. However, in this proposal, the thermoreversible recording medium has a lower surface resistance measured under a low humidity and particularly with respect to a thermoreversible recording medium having a surface resistance of $1\times10^{11}$ ohm/square or less, disadvantage is caused in that since the static charge cannot be satisfactorily removed from the thermoreversible recording medium under a low humidity and the thermoreversible recording medium is charged by repeating the printing and erasing under a low humidity, thermoreversible recording media stick to each other in the printer and then, a defect in conveyance of the thermoreversible recording medium is caused. There is posed also a problem that the curling on the thermoreversible recording medium becomes larger by repeating the use of the thermoreversible recording medium and it results also in a defect in conveyance of the thermoreversible recording medium.

In JP-A No.10-250239, there is proposed a thermoreversible recording medium comprising conductive particles having a shortest diameter of 1 μm or less. In this proposal, a less amount of dust attaches to the thermoreversible recording medium, however there is neither disclosed nor suggested a description with respect to a surface form of the thermoreversible recording medium and when thermoreversible recording media having a surface which is mentioned in the proposal are piled in the printer, they may be difficultly conveyed by a paper feeding roll in the printer. As a result, sheets of thermoreversible recording media cannot be separated into an individual sheet and then, the conveyablity of the thermoreversible recording medium is impaired in the printer. In addition, the proposed thermoreversible recording medium poses a problem that during repeating the printing and erasing of the thermoreversible recording medium, the curling is caused by heating for the printing and erasing and the conveyablity of the thermoreversible recording medium is impaired in the printer.

Further, in JP-A No.11-91243, there is proposed a thermoreversible recording medium comprising at least one layer comprised of particles of a conductive metal oxide semi-conductor, wherein the particle is a conductive pigment coated with tin oxide. However, it is the same as mentioned in JP-A No.10-250239 above that there is no description with respect to a surface form of the thermoreversible recording medium in the proposal and when thermoreversible recording media having a surface which is mentioned in the proposal are piled in the printer, they may be difficultly conveyed by a paper feeding roll in the printer. As a result, sheets of thermoreversible recording media may not be separated into an individual sheet and then, the conveyablity of the thermoreversible recording medium is impaired in the printer. In addition, the proposed thermoreversible recording medium poses a problem that during repeating the printing and erasing of the thermoreversible recording medium, the curling is caused by heating for the printing and erasing and the conveyablity of the thermoreversible recording medium is impaired in the printer.

In other fields, as a method for imparting an anti-static function to the thermoreversible recording medium, for example, a heat transfer receiving sheet comprising a conductive needle-like crystal is proposed (see JP-A No.11-78255). However, when the method of this proposal is applied to the thermoreversible recording medium, a satisfactory anti-static function of the thermoreversible recording medium cannot be obtained and there is reported no example for forming an anti-static layer on the most outer surface of the thermoreversible recording medium. In this case, the conveyablity of the thermoreversible recording medium is also unsatisfactory. Moreover, in this proposal, during repeating the printing and erasing, disadvantage is caused in that thermoreversible recording media stick to each other and multi feeding of the recording media is caused. Further, in this proposal, the curling of the thermoreversible recording medium cannot be satisfactorily prevented and during repeating the printing and erasing by heating, the curling becomes larger. As a result, there is posed a problem that a defect in the conveyance is caused.

For preventing the curling, there is proposed a thermoreversible recording medium comprising a protective layer (the surface) and a back layer (the reverse surface) (the both layers are made of a ultraviolet-curable resin), wherein a kinetic coefficient of friction between the protective layer and the back layer is 0.3 or more and a kinetic coefficient of friction between 2 protective layers is 0.3 or less (see JP-A No.8-187941). By this proposal, the curling can be effectively prevented; however, the thermoreversible recording medium of this proposal is charged during repeating the printing and erasing and thermoreversible recording media stick to each other, thereby resulting in a defect in the conveyance. Further, during repeating the printing and erasing, to the thermoreversible recording medium heat and pressure are applied by a thermal head and heat is applied by an erasing unit; accordingly the surface property of the thermoreversible recording medium is so changed that a defect in conveyance thereof may be induced. In addition, when thermoreversible recording media are set into the printer in such a wrong setting order that the reverse surface of a thermoreversible recording medium faces to the reverse surface of another thermoreversible recording medium, a kinetic coefficient of friction between a surface and another surface differs from a kinetic coefficient of friction between a reverse surface and another reverse surface and as a result, disadvantage is caused in that a defect in conveyance of the thermoreversible recording medium may be induced.

As noted above, there are a method for preventing the electrostatic charge and a method for preventing the curling individually; however a thermoreversible recording medium which possesses not only such an excellent property that both the electrostatic charge and the curling can be prevented, but also an excellent conveyability which is not affected by repeating the use of the thermoreversible recording medium and by an using condition thereof, and a related technique thereto have not been attained yet.

SUMMARY OF THE INVENTION

The object of the present invention is to provide a thermoreversible recording medium which possesses not only such an excellent property that the electrostatic charge on the thermoreversible recording medium can be prevented and the curling of the recording medium caused by repeating heating for the printing and erasing of the recording medium can be also prevented, but also an excellent conveyability which is not affected by repeating the use of the recording medium and by an using condition thereof, and a thermoreversible recording label, a thermoreversible recording member, an image processing apparatus and a process which employ the thermoreversible recording medium respectively.

The thermoreversible recording medium according to the present invention comprises a support, a thermosensitive layer disposed on the support which reversibly changes the color depending on the temperature, a protective layer disposed on the thermosensitive layer, and a back layer disposed on a surface of the support which is opposite to another surface of the support on which the thermosensitive layer is disposed. In the thermoreversible recording medium according to the present invention, the back layer comprises at least a needle-like conductive filler, so that the electrostatic charge generated on the thermoreversible recording medium by the friction of a recording medium with either a conveying roller or another recording medium during the conveyance of the recording medium, can be discharged from the recording medium without remaining on the recording medium. As a result, the recording media can be prevented from sticking to each other and the recording medium can exhibit such an effect to adsorb no dust which is likely to cause a defective printing during the printing and erasing. In addition, since the back layer comprises a needle-like conductive filler, not only needle-like conductive fillers intertwine with each other, so that the curling caused by the heating during repeating the printing and erasing may be prevented, but also many edge parts of fillers may be present at a surface part of the recording medium and the surface of the recording medium is uneven, so that the conveyability of the recording medium can be markedly improved.

The thermoreversible recording label according to the present invention comprises one of the adhesive layer and tacky layer disposed on a surface of the support opposite to another surface of the support on which the image forming layer of the recording medium according to the present invention is disposed.

In the recording label, since the back layer of the above-noted thermoreversible recording medium part comprises at least a needle-like conductive filler, the electrostatic charge and the curling of the recording label can be prevented and the conveyability of the recording label can be markedly improved, so that images with superior visuality can be formed. In addition, owing to the adhesive layer or tacky layer, the recording label can be broadly applied to, for example, a thicker substrate such as a card formed of polyvinyl chloride with magnetic stripe to which the direct coating of thermosensitive layer is difficult, container of sheet size larger than card size, sticker, and wide screen.

The thermoreversible recording member comprises an information-memorizing part and a reversible displaying part, the reversible displaying part comprises the thermoreversible recording medium according to the present invention. In the recording member, the back layer in the reversible displaying part comprises at least a needle-like conductive filler, thereby the electrostatic charge and the curling can be prevented and the conveyability of the recording member can be remarkably improved, so that a desired image can be formed and erased with a desired timing. Therefore, images with superior contrast, visuality and the like can be formed.

On the other hand, at the information-memorizing part, various optional information such as of letter, image, music, and picture are recorded and erased through the corresponding way with the recording means of magnetic thermosensitive layer, magnetic stripe, IC memory, optical memory, hologram, RF-ID tag card, disc, disc cartridge and tape cassette.

The image processing apparatus comprises at least one of an image forming unit and an image erasing unit, wherein images are formed on the thermoreversible recording medium according to the present invention.

In the image forming apparatus, the image forming unit forms images on the recording medium according to the present invention by heating the recording medium. On the other hand, the image erasing unit erases images on the recording medium according to the present invention by heating the recording medium.

The image processing apparatus comprises, as the recording medium, the thermoreversible recording medium according to the present invention by which the electrostatic charge and the curling of the recording medium can be prevented and the conveyability of the recording medium can be remarkably improved, thereby the curling of the recording medium can be prevented during repeating the printing and erasing so that a defect in conveyance, such as the multi feeding and the paper jam can be prevented.

The image processing method may achieve at least one of image forming and image erasing through heating the recording medium according to the present invention. In the image processing method, images are formed on the recording medium by heating the recording medium. On the other hand, images formed on the recording medium are erased through heating the recording medium. The image processing apparatus comprises, as the recording medium, the thermoreversible recording medium according to the present invention by which the electrostatic charge and the curling of the recording medium may be prevented and the conveyability of the recording medium may be remarkably improved, thereby the curling of the recording medium may be prevented during repeating the printing and erasing so that a defect in conveyance, such as the multi feeding and the paper jam may be prevented.

Figure 1:
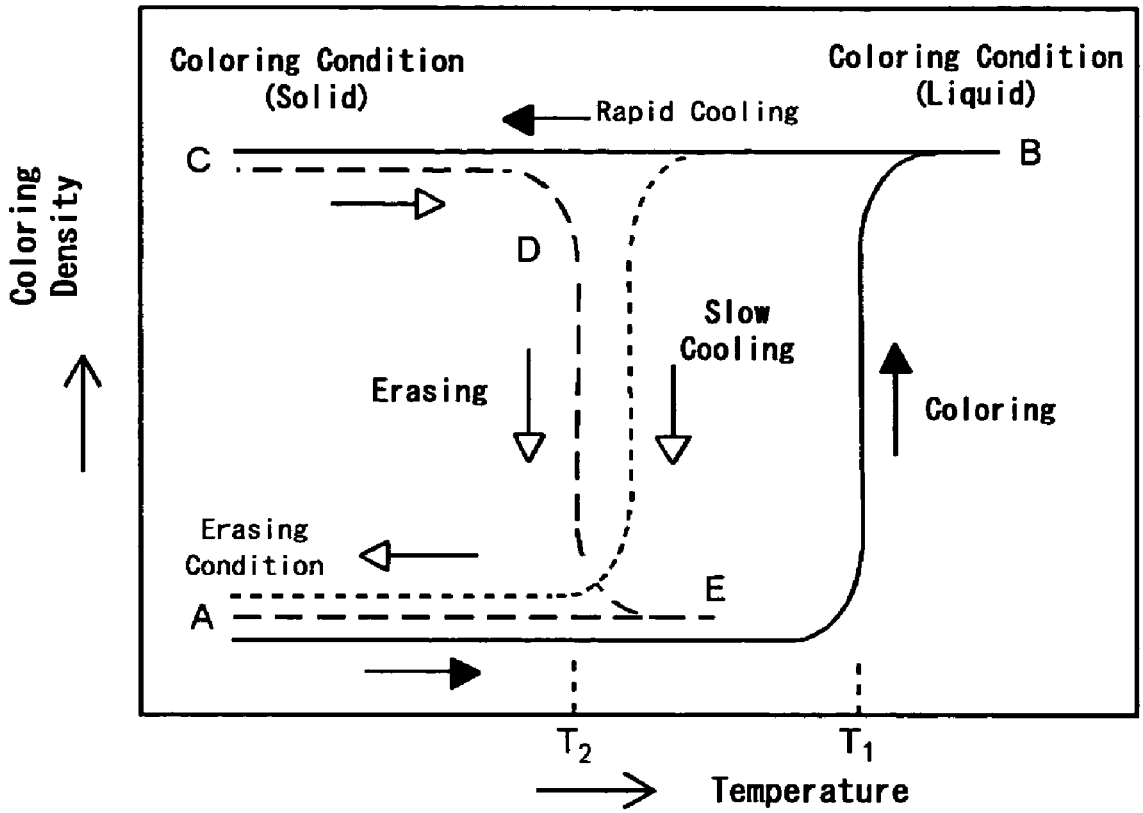
FIG. 1 schematically shows the color developing-reducing property (developing-erasing phenomena) in an example of the thermoreversible recording medium according to the present invention.

DESCRIPTION OF THE PREFERRED EMBODIMENTS (Thermoreversible Recording Medium)

The thermoreversible recording medium according to the present invention comprises at least a support, a back layer, a protective layer, a thermosensitive layer and optionally the other layers.

<Support>

The support is not restricted as to the form, the configuration, the size and may be properly selected depending on the application. Examples of the form include a plate and examples of the configuration include a single layer and a laminated layer. The size may be properly selected depending on the size of the thermoreversible recording medium.

The materials of the support are summarily divided into inorganic materials and organic materials. Examples of the inorganic material include glass, quartz, silicon, silicon oxide, aluminum oxide, $SiO_2$ and metal. Examples of the organic material include paper, cellulose derivatives, such as triacetyl cellulose, synthetic paper, polyethylene terephthalate, polycarbonate, polystyrene and polymethylmethacrylate. These materials may be used individually or in combination.

Among these materials, for obtaining a sheet with a high clarity of images, polyethylene terephthalate and PET-G film having the haze (defined in JIS K7105) of 10% or less as the support, are particularly preferred.

For improving the adhesion properties of a coat layer, the support is preferably subjected to surface reforming by means of corona discharge processing, oxidation reaction processing (with chromium oxide and the like), etching processing, adherable processing or anti-static processing. Further, the support is preferably rendered to white by incorporating white pigment, such as titanium oxide.

The thickness of the support is not restricted and may be properly selected depending on the application and the thickness is preferably from 10 to 2,000 μm, more preferably from 20 to 1,000 μm.

The support may comprise a magnetic thermosensitive layer disposed in at least one manner of such two manners as a manner that the magnetic thermosensitive layer is disposed on a surface of the support which is opposite to another surface of the support on which the thermosensitive layer is disposed, and a manner that the magnetic thermosensitive layer is disposed on the thermosensitive layer. Further, the thermoreversible recording medium according to the present invention may be laminated on the other media through a tacky layer and the like.

<Back Layer>

The back layer is not restricted so long as it is disposed on a surface of the support which is opposite to another surface of the support on which the thermosensitive layer is disposed, and may be properly selected depending on the application. The configuration thereof may be a laminated layer of plural layers. Particularly, the back layer is preferably located at the most outer (inner) surface on which no layer is disposed.

The back layer comprises at least a needle-like conductive filler and comprises a binder resin and optionally other components, such as other fillers, lubricant and pigment.

In the present invention, the back layer comprises at least a needle-like conductive filler, so that the electrostatic charge generated on the thermoreversible recording medium by the friction of a recording medium with either a conveying roller or another recording medium during the conveyance of the recording medium, can be discharged from the recording medium without remaining on the recording medium. Accordingly, the recording media may be prevented from sticking to each other and the recording medium can exhibit such an effect to adsorb no dust which is likely to cause a defective printing during the printing and erasing. By incorporating needle-like conductive fillers in the back layer, these needle-like conductive fillers intertwine with each other, so that the curling caused by the heating during repeating the printing and erasing can be prevented. Further, since the filler is a needle-like filler and many edge parts of fillers may be present in the surface part of the recording medium, the surface of the recording medium is uneven, so that the conveyability of the recording medium can be improved.

Needle-like Conductive Filler

The needle-like conductive filler is not restricted and may be properly selected depending on the application. Preferred examples of the needle-like conductive filler include a needle-like crystal of which surface is treated with a conducting agent.

Examples of the needle-like crystal include titanium oxide, potassium titanate, aluminum borate, silicon carbide, silicon nitride. Among them, from the viewpoint of the easiness to control the growth of the crystal and to obtain a crystal of a stable size, titanium oxide is most preferred. Titanium oxide is also preferred from the viewpoint that titanium oxide has such a high strength not to be destroyed during the dispersion thereof in a coating liquid for preparing a coating liquid comprising titanium oxide and titanium oxide may roughen the surface of a coating formed from the above-noted coating liquid, so that the coating can maintain a surface strength and hardness.

The conducting agent is not restricted and may be properly selected depending on the application. Examples of the conducting agent include antimony doped tin oxide, tin doped indium oxide, aluminum doped zinc oxide and fluorine doped tin oxide. Among them, from the viewpoint of the stability of the surface electric resistance, the metal electric conductivity, the stability and the cost, antimony doped tin oxide is most preferred. By coating a needle-like crystal with antimony doped tin oxide, the function to discharge an electrostatic charge generated on the recording medium without presence of water is not lost from the back layer comprising such a needle-like crystal, so that the property of the back layer is independent of the humidity.

More specifically, the needle-like conductive crystal is most preferably titanium oxide which is coated with antimony-tin-oxide. The needle-like conductive filler comprising titanium oxide possesses an enhanced strength, so that the surface of the back layer is rendered to be uneven without affections of the heat and pressure generated by the thermal head during repeating the printing and erasing, and the friction between a recording medium and either the conveying roller or another recording medium.

From the viewpoint of improving the effect to discharge the electrostatic charge by being effectively piled up, the needle-like conductive crystal has preferably a longest diameter of from 1 to 10 μm and a shortest diameter of from 0.1 to 0.5 μm, more preferably a longest diameter of from 2 to 8 μm and a shortest diameter of from 0.15 to 0.4 μm and most preferably a longest diameter of from 3 to 7 μm and a shortest diameter of from 0.2 to 0.35 μm.

When the longest diameter is less than 1 μm, fillers may be ineffectively piled up, so that the effect to discharge the electrostatic charge is lowered; or by the absence of the filler through which the electrostatic charge is discharged in the surface of the coating, the surface of the back layer is smooth, so that a defect in conveyance due to sticking of the recording medium may be caused. On the other hand, when the longest diameter is more than 10 μm, the filler may largely break out on the surface of the recording medium, so that the adequate conveyance may be hindered.

When the shortest diameter is less than 0.1 μm, the strength of the filler is lowered and particularly a part of fillers which is present in the surface of the recording medium is worn during repeating the printing and erasing, it may become difficult to maintain the initial effect of the filler. On the other hand, when the shortest diameter is more than 0.5 μm, the needle-like conductive filler is so large that the surface of the recording medium is largely uneven and accordingly the adequate conveyance may be hindered.

The longest and shortest diameter of the needle-like conductive filler can be measured, for example by the observation of the surface of the back layer using the Scanning Electron Microscope (SEM).

The amount of the needle-like conductive filler in the back layer is preferably from 10 to 40% by mass, more preferably from 15 to 35% by mass, still more preferably from 17 to 25% by mass, based on the mass of the back layer.

When the amount is less than 10% by mass, the needle-like conductive fillers may be ineffectively piled up, so that a value of the surface electric resistance of the recording medium may be rapidly increased and as a result, a defect in conveyance may be induced. On the other hand, when the amount is more than 40% by mass, the surface of the recording medium may contain a lot of fillers and may be largely uneven, so that not only the conveyability of the recording medium is largely lowered, but also the conveying roller, the thermal head and other materials may be worn.

The amount of the needle-like conductive filler having a longest diameter of from 1 to 10 μm and a shortest diameter of from 0.1 to 0.5 μm in the back layer is preferably from 10 to 40% by mass, more preferably from 15 to 35% by mass, based on the mass of the back layer.

—Binder Resin—

The binder resin is not restricted and may be properly selected depending on the application. Examples of the binder resin include a thermosetting resin, an ultraviolet (UV)-curing resin and an electron beam-curing resin. Among them, an ultraviolet (UV)-curing resin and a thermosetting resin are particularly preferred.

A UV-curing resin which is already cured can form an extremely hard film and a back layer comprising the cured UV-curing resin is excellent in the repetition durability. The hardness of the surface of the back layer comprising the cured thermosetting resin is less than the hardness of the surface of the back layer comprising a cured UV-curing resin; however the back layer comprising the cured thermosetting resin is also excellent in the repetition durability.

The UV-curing resin is not restricted and may be properly selected from conventional resins depending on the application. Examples of the UV-curing resin include urethane-acrylate oligomers, epoxy-acrylate oligomers, polyester-acrylate oligomers, polyether-acrylate oligomers, vinyl oligomers, unsaturated polyester oligomers and monomers of various monofunctional or multi-functional acrylates, methacrylates, vinyl esters, ethylene derivatives and allyl compounds. Among them, multi-functional monomers or oligomers having 4 or more functionality are particularly preferred. By mixing 2 or more types of these monomers or oligomers, the hardness, the shrinkage factor, a flexibility and the strength of a coating formed from a resin comprising the above-noted mixture can be properly controlled.

Examples of the multi-functional monomer or oligomer include trimethylolpropanetriacrylate, pentaerythritoltriacrylate, triacrylate of PO added glycerin, trisacryloyloxyethylphosphate, pentaerythritoltetraacrylate, triacrylate of 3 mol-propyleneoxide added trimethylolpropane, glycerylpropoxytriacrylate, dipentaerythritol-polyacrylate, polyacrylate of caprolactone added dipentaerythritol, propionic acid-dipentaerythritol triacrylate, hydroxypival modified dimethylolpropinetriacrylate, propionic acid-dipentaerythritol tetraacrylate, ditrimethylolpropanetetraacrylate, propionic acid-dipentaerythritol pentaacrylate, trimethylolpropanetriacrylate added urethane prepolymer, dipentaerythritol-hexaacrylate (DPHA), ε-caprolactone added DPHA.

For curing the above-noted monomers or oligomers by means of UV, it is necessary to use the photopolymerization initiator and photopolymerization accelerator.

The photopolymerization initiator may be summarily divided into radical reaction type and ion reaction type and further the radical reaction type may be divided into photocleavage type and hydrogen-pull type.

Examples of the photopolymerization initiator include isobutylbenzoinether, isopropylbenzoinether, benzoinethylether benzoinmethylether, 1-phenyl-1,2-propanedione-2-(o-ethoxycarbonyl)oxime,2,2-dimethoxy-2-phenylacetophenonebenzyl, hydroxycyclohexylphenylketone, diethoxyacetophenone, 2-hydrox-2-methyl-1-phenylpropane-1-one, benzophenone, chlorothioxanthone, 2-chlorothioxanthone, isopropylthioxanthone, 2-methylthioxanthone, chloro-substituted benzophenone. These photopolymerization initiators may be used individually or in combination, however, they should not be construed as limiting the scope of the present invention.

As the photopolymerization accelerator, a photopolymerization accelerator having the effect to improve the curing rate of the resin in relation with a photopolymerization initiator of hydrogen-pull type, such as benzophenone type and thioxanthone type is preferred. Examples of the accelerator include aromatic tertiary amines and aliphatic amines. Specific examples of the accelerator include p-dimethylaminobenzoic acid isoamyl ester and p-dimethylaminobenzoic acid ethyl ester. These accelerators may be used individually or in combination.

The amount of the photopolymerization initiator or accelerator is preferably from 0.1 to 20% by mass, more preferably from 1 to 10% by mass, based on the total mass of the resin composition in the back layer.

The thermosetting resin is not restricted and may be properly selected from conventional resins depending on the application. Examples of the thermosetting resin include a resin having a group which can react with a crosslinker, such as a hydroxyl group and a carboxyl group, and a resin produced by copolymerizing a monomer having a hydroxyl group or a carboxyl group and another monomer. Specific examples of the above-noted thermosetting resin include phenoxy resins, polyvinyl butyral resins, celluloseacetate propionate resins, celluloseacetate butyrate resins, acrylpolyol resins, polyesterpolyol resins, polyurethanepolyol resins. Among them, acrylpolyol resins, polyesterpolyol resins, polyurethanepolyol resins are particularly preferred.

The acrylpolyol resin can be synthesized by using a (meth)acrylic ester monomer and at least one unsaturated monomer selected from the group consisting of an unsaturated monomer having carboxyl group, an unsaturated monomer having hydroxyl group and an unsaturated monomer having ethylene group according to a conventional polymerization method, such as a solution polymerization, a suspension polymerization and an emulsion polymerization.

Examples of the unsaturated monomer having hydroxyl group include hydroxyethylacrylate (HEA), hydroxypropylacrylate (HPA), 2-hydroxyethylmethacrylate (HEMA), 2-hydroxypropylmethacrylate (HPMA), 2-hydroxybutylmonoacrylate (2-HBA), and 1,4-hydroxybutylmonoacrylate (1-HBA). Since a coating formed from a resin produced using a monomer having a primary hydroxyl group exhibits excellent cracking resistance and excellent durability, 2-hydroxyethylmethacrylate is preferably used.

From the viewpoint of improving repetition durability of the printing and erasing images, the acrylpolyol resin may be preferably crosslinked by using a crosslinker. The crosslinking can be performed by means of heat, UV or electron beam. Among them, from the viewpoint of easiness to perform at a low cost and requiring no long-term for curing, the crosslinking by means of heat or UV is preferred.

The crosslinker is not restricted and may be properly selected depending on the application. Examples of the crosslinker include isocyanates, amino resins, phenol resins, amines, and epoxy compounds. Among them, isocyanates are preferred. Further, among isocyanates, polyisocyanate compounds having plural isocyanate groups are particularly preferred.

Examples of the isocyanates include hexamethylenediisocyanate (HDI), tolylenediisocyanate (TDI), xylylenediisocyanate (XDI) and modified forms of these isocyanates, such as trimethylpropane added form, buret modified form, isocyanurate modified form and blocked form.

A preferred amount of the crosslinker is such an amount that a ratio of the number of functional groups contained in the crosslinker to the number of active groups contained in the binder resin becomes from 0.01 to 2 by the amount of the crosslinker. When an amount of the crosslinker is not more than the above-noted preferred amount, the thermal resistance of the recording medium becomes unsatisfactory; on the other hand, when not less than the above-noted preferred amount, the color-developing, -erasing property of the recording medium becomes impaired.

As the crosslinking accelerator, a catalyst which is used generally for similar reactions to the crosslinking may be employed. Examples of the crosslinking accelerator include tertiary amines such as 1,4-diaza-bicyclo(2,2,2)octane and metal compounds such as organotin compounds.

The gel fraction of a thermosetting resin crosslinked by means of heat is preferably 30% or more, more preferably 50% or more, still more preferably 70% or more. When the gel fraction is less than 30%, the crosslinking effect and the durability of the crosslinked resin may be unsatisfactory.

The hydroxyl value of the thermosetting resin is preferably 70 KOHmg/g or more, more preferably 90 KOHmg/g or more. When the hydroxyl value is 70 KOHmg/g or more, the durability of the resin, the surface hardness of a coating formed from the resin and the cracking resistance of the resin can be improved.

The back layer may comprise, besides the above-noted needle-like filler and the above-noted binder resin, optionally other components, such as other fillers, lubricants and pigments.

The other fillers are not restricted so long as the filler is other than a needle-like conductive filler and may be in the form of sphere. Examples of the other fillers include inorganic fillers and organic fillers.

Examples of inorganic fillers include carbonate salts, silicate salts, metal oxides, sulfuric acid compounds. Examples of organic fillers include silicone resins, cellulose resins, epoxy resins, nylon resins, phenol resins, polyurethane resins, urea resins, melamine resins, polyester resins, polycarbonate resins, styrene resins, acryl resins, polyethylene resins, formaldehyde resins and polymethylmethacrylate resins.

The amount of the other filler in the back layer is preferably from 1 to 20% by mass, based on the mass of the back layer.

When the amount is less than 1% by mass, the effect to improve the surface property of the back layer by incorporating fillers may be fatally impaired. On the other hand, when the amount is more than 20% by mass, the effect of the needle-like conductive filler to prevent the electrostatic charge on the recording medium may be impaired by incorporating the other filler.

Examples of the lubricant include synthetic waxes, vegetable waxes, animal waxes, higher alcohols, higher aliphatic acids, higher aliphatic acid esters, and amides. For making it easy to distinguish the surface of the recording medium from the reverse surface thereof, the back layer may be colored by incorporating a coloring agent as the lubricant. Examples of a preferred coloring agent include dyes and pigments. Since the thermal hysteresis is repeatedly induced on the back layer, pigments are particularly preferred.

The method for disposing the back layer is not restricted and may be properly selected depending on the application. Examples of the method include a method in which the back layer is disposed by using a coating liquid which is prepared by mixing and dispersing the needle-like conductive filler, the binder resin and the other additives uniformly into a solvent.

The solvent is not restricted and may be properly selected depending on the application. Examples of the solvent include water, alcohols, ketones, amides, ethers, glycols, glycol ethers, glycol ester acetates, esters, aromatic hydrocarbons, aliphatic hydrocarbons, halogenated hydrocarbons, sulfoxides and pyrrolidones. Specific examples of preferred solvents among the above-noted solvents include water, methanol, ethanol, isopropanol, n-butanol, acetone, methyl ethyl ketone, methyl isobutyl ketone, cyclohexanone, N,N-dimethylformamide, N,N-dimethylacetoamide, tetrahydrofuran, 1,4-dioxane, 3,4-dihydro-2H-pyran, 2-methoxyethanol, 2-ethoxyethanol, 2-butoxyethanol, methyl acetate, ethyl acetate, butyl acetate, toluene, xylene, hexane, heptane, cyclohexane and dimethyl sulfoxide. Among them, particularly preferred are water, isopropanol, n-butanol, methyl ethyl ketone, methyl isobutyl ketone, cyclohexanone, tetrahydrofuran, ethyl acetate, butyl acetate, toluene and xylene.

The coating liquid can be prepared by means of a conventional apparatus for preparing a coat liquid, such as paint shaker, ball mill, attritor, triple roll mill, kedy mill, sand mill, dyno mill and colloid mill.

The disposing process of the back layer by the coating of the support is not restricted and may be properly selected depending on the application. For example, the support is subjected to a coating apparatus in the form of a continuous sheet supplied from a roll or a cut sheet, then the coating liquid is applied on a sheet according to a conventional process, such as blade, wire-bar, spray, air-knife, bead, curtain, gravure, kiss, reverse roll, dip and die coating process. Thereafter, a coated sheet is conveyed into a blower dryer and dried at from 30 to 150° C. for from 10 seconds to 10 minutes.

For performing the coating process with zero defect, before the process or during supplying the coating liquid, the liquid may be subjected to filtration by means of a net, such as a stainless mesh and a nylon mesh, or a natural or synthetic fiber filter, such as a cotton filter and a carbon fiber filter and ultrasonic vibration for 1 minutes to 200 hours, more preferably 10 minutes to 80 hours so as to remove contaminations and bubbles and to prevent the coagulation of the flocked dispersion.

The coating process is preferably performed in a clean room of class 10,000 or less. For drying the support coated with the back layer, it is preferred that air or an inert gas, such as nitrogen gas which has been subjected to a filter and a dehumidifier and heated beforehand, is blown to the surface, the reverse surface or both of them of the support coated with the back layer. Among these pretreatments of the coating liquid, the filtration by means of a cotton filter or a membrane filter and the ultrasonic irradiation are preferred. By using a properly selected apparatus from the above-noted apparatus, the uniformity of the coated layer on the back layer can be improved.

When the back layer comprises a thermosetting resin, it is preferred that the coated support is optionally subjected to a curing process after the coating and drying. By the curing process, not only the thermal crosslinking can be accelerated, but also removing a residual solvent can stabilize the quality of the disposed back layer. The curing process may be performed by means of a thermostat, either at a relative higher temperature for a shorter period or at a relative lower temperature for a longer period. The curing condition is preferably of at from 10 to 130° C. and for from 1 minutes to 200 hours, more preferably of at from 15 to 100° C. and for from 2 minutes to 180 hours.

With respect to disposing the back layer, since the productivity is important, it is difficult to take time in completing the crosslinking. From this standpoint, the curing condition is preferably of at from 40 to 100° C. and for from 2 minutes to 120 hours. The curing may be performed either by directing a warm wind at the coated surface of the support or by laying the coated support in the form of a roll or cut sheets in a thermostat. When a higher temperature is undesirable, the drying may be performed by drying under a reduced pressure. With respect to the drying, either by elevating or lowering the drying temperature gradually or by repeating the drying after the back layer has been also coated with another layer or dividing a drying period into plural times, either the properties of the back layer can be controlled or the efficiency of the production process can be improved.

The film formation by means of UV rays is preferably performed through a photopolymerization reaction by means of UV irradiation apparatus after drying the coating. The UV curing may be performed by means of conventional UV irradiation apparatus. Examples of the UV radiation source include a mercury lump, a metal halide lump, a gallium lump, a mercury xenon lump and a flash lump.

As the source, a source having an emission spectrum corresponding to the wave length of UV which is absorbed by the photopolymerization initiator or photopolymerization accelerator may be used. With respect to the irradiation condition, an out put of the lamp and a conveying rate of the sheet may be determined in accordance with a required irradiation energy for crossliking the resin. When the crosslinking-curing is performed by means of the electron beam, the electron beam irradiation apparatus may be selected from the group consisting of a scanning type apparatus and a non-scanning type apparatus according to the purpose, such as an irradiation area and an irradiation dose. With respect to the specific irradiation condition, the electric current, the irradiation width and the conveying rate of the sheet may be determined according to a required dose for the crosslinking of the resin.

In the thermoreversible recording medium according to the present invention, the value of the surface resistance of the back layer (the bare most outer surface) is preferably $1\times10^{11}$ ohm/square or less as measured at any temperature in the range of from 5 to 30° C. and under any relative humidity in the range of from 30 to 85 RH %. When the surface resistance is $1\times10^{12}$ ohm/square or more, the back layer exhibits the property of being charged. When the resistance is $1\times10^{12}$ ohm/square or less, the back layer exhibits the property of being charged and rapidly discharged. When the resistance is $1\times10^{9}$ ohm/square or less, the back layer does not exhibit the property of being charged. When the surface resistance of a coating film having a surface resistance of $1\times10^{11}$ ohm/square is measured under a lower relative humidity, a measured resistance may become $1\times10^{12}$ ohm/square or more. This is because, even when an antistatic agent used in the back layer is not affected by the humidity, the effect of the antistatic agent is impaired, because the binder resin itself is charged. By producing the back layer according to such a specification that the surface resistance of the back layer can maintain a value of $1\times10^{11}$ ohm/square or less at any temperature in the range of from 5 to 30° C. and under any relative humidity in the range of from 30 to 85 RH %, the electrostatic charge on the back layer can be prevented at above-noted temperatures and under above-noted relative humidities and a defect in conveyance may not be caused.

The surface resistance can be measured, for example by means of a conventional surface resistance measuring apparatus.

<Protective Layer>

In the thermoreversible recording medium according to the present invention, for protecting the thermosensitive layer, the protective layer is disposed on the thermosensitive layer. The protective layer is not restricted and may be properly selected depending on the application. The configuration thereof may be of a laminated layer of plural layers. Particularly, the protective layer is preferably located at the most outer (inner) surface on which no layer is disposed.

The protective layer may comprise a needle-like conductive filler or no needle-like conductive filler; however from the viewpoint of preventing a defect in conveyance, such as the multi feeding and the paper jam of the recording medium, the protective layer comprise preferably the needle-like conductive filler filler. As the needle-like conductive filler for the protective layer, the same filler as a filler used in the back layer may be used.

The surface resistance of the protective layer (the bare most outer surface) is preferably $1\times10^{11}$ ohm/square or less at any temperature in the range of from 5 to 30° C. and under any relative humidity in the range of from 30 to 85 RH %.

The amount of the needle-like conductive filler in the protective layer is preferably from 10 to 40% by mass, more preferably from 15 to 35% by mass, still more preferably from 17 to 25% by mass, based on the mass of the protective layer.

The protective layer may comprise, besides the needle-like conductive filler, the binder resin and other components.

Examples of the binder resin include a thermosetting resin, an ultraviolet (UV)-curing resin and an electron beam-curing resin. By disposing the protective layer comprising either the same ultraviolet (UV)-curing resin as an ultraviolet (UV)-curing resin comprised in the back layer or the same thermosetting resin as a thermosetting resin comprised in the back layer, the balance between the curling caused on the protective layer and the curling caused on the back layer can be maintained. That is, during repeating the printing and erasing, the recording medium is heated by a thermal head, a heat roller and an erase bar, thereby causing the shrink of the resin and the UV-curing resin has an particularly large shrinkage factor which is a little smaller than the shrinkage factor of the UV-curing resin; therefore, by disposing the protective layer comprising either the same ultraviolet (UV)-curing resin or the same thermosetting resin as either an ultraviolet (UV)-curing resin or a thermosetting resin comprised in the back layer, the balance between the curling caused on the protective layer and the curling caused on the back layer can be maintained. On the other hand, when the protective layer comprises a different ultraviolet (UV)-curing resin (or a different thermosetting resin) from an ultraviolet (UV)-curing resin (or a thermosetting resin) comprised in the back layer, due to the difference of resin properties between the two resins, the recording medium is easily charged when two recording media are contacted with each other, so that the recording medium cannot exhibit satisfactorily the effect of the anti-static filler.

The thickness of the protective layer is not restricted and may be properly selected depending on the application. For example, the thickness is preferably from 0.1 to 10.0 μm. When the thickness is less than 0.1 μm, the above-noted effect of protecting the thermosensitive layer by the protective layer is unsatisfactory. On the other hand, when the thickness is more than 10.0 μm, thermal sensitivity of the recording medium may be impaired.

In the thermoreversible recording medium, a difference of the static friction coefficient between the back layer and the protective layer, two back layers, or two protective layers is preferably 0.1 or less, respectively.

This preferred difference is for preventing a defect in conveyance of the recording medium which may be caused, when the recording media are set into the printer in such a wrong setting order that the reverse surface of a recording medium faces to the reverse surface of another recording medium. The recording media set in the printer are conveyed as an individual recording medium by the separating pad and the conveying roller. When the above-noted difference of the static friction coefficient is more than 0.1, a frictional force is caused between two recording media, so that recording media cannot be separated into an individual recording medium by the separating pad and the conveying roller. Ideally, the closer to 0 each difference of the static friction coefficient among the recording media is, the more preferred.

The static friction coefficient between the back layer and the protective layer, two back layers or two protective layers is preferably from 0.05 to 0.3, respectively.

When the static friction coefficient is less than 0.05, piled recording media may easily slip, so that maintaining a state in which recording media are piled up becomes difficult, and then recording media become difficult to handle. Further, piled recording media may move easily and may rub each other frequently, so that disadvantage is likely to be caused wherein recording media may get many scratches. When the static friction coefficient is more than 0.3, a frictional force between two recording media becomes larger, in the relationship between a frictional force between the surface of the recording medium and the conveying roller and a frictional force between the reverse surface of the recording medium and the separating pad, a frictional force between the reverse surface and the separating pad becomes nearer to a frictional force between two recording media or becomes larger than a frictional force between two recording media, and accordingly the recording media cannot be conveyed. Further, the specification of the separating pad becomes narrow limited.

<Thermosensitive Layer>

The thermosensitive layer comprises a material which reversibly changes the color depending on the temperature. The thermosensitive layer comprises at least an electron-donating coloring compound and an electron-accepting compound, and also a decoloring accelerator, binder resin and optionally further other components.

The above-noted "reversibly change the color depending on the temperatures" means a phenomenon in which visible changes are induced reversibly depending on the temperature change, in other words, it means that a relatively coloring condition and a relatively erasing condition may be produced depending on the heating temperature and the cooling rate after the heating. In this meaning, visible changes are summarily divided into the change of the color condition and the change of the form. In the present invention, a material which can cause the change of the color condition is mainly used. The change of the color condition includes changes of transmittance, reflectivity, absorption wavelength and scattering coefficient. Actual thermoreversible recording media indicate informations by the combination of these changes. More specifically, the material for the thermosensitive layer is not restricted so long as the transparency and the color tone of the material can be reversibly changed by the heating and the material may be properly selected depending on the application. Examples of the material include a material which is in a first color condition at a first specific temperature which is higher than normal temperature, and which is in a second color condition when the material is heated at a second specific temperature which is higher than the first specific temperature and cooled. Among such materials, a material is particularly preferably used, wherein the material is in another color condition at a first specific temperature than a color condition at a second specific color condition.

Examples of a material which is preferably used as noted above include a material which is in transparent color condition at a first specific temperature and is in white opaque color condition at a second specific temperature (JP-A No. 55-154198), a material which is in a coloring condition at a second temperature and is in a color-erased condition at a first temperature (JP-A Nos. 4-224996, 4-247985 and 4-267190), a material which is in white opaque color condition at a first specific temperature and is in transparent color condition at a second specific temperature (JP-A No. 3-169590) and a material which is in black, red or blue color condition at a first specific temperature and is in a erasing condition at a second temperature (JP-A Nos. 2-188293 and 2-188294).

As noted above, the thermoreversible recording medium according to the present invention may be in a relatively coloring condition and a relatively erasing condition depending on the heating temperature and/or cooling rate after the heating. Hereinbelow, explanations are given with respect to the essential color developing-erasing phenomenon of the composition according to the present invention, which comprises the coloring agent and color developer. FIG. 1 shows the relation between the developed color density and the temperature with respect to the thermoreversible recording medium. When the recording medium in the initial erasing condition (A) is heated, a color of the medium is developed at the temperature T1 where the medium begins to be moltend and comes into the molten and coloring condition (B). When the medium in the molten and coloring condition (B) is cooled rapidly, the temperature of the medium can be lowered to the room temperature while the medium maintains the color-developed condition, thereby the medium comes into the solid coloring condition (C). Whether the medium can come into the solid coloring condition (C) or not depends on the cooling rate from the molten and coloring condition (B) as follows. When the medium in the molten and coloring condition (B) is cooled slowly, the medium comes into the erasing condition (A) or into a condition in which a density of the developed color is relative lower than a density of the developed color in the solid coloring condition (C). On the other hand, when the medium in the solid coloring condition (C) is heated again, a color of the medium is erased at the temperature T2 which is lower than the above-noted coloring temperature T1 (from D to E) and from here (E), when the medium is cooled, the medium returns into the initial erasing condition (A). Since actual color-developed and color-erased temperatures vary depending on an amount ratio between the coloring agent and color developer, the coloring and erasing temperatures can be properly selected depending on the application purpose of the medium. Further, the color density of the medium in the molten and coloring condition (B) is not always the same as the color density of the medium in the solid coloring condition (C).

In the recording medium, the color-developed condition (C) obtained through rapid cooling from the molten condition is a condition in which the coloring agent and color developer are mixed in such a state that they can react through a molecular contact and the color-developed condition may be often in a solid state. It is believed that the coloring condition (C) is a condition in which the coloring agent and color developer are agglomerated together, thereby maintaining a developed color and the formation of the agglomerated condition may stabilize the color-developed condition. On the other hand, in the erasing condition, the coloring agent and color developer are separated into two phases. It is believed that the erasing condition is a condition in which molecules of at least one of the coloring agent and color developer are aggregated to form a domain or to be crystallized and by the aggregation or the crystallization, the coloring agent and color developer are stably separated. In many cases, a condition in which the developed color is completely erased is formed through such a reaction that the coloring agent and color developer are separated into two phases and the color developer is crystallized. In both a erasing condition formed by slow cooling from the molten coloring condition and a color-erased condition formed by the heating from the solid color-developed condition as shown in FIG. 1, the agglomeration condition is changed at this temperature and the separation into two phases or the crystallization of the color developer is caused.

In the recording medium, the coloring recording may be formed by heating up to the temperature at which the coloring agent and color developer are molten and mixed by means of the thermal head and cooling rapidly. On the other hand, the methods for erasing the color include such two methods as a method in which the recording medium is cooled slowly from the molten coloring condition and a method in which the recording medium is heated to a little lower temperature than the color-developed temperature. The two methods are equivalent to each other in the meaning that the recording medium is temporally maintained at the temperature at which the coloring agent and color developer are separated into two phases or at least one of them is crystallized.

The rapid cooling in the formation of the color-developed condition is performed so as not to maintain the recording medium at the temperature for either the phase-separation of the coloring agent and color developer or the crystallization. The terms of "rapid cooling" and "slow cooling" represent no more than a relative cooling rate with respect to a certain composition and the actual cooling rate is altered depending on the combination of the coloring agent and color developer.

Electron-Accepting Compound

The electron-accepting compound (color developer) is not restricted so long as the compound can perform reversibly the color developing and erasing by the heating and may be properly selected depending on the application. Preferred examples of the electron-accepting compound include a compound having in the molecule at least one structure selected from the group consisting of (i) a structure which has a color-developing function to develop the color of an electron-donating coloring compound (coloring agent) (e.g., a phenolic hydroxyl group, a carboxylic acid group or a phosphoric acid group) and (ii) a structure which can control an intermolecular cohesive force (a group to which a long-chain hydrocarbon group is bonded). With respect to a structure of (ii), a bonding part between a group and a long-chain hydrocarbon group may contain a divalent or more bonding group containing a hetero atom and a long-chain hydrocarbon group may contain at least one of the same bonding group as the above-noted bonding group and an aromatic group. Among these compounds, a phenol compound represented by the following formula (1) is particularly preferred.

Formula (1)

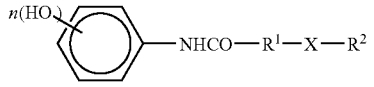

wherein "n" represents an integer of 1 to 3; "X" represents a divalent organic group containing nitrogen atom or oxygen atom; $R^1$ and $R^2$ respectively represent an aliphatic hydrocarbon group which may be substituted with other substituents.

"$R^1$" represents an aliphatic hydrocarbon group having two or more carbon atoms, particularly preferably 5 or more carbon atoms, which may be further substituted with other substituents.

"$R^2$" represents a $C_2$ to $C_{24}$, preferably $C_8$ to $C_{18}$ aliphatic hydrocarbon group, which may be further substituted with other substituents.

The aliphatic hydrocarbon group may be linear or branched and may contain an unsaturated bond. Examples of the substituent which is bonded to the above-noted aliphatic hydrocarbon group include a hydroxyl group, a halogen atom and an alkoxy group. When the sum of the number of carbon atoms in $R^1$ and $R^2$ is 7 or less, the stability and the erasing property of a developed color are lowered, therefore the sum of the number of carbon atoms is preferably 8 or more, more preferably 11 or more.

Preferred examples of "$R^1$" include groups represented by the following formulae:

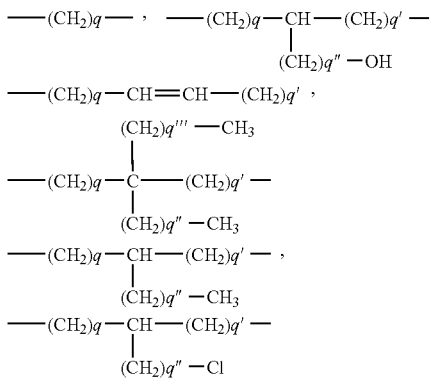

wherein q, q', q'', and q''' represent integers which are corresponding to the above-noted numbers of carbon atoms in $R^1$ and $R^2$, respectively. Among these groups, particularly preferred is —$(CH_2)q$-.

Examples of "$R^2$" include groups represented by the following formulae:

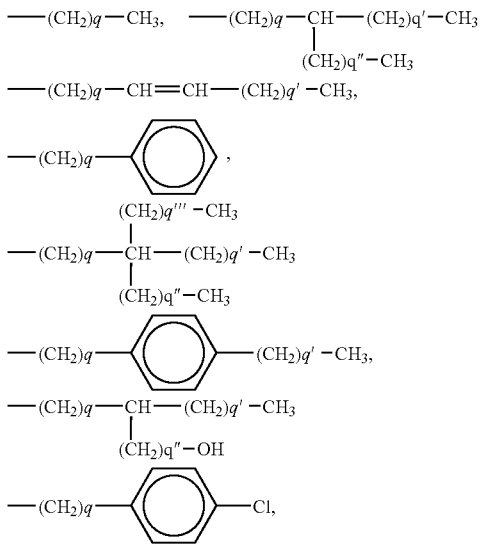

wherein q, q', q'', and q''' represent integers which are corresponding to the above-noted numbers of carbon atoms in $R^1$ and $R^2$, respectively. Among these groups, particularly preferred is —$(CH_2)q$-$CH_3$.

"X" represents a divalent organic group containing a nitrogen atom or an oxygen atom, which contains at least one group selected from the group consisting of the groups represented by the following formulae:

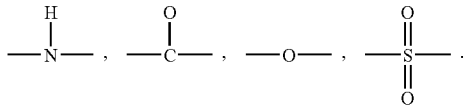

Preferred examples of the above-noted divalent organic group include the groups represented by the following formulae:

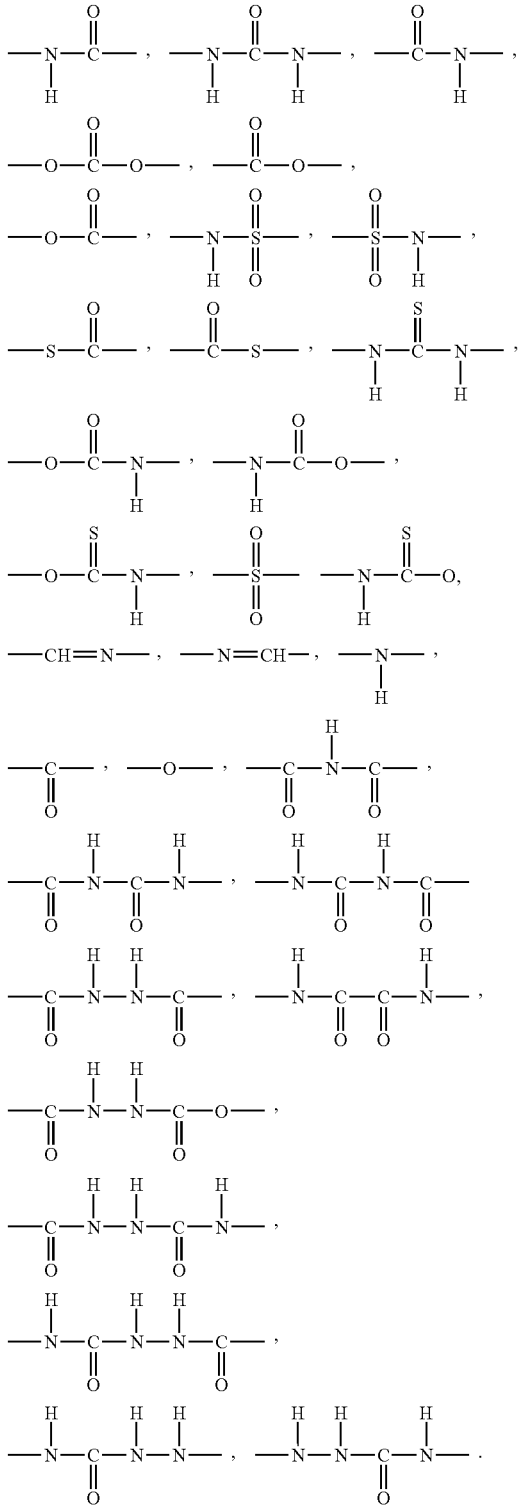

Examples of particularly preferred groups among the above-exemplified divalent organic groups include the groups represented by the following formulae:

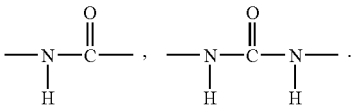

Preferred examples of the phenol compound represented by the formula (1), include the compounds represented by the following formulae (2) and (3).

Formula (2)

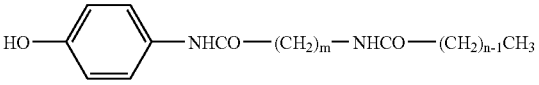

Formula (3)

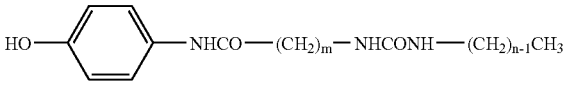

wherein in the formulae (2) and (3), "m" represents an integer of any one of 5 to 11 and "n" represents an integer of any one of 8 to 22.

Specific examples of the phenol compounds represented by the formulae (2) and (3) include the compounds represented by the following formulae:

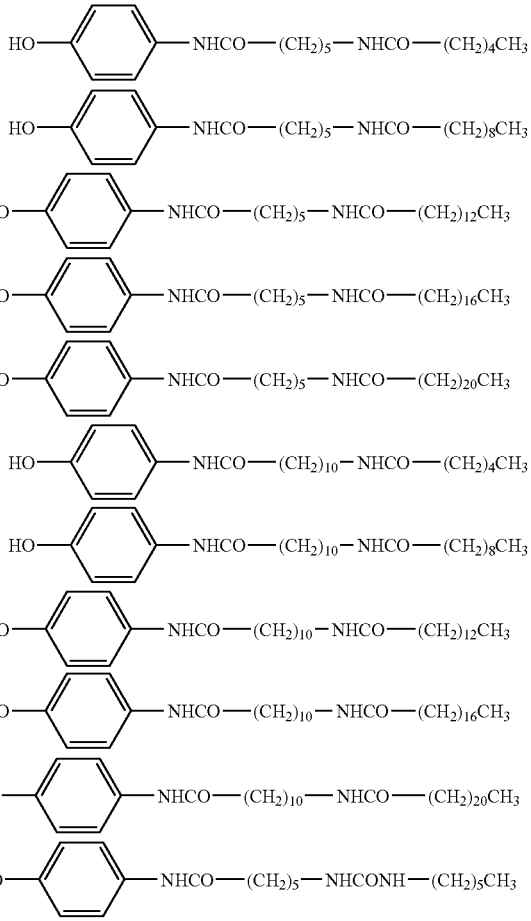

-continued

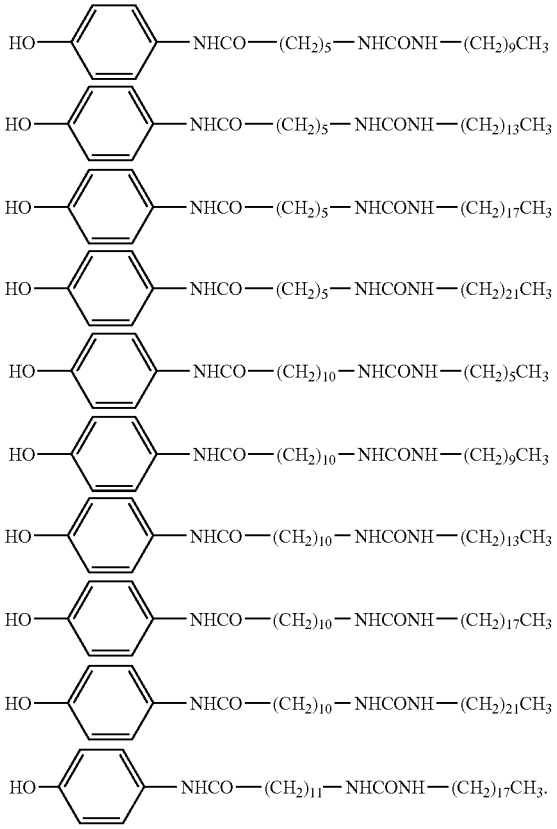

Electron-Donating Coloring Compounds

The electron-donating coloring compound (coloring agent) is not restricted and may be properly selected depending on the application. Preferred examples of the electron-donating coloring compound include leuco dyes.

Preferred examples of the leuco dyes include fluoran compounds and azaphthalide compounds. Specific examples of fluoran compounds or azaphthalide compounds include 2-anilino-3-methyl-6-diethylaminofluoran,
2-anilino-3-methyl-6-(di-n-butylamino)fluoran,
2-anilino-3-methyl-6-(N-n-propyl-N-methylamino)fluoran,
2-anilino-3-methyl-6-(N-isopropyl-N-methylamino)fluoran,
2-anilino-3-methyl-6-(N-isobutyl-N-methylamino)fluoran,
2-anilino-3-methyl-6-(N-n-amyl-N-methylamino)fluoran,
2-anilino-3-methyl-6-(N-sec-butyl-N-methylamino)fluoran,
2-anilino-3-methyl-6-(N-n-amyl-N-ethylamino)fluoran,
2-anilino-3-methyl-6-(N-n-isoamyl-N-ethylamino)fluoran,
2-anilino-3-methyl-6-(N-n-propyl-N-isopropylamino)-fluoran,
2-anilino-3-methyl-6-(N-cyclohexyl-N-methylamino)-fluoran,
2-anilino-3-methyl-6-(N-ethyl-p-toluidino)fluoran,
2-anilino-3-methyl-6-(N-methyl-p-toluidino)fluoran,
2-(m-trichloromethylanilino)-3-methyl-6-diethylaminofluoran,
2-(m-trifluoromethylanilino)-3-methyl-6-diethylaminofluoran,
2-(m-trichloromethylanilino)-3-methyl-6-(N-cyclohexyl-N-methylamino)fluoran,
2-(2,4-dimethylanilino)-3-methyl-6-diethylaminofluoran, 2-(N-ethyl-p-toluidino)-3-methyl-6-(N-ethylanilino)fluoran,
2-(N-ethyl-p-toluidino)-3-methyl-6-(N-propyl-p-toluidino)fluoran,
2-anilino-6-(N-n-hexyl-N-ethylamino)fluoran,
2-(o-chloroanilino)-6-diethylaminofluoran,
2-(o-chloroanilino)-6-dibutylaminofluoran,
2-(m-trifluoromethylanilino)-6-diethylaminofluoran,
2,3-dimethyl-6-dimethylaminofluoran,
3-methyl-6-(N-ethyl-p-toluidino)fluoran,
2-chloro-6-diethylaminofluoran, 2-bromo-6-diethylaminofluoran,
2-chloro-6-dipropylaminofluoran, 3-chloro-6-cyclohexylaminofluoran,
3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran,
2-(o-chloroanilino)-3-chloro-6-cyclohexylaminofluoran,
2-(m-trifluoromethylanilino)-3-chloro-6-diethylaminofluoran,
2-(2,3-dichloroanilino)-3-chloro-6-diethylaminofluoran,
1,2-benzo-6-diethylaminofluoran,
3-diethylamino-6-(m-trifluoromethylanilino)fluoran,
3-(1-ethyl-2-methylindole-3-yl)-3-(2-ethoxy-4-diethylaminophenyl)-4-azaphthalide,
3-(1-octyl-2-methylindole-3-yl)-3-(2-ethoxy-4-diethylaminophenyl)-4-azaphthalide,
3-(1-ethyl-2-methylindole-3-yl)-3-(2-ethoxy-4-diethylaminophenyl)-7-azaphthalide,
3-(1-ethyl-2-methylindole-3-yl)-3-(2-methyl-4-diethylaminophenyl)-4-azaphthalide,
3-(1-ethyl-2-methylindole -3-yl)-3-(2-methyl-4-diethylaminophenyl)-7-azaphthalide,
3-(1-ethyl-2-methylindole-3-yl)-3-(4-diethylaminophenyl)-4-azaphthalide,
3-(1-ethyl-2-methylindole-3-yl)-3-(4-N-n-amyl-N-methylaminophenyl)-4-azaphthalide,
3-(1-methyl-2-methylindole-3-yl)-3-(2-hexyloxy-4-diethylaminophenyl)-4-azaphthalide,
3,3-bis(2-ethoxy-4-diethylaminophenyl)-4-azaphthalide, and
3,3-bis(2-ethoxy-4-diethylaminophenyl)-7-azaphthalide.

Examples of the electron-donating coloring compound (coloring agent) include, besides the above-noted fluoran and azaphthalide compounds, conventional leuco dyes, such as 2-(p-acetylanilino)-6-(N-n-amyl-N-n-butylamino)fluoran,
2-benzylamino-6-(N-ethyl-p-toluidino)fluoran,
2-benzylamino-6-(N-methyl-2,4-dimethylanilino)fluoran,
2-benzylamino-6-(N-ethyl-2,4-dimethylanilino)fluoran,
2-dibenzylamino-6-(N-methyl-p-toluidino)fluoran,
2-dibenzylamino-6-(N-ethyl-p-toluidino)fluoran,
2-(di-p-methylbenzylamino)-6-(N-ethyl-p-toluidino)fluoran,
2-(α-phenylethylamino)-6-(N-ethyl-p-toluidino)fluoran,
2-methylamino-6-(N-methylanilno)fluoran,
2-methylamino-6-(N-ethylanilino)fluoran,
2-methylamino-6-(N-propylanilino)fluoran,
2-ethylamino-6-(N-methyl-p-toluidino)fluoran,
2-methylamino-6-(N-methyl-2,4-dimethylanilino)fluoran,
2-ethylamino-6-(N-ethyl-2,4-dimethylanilino)fluoran,
2-dimethylamino-6-(N-methylanilino)fluoran,
2-dimethylamino-6-(N-ethylanilino)fluoran,
2-diethylamino-6-(N-methyl-p-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran,
2-amino-6-(N-methylanilino)fluoran,
2-amino-6-(N-ethylanilino)fluoran,
2-amino-6-(N-propylanilino)fluoran,
2-amino-6-(N-methyl-p-toluidino)fluoran,
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran,
2-amino-6-(N-propyl-p-ethylanilino)fluoran,
2-amino-6-(N-methyl-2,4-dimethylanilino)fluoran,
2-amino-6-(N-ethyl-2,4-dimethylanilino)fluoran,
2-amino-6-(N-propyl-2,4-dimethylanilino)fluoran,
2-amino-6-(N-methyl-p-chloroanilino)fluoran,
2-amino-6-(N-ethyl-p-chloroanilino)fluoran,
2-amino-6-(N-propyl-p-chloroanilino)fluoran,
1,2-benzo-6-(N-ethyl-N-isoamylamino)fluoran,
1,2-benzo-6-dibutylaminofluoran,
1,2-benzo-6-(N-ethyl-N-cyclohexylamino)fluoran, and
1,2-benzo-6-(N-ethyl-N-toluidino)fluoran.

These compounds may be used individually or in combination. Further, by laminating plural layers which develop color in a different color tone, respectively, the image can be either in "multi color" or "full color".

The mixing ratio of the electron-donating coloring compound (coloring agent) to the electron-accepting compound (color developer) cannot be sweepingly determined, since the appropriate range of the ratio varies depending on the combination of a coloring agent used and a color developer used. The ratio of the color developer to 1 mol of the coloring agent is preferably in the range of from 0.1 to 20 mol, more preferably from 0.2 to 10 mol. Whether the ratio of the color developer is larger than this range or not, a disadvantage is likely to be caused wherein the density of the developed color is lowered. Further, the coloring agent and color developer can be used in a microcapsule encapsulated.

Erasing Accelerator

In the present invention, when the color developer is used in combination with an erasing accelerator, such as a compound having in the molecule at least one group of amide group, urethane group and urea group, an intermolecular reaction is induced between the erasing accelerator and the color developer during forming a state of erasing, so that the erasing rate can be markedly elevated.

The erasing accelerator may be a compound having in the molecule at least one group of an amide group, an urethane group and an urea group. Among the above-noted compounds, compounds represented by the following formulae (4) to (10) are particularly preferred.

$$R^4—NHCO—R^5 \quad \text{Formula (4)}$$

$$R^4—NHCO—R^6—CONH—R^5 \quad \text{Formula (5)}$$

$$R^4—CONH—R^6—NHCO—R^5 \quad \text{Formula (6)}$$

$$R^4—NHCOO—R^5 \quad \text{Formula (7)}$$

$$R^4—NHCOO—R^6—OCONH—R^5 \quad \text{Formula (8)}$$

$$R^4—OCONH—R^6—NHCOO—R^5 \quad \text{Formula (9)}$$

Formula (10)

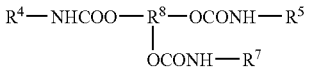

wherein $R^4$, $R^5$, and $R^7$ in the formulae (4) to (10) represent a $C_7$ to $C_{22}$ linear alkyl group, a $C_7$ to $C_{22}$ branched alkyl group and a $C_7$ to $C_{22}$ unsaturated alkyl group, respectively. $R^6$ represents a $C_1$ to $C_{10}$ divalent functional group. $R^8$ represents a $C_4$ to $C_{10}$ trivalent functional group.

Examples of $R^4$, $R^5$, and $R^7$ include a heptyl group, an octyl group, a nonyl group, a decyl group, an undecyl group, a dodecyl group, a stearyl group, a behenyl group, and an oleyl group.

Examples of $R^6$ include a methylene group, an ethylene group, a propylene group, a buthylene group, a heptamethylene group, a hexamethylene group, an octamethylene group, a $—C_3H_6OC_3H_6—$ group, a $—C_2H_4OC_2H_4—$ group and a $—C_2H_4OC_2H_4OC_2H_4—$ group.

Preferred examples of $R^8$ include the compounds represented by the following formulae:

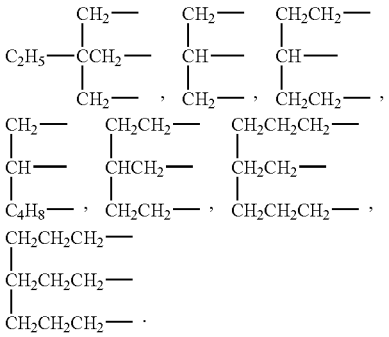

Preferred specific examples of the compounds represented by the formulae (4) to (10) include the compounds represented by the following formulae (1) to (81).

$C_{11}H_{23}CONHC_{12}H_{25}$ (1)

$C_{15}H_{31}CONHC_{16}H_{33}$ (2)

$C_{17}H_{35}CONHC_{18}H_{37}$ (3)

$C_{17}H_{35}CONHC_{18}H_{35}$ (4)

$C_{21}H_{41}CONHC_{18}H_{37}$ (5)

$C_{15}H_{31}CONHC_{18}H_{37}$ (6)

$C_{17}H_{35}CONHCH_2NHCOC_{17}H_{35}$ (7)

$C_{11}H_{23}CONHCH_2NHCOC_{11}H_{23}$ (8)

$C_7H_{15}CONHC_2H_4NHCOC_{17}H_{35}$ (9)

$C_9H_{19}CONHC_2H_4NHCOC_9H_{19}$ (10)

$C_{11}H_{23}CONHC_2H_4NHCOC_{11}H_{23}$ (11)

$C_{17}H_{35}CONHC_2H_4NHCOC_{17}H_{35}$ (12)

$(CH_3)_2CHC_{14}H_{35}CONHC_2H_4NHCOC_{14}H_{35}(CH_3)_2$ (13)

$C_{21}H_{43}CONHC_2H_4NHCOC_{21}H_{43}$ (14)

$C_{17}H_{35}CONHC_6H_{12}NHCOC_{17}H_{35}$ (15)

$C_{21}H_{43}CONHC_6H_{12}NHCOC_{21}H_{43}$ (16)

$C_{17}H_{33}CONHCH_2NHCOC_{17}H_{33}$ (17)

$C_{17}H_{33}CONHC_2H_4NHCOC_{17}H_{33}$ (18)

$C_{21}H_{41}CONHC_2H_4NHCOC_{21}H_{41}$ (19)

$C_{17}H_{33}CONHC_6H_{12}NHCOC_{17}H_{33}$ (20)

$C_8H_{17}NHCOC_2H_4CONHC_{18}H_{37}$ (21)

$C_{10}H_{21}NHCOC_2H_4CONHC_{10}H_{21}$ (22)

$C_{12}H_{25}NHCOC_2H_4CONHC_{12}H_{25}$ (23)

$C_{18}H_{37}NHCOC_2H_4CONHC_{18}H_{37}$ (24)

$C_{21}H_{43}NHCOC_2H_4CONHC_{21}H_{43}$ (25)

$C_{18}H_{37}NHCOC_6H_{12}CONHC_{18}H_{37}$ (26)

$C_{18}H_{35}NHCOC_4H_8CONHC_{18}H_{35}$ (27)

$C_{18}H_{35}NHCOC_8H_{16}CONHC_{18}H_{35}$ (28)

$C_{12}H_{25}OCONHC_{18}H_{37}$ (29)

$C_{13}H_{27}OCONHC_{18}H_{37}$ (30)

$C_{16}H_{33}OCONHC_{18}H_{37}$ (31)

$C_{18}H_{37}OCONHC_{18}H_{37}$ (32)

$C_{21}H_{43}OCONHC_{18}H_{37}$ (33)

$C_{12}H_{25}OCONHC_{16}H_{33}$ (34)

$C_{13}H_{27}OCONHC_{16}H_{33}$ (35)

$C_{16}H_{33}OCONHC_{16}H_{33}$ (36)

$C_{18}H_{37}OCONHC_{16}H_{33}$ (37)

$C_{21}H_{43}OCONHC_{16}H_{33}$ (38)

$C_{12}H_{25}OCONHC_{14}H_{29}$ (39)

$C_{13}H_{27}OCONHC_{14}H_{29}$ (40)

$C_{16}H_{33}OCONHC_{14}H_{29}$ (41)

$C_{18}H_{37}OCONHC_{14}H_{29}$ (42)

$C_{22}H_{45}OCONHC_{14}H_{29}$ (43)

$C_{12}H_{25}OCONHC_{12}H_{37}$ (44)

$C_{13}H_{27}OCONHC_{12}H_{37}$ (45)

$C_{16}H_{33}OCONHC_{12}H_{37}$ (46)

$C_{18}H_{37}OCONHC_{12}H_{37}$ (47)

$C_{21}H_{43}OCONHC_{12}H_{37}$ (48)

$C_{22}H_{45}OCONHC_{18}H_{37}$ (49)

$C_{18}H_{37}NHCOOC_2H_4OCONHC_{18}H_{37}$ (50)

$C_{18}H_{37}NHCOOC_3H_6OCONHC_{18}H_{37}$ (51)

$C_{18}H_{37}NHCOOC_4H_8OCONHC_{18}H_{37}$ (52)

$C_{18}H_{37}NHCOOC_6H_{12}OCONHC_{18}H_{37}$ (53)

$C_{18}H_{37}NHCOOC_8H_{16}OCONHC_{18}H_{37}$ (54)

$C_{18}H_{37}NHCOOC_2H_4OC_2H_4OCONHC_{18}H_{37}$ (55)

$C_{18}H_{37}NHCOOC_3H_6OC_3H_6OCONHC_{18}H_{37}$ (56)

$C_{18}H_{37}NHCOOC_{12}H_{24}OCONHC_{18}H_{37}$ (57)

$C_{18}H_{37}NHCOOC_2H_4OC_2H_4OC_2H_4OCONHC_{18}H_{37}$ (58)

$C_{16}H_{33}NHCOOC_2H_4OCONHC_{16}H_{33}$ (59)

$C_{16}H_{33}NHCOOC_3H_6OCONHC_{16}H_{33}$ (60)

$C_{16}H_{33}NHCOOC_4H_8OCONHC_{16}H_{33}$ (61)

$C_{16}H_{33}NHCOOC_6H_{12}OCONHC_{16}H_{33}$ (62)

$C_{16}H_{33}NHCOOC_8H_{16}OCONHC_{16}H_{33}$ (63)

$C_{18}H_{37}OCOHNC_6H_{12}NHCOOC_{18}H_{37}$ (64)

$C_{16}H_{33}OCOHNC_6H_{12}NHCOOC_{16}H_{33}$ (65)

$C_{14}H_{29}OCOHNC_6H_{12}NHCOOC_{14}H_{29}$ (66)

$C_{12}H_{25}OCOHNC_6H_{12}NHCOOC_{12}H_{25}$ (67)

$C_{10}H_{21}OCOHNC_6H_{12}NHCOOC_{10}H_{21}$ (68)

$C_8H_{17}OCOHNC_6H_{12}NHCOOC_8H_{17}$ (69)

(70)

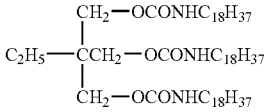

(71)

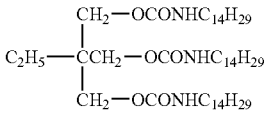

(72)

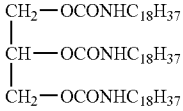

(73)

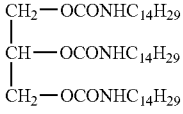

(74)

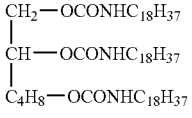

(75)

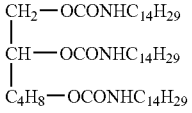

-continued (76)

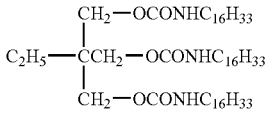

(77)

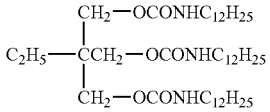

(78)

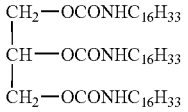

(79)

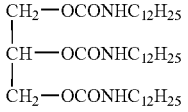

(80)

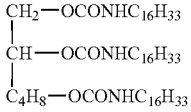

(81)

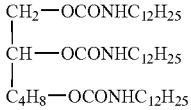

The amount of the erasing accelerator is preferably 0.1 to 300 parts by mass, more preferably 3 to 100 parts by mass, relative to 100 parts by mass of the color developer. When the amount is less than 0.1 parts by mass, the effect of the added erasing accelerator may be impaired, on the other hand, when the amount is more than 300 parts by mass, the density of the developed color may be lowered.

The thermosensitive layer may comprise, besides the above-noted components, a binder resin, and optionally various additives for improving the coating property and the color developing and erasing property of the thermosensitive layer. Examples of the above-noted additives include crosslinker, crosslinking accelerator, filler, lubricant, surfactant, conducting agent, loading material, antioxidant, solar proof material, color stabilizer, plasticizer.

The binder resin is not restricted and may be properly selected depending on the application. Examples of the binder resin include polyvinyl chloride resins, polyvinyl acetate resins, vinylchloride-vinylacetate copolymers, ethylcellulose, polystyrene resins, styrene copolymers, phenoxy resins, polyester resins, aromatic polyester resins, polyurethane resins, polycarbonate resins, polyester acrylate resins, polyester methacrylate, acryl copolymers, maleic acid copolymers, polyvinylalcohol resins, modified polyvinylalcohol resins, hydroxylethylcellulose, carboxymethylcellulose and starch.

These binder resins serve to maintain a condition in which each material of the composition in the thermosensitive layer is uniformly dispersed in a coating liquid for the thermosensitive layer, unless each material is polarizedly dispersed by the heating for repeating the printing and erasing. Accordingly, the binder resin used is preferably a resin having high heat-resistance. Further, as the binder resin, a curable resin which comprises a crosslinker and can be crosslinked by means of heat, ultra-violet or electron beam (hereinafter, sometimes referred to as "crosslinking resin"). By incorporating a curable resin in the thermosensitive layer, the heat-resistance and the coating strength of the thermosensitive layer and the repetition durability of the recording medium can be improved.

The curable resin is not restricted and may be properly selected depending on the application. Examples of the curable resin include resins having a group reactive with a crosslinker and resins produced by copolymerizing a monomer having a group reactive with a crosslinker with another monomer, such as acrylpolyol resins, polyesterpolyol resins, polyurethanepolyol resins, phenoxy resins, polyvinylbutyral resins, cellulose acetate propionate and cellulose acetate butylate. Among these resins, acrylpolyol resins, polyesterpolyol resins and polyurethanepolyol resins are preferred.

The hydroxyl value of the thermosetting resin is preferably 70 KOHmg/g or more, more preferably 90 KOHmg/g or more. When the hydroxyl value is 70 KOHmg/g or more, the durability, the surface hardness of a coating formed from the resin and cracking resistance can be improved. The hydroxyl value may influence the crosslinking density and consequently influence chemical resistance and properties of the coating.

The acrylpolyol resin may be synthesized by using a (meth)acrylic ester monomer and at least one unsaturated monomer selected from the group consisting of a unsaturated monomer having carboxyl group, a unsaturated monomer having hydroxyl group and a unsaturated monomer having ethylene group according to a conventional polymerization method, such as a solution polymerization, a suspension polymerization and emulsion polymerization. Examples of the unsaturated monomer having hydroxyl group include hydroxyethylacrylate (HEA), hydroxypropylacrylate (HPA), 2-hydroxyethylmethacrylate (HEMA), 2-hydroxypropylmethacrylate (HPMA), 2-hydroxybutylmonoacrylate (2-HBA), and 1,4-hydroxybutylmonoacrylate (1-HBA). Since a coating formed from a resin produced using a monomer having a primary hydroxyl group exhibits excellent cracking resistance and excellent durability, 2-hydroxyethylmethacrylate is preferably used.

Examples of the crosslinker include conventional isocyanate compounds, amines, phenols, epoxy compounds. Among these compounds, isocyanate compounds are particularly preferred. The isocyanate compound is not restricted and may be properly selected depending on the application. Examples the isocyanate compound include modified forms of isocyanate monomer, such as urethane modified form, allophanate modified form, isocyanurate modified form, buret modified form, carbodiimide modified form and blocked isocyanate. Examples of the isocyanate monomer which forms the above-noted modified form include dicyclohexylmethanediisocyanate (HMDI), isophorondiisocyanate (IPDI), lysinediisocyanate (LDI), isopropylidenebis(4-cyclohexylisocyanate) (IPC), cyclohexyldiisocyanate (CHDI), and tolidinediisocyanate (TODI).

As the crosslinking accelerator, a catalyst which is used generally in similar reactions to the crosslinking may be employed. Examples of the crosslinking accelerator include tertiary amines such as 1,4-diaza-bicyclo(2,2,2)octane, and metal compounds such as organotin compounds. It is not necessary that all amount used of a crosslinker is reacted. That is, an unreacted crosslinker may be remained. Such crosslinking reaction may progress with time; therefore, the presence of unreacted crosslinker indicates neither that a crosslinking reaction has not progressed at all, nor that a crosslinked resin is not present.

Further, a method for judging whether a polymer is crosslinked or not is a method in which the coating is immersed in a solvent having a high solubility of polymers. In other words, since an uncrosslinked polymer dissolves into the solvent and cannot remain in the solute, by analyzing the presence of a polymer structure in the solute, it is judged whether a polymer in the coating is crosslinked or not. When a polymer structure is not detected in the solute, a polymer in the coating is not yet crosslinked. For judging whether a polymer is crosslinked or not, "gel fraction" is employed.

The above-noted "gel fraction" means the percentage of the gel formed in a solvent, wherein resin solutes lose the independent mobility in the solvent due to the interaction and are agglomerated into a solidified gel. The gel fraction of the resin is preferably 30%, more preferably 50%, still more preferably 70%, most preferably 80%. When the gel fraction is low, the repetition durability of the resin is lowered. For improving the gel fraction, either a curable resin which is cured by means of heat, ultraviolet (UV) irradiation or electron beam (EB) irradiation may be incorporated into the resin or the resin itself may be crosslinked.

The gel fraction can be determined as follows. A piece of a coating is peeled from the support to weigh the initial mass. Then the coating is nipped between wire nets of 400 mesh and immersed into a solvent in which the resin which is not crosslinked is soluble, for 24 hours. The coating is dried under vacuum, then the mass of the coating after the drying is measured.

The gel fraction may be calculated by the following equation.

$$\text{Gel Fraction (\%)} = (\text{mass after drying (g)})/\text{initial mass (g)} \times 100 \qquad \text{Equation (1)}$$

In the calculation of the gel fraction by the equation, the mass of the organic substances having a lower molecular weight, which are not the resin components of the thermosensitive layer, should be eliminated. When the mass of the organic substances having a lower molecular weight is not definite, the gel fraction may be obtained by an observation of the resin cross-section by means of transmittance electron microscope (TEM) or scanning electron microscope (SEM) and by measuring the area ratio of the resin and organic substances having a lower molecular weight; and from the area ratio and the respective specific gravity, the mass of the organic substances having a lower molecular weight can be obtained.

Further, in the calculation of the gel fraction, when the thermosensitive layer is disposed on the support and another layer, such as a protective layer is disposed on the thermosensitive layer, or when another layer is disposed between the support and the thermosensitive layer, the gel fraction can be similarly determined as follows. The layer thicknesses of the thermosensitive layer and another layer are respectively measured through the observation using TEM or SEM and a layer having a thickness corresponding to the thickness of another layer is shaved off, thereby the thermosensitive layer is exposed. The exposed thermosensitive layer is peeled off and the gel fraction thereof is measured by the above-noted method.

Further, in the above-noted method for determining the gel fraction of the thermosensitive layer, when a protective layer comprising an UV curable resin is disposed on the thermosensitive layer, for preventing the sample for determining the gel fraction of the thermosensitive layer from contamination by intrusion of a peeled part of the protective layer into the sample as little as possible, it is necessary that before preparing the sample, a layer corresponding to the thickness of the protective layer and a small part of the thermosensitive layer should be peeled off and discarded.

The above-noted fillers divided summarily into inorganic fillers and organic fillers.

Examples of inorganic fillers include calcium carbonate, magnesium carbonate, anhydrous silicic acid, alumina, iron oxide, calcium oxide, magnesium oxide, chromium oxide, manganese oxide, silica, talc, and mica.

Examples of organic fillers include silicone resins, cellulose resins, epoxy resins, nylon resins, phenol resins, polyurethane resins, urea resins, melamine resins, polyester resins, polycarbonate resins, polystyrene resins, polystyreneisoprene, polystyrenevinylbenzene, polyvinylidenechloride, acrylurethane resins, ethyleneacryl resins, polyethylene resins, benzoguanazineformaldehyde resins, melamine formaldehyde resins, polymethylmethacrylate resins, and polyvinylchloride.

These fillers may be used individually or in combination. When plural fillers are used, with respect to the combination of an inorganic filler and an organic filler, there is not particular limitation. Examples of forms of a filler include sphere, granular, platelet and needle. The amount of a filler is usually 5 to 50% by volume.

The lubricant is not restricted and may be properly selected from conventional lubricants depending on the application. Examples of the lubricant include synthetic waxes, such as ester wax, paraffin wax and polyethylene wax; vegetable waxes, such as hardened castor oil; animal waxes, such as hardened beef tallow; higher alcohols, such as stearyl alcohol and benyl alcohol; higher aliphatic acids, such as margaric acid, lauric acid, myristic acid, palmic acid, stearic acid and behenolic acid; higher aliphatic acid esters, such as aliphatic acid ester of sorbitan; and amides, such as stearic acid amide, oleic acid amide, lauric acid amide, ethylenebisstearic acid amide, methylenebisstearic acid amide and methylolstearic acid amide The amount of lubricants in the thermosensitive layer is preferably 0.1 to 95% by volume, more preferably 1 to 75% by volume.

The surfactant is not restricted and may be properly selected depending on the application. Examples of the surfactant include an anionic surfactant, cationic surfactant, nonionic surfactant and amphoteric surfactant.

The method for disposing the above-noted thermosensitive layer is not restricted and may be properly selected depending on the application. Examples of the method include (1) a method in which the coating liquid for the thermosensitive layer prepared by dissolving or dispersing the binder resin, the electro-donating coloring compound and the electron-accepting compound in a solvent, is coated on the support and either during or after evaporating off the solvent to produce the coated support in the form of a sheet, the thermosensitive layer is crosslinked; (2) a method in which the coating liquid for the thermosensitive layer prepared by dispersing the electro-donating coloring compound and the electron-accepting compound in a solvent in which only the binder resin is dissolved, is coated on the support and either during or after evaporating off the solvent to produce the coated support in the form of a sheet, the thermosensitive layer is crosslinked; and (3) a method in which without using a solvent, the binder resin, the electron-donating coloring compound and the electron-accepting compound are molten by the heating and mixed to form a mixture and after the molten mixture is shaped into the thermosensitive layer in the form of a sheet and cooled, the thermosensitive layer is crosslinked.

In these methods, the thermoreversible recording medium in the form of a sheet can be shaped without using the support.

The solvent used in the methods (1) or (2) is not determined sweepingly, since the solvent is determined depending on the type of the electron-donating coloring compound and the electron-accepting compound; however, examples of the solvent include tetrahydrofuran, methylethylketone, methylisobutylketone, chloroform, carbontetrachloride, ethanol, toluene and benzene.

Further, the electron-accepting compound is dispersed in the form of particles in the thermosensitive layer.

For causing the coating liquid for the thermosensitive layer to exhibit a high-graded property as a coating material, the coating liquid for the thermosensitive layer may contain various pigments, anti-forming agents, dyes, dispersants, lubricants, preservatives, crosslinkers and plasticizers.

The coating process is not restricted and may be properly selected depending on the application. The process is performed by a method in which, the support in a continuous sheet supplied from a roll or in a cut sheet is conveyed and on the support, the coating liquid is coated by a conventional coating process, such as a blade process, wire-bar process, spray process, air-knife process, bead process, curtain process, gravure process, kiss process, reverse roll process, dip process and die coating process.

The condition for drying the coated liquid for the thermosensitive layer is not restricted and may be properly selected depending on the application. For example, the drying is performed approximately at from room temperature to 140° C. for from 10 minutes to 1 hour.

The curing of the resin in the thermosensitive layer can be performed by means of heating, UV irradiation, or electron beam irradiation.

The UV irradiation may be performed by means of a conventional UV irradiation apparatus. Examples of the UV irradiation apparatus include an apparatus equipped with a UV source, light kit, power supply, cooling device and conveying instrument.

Examples of the UV source include a mercury lump, metal halide lump, gallium lump, mercury xenon lump and flash lump. The wavelength of the UV source may be selected depending on the wavelength of an absorbed UV by the photopolymerization initiator or the photopolymerization accelerator comprised in the composition of the recording medium.

The condition of UV irradiation is not restricted and may be properly selected depending on the application. For example, the lump power and the conveying rate may be determined depending on the exposed energy necessary for crosslinking the resin.

The electron beam irradiation may be performed by means of conventional electron beam irradiation apparatuses. Such electron beam irradiation apparatuses may be summarily divided into scanning bean type and area beam type, and the type may be selected considering the irradiation area, irradiation dose and the like. The condition of irradiation may be calculated from the following equation (2), depending on the dose required for crosslinking the resin and considering the electron current, irradiation width, carrying rate and the like.

$$D=(\Delta E/\Delta R)\times\eta\times I/(W\cdot V) \qquad \text{Equation (2)}$$

wherein "D" represents the required dose (Mrad); "ΔE/ΔR" represents averaged energy loss; "η" represents efficiency; "I" represents electron current (mA); "W" represents irradiation width; and "V" represents carrying rate.

Commercially, the following equation (3) is recommended, which is simplified from equation (2).

$$D \times V = K \times I/W \quad \text{Equation (3)}$$

The rating of the instrument is expressed by "Mrad-m/min", the rating of the electron current is selected from about 20 to 500 mA.

The film thickness of the thermosensitive layer is not restricted and may be properly selected depending on the application; for example, preferably 1 to 20 μm, more preferably 3 to 15 μm.

When the thickness is excessively small, the image contrast may come to low due to a lower coloring density, on the other hand, when the thickness is excessively large, the intended coloring density may not be obtained since the temperature distribution comes to broad in the film thereby non-coloring parts appear due to the lower temperature.

<Intermediate Layer>

In the thermoreversible recording medium of the present invention, for protecting the thermosensitive layer from a solvent or a resin component in a coating liquid for disposing the protective layer, an intermediate layer may be disposed between the protective layer and the thermosensitive layer (see JP-A No. 1-133781).

The intermediate layer comprises an ultraviolet absorber, a curable resin and optionally other components.

Examples of the curable resin include an ultraviolet curing resin and a thermosetting resin. Specific examples of the curable resin include, besides above exemplified materials for a binder resin in the back layer, a polyethylene, polypropylene, polystyrene, polyvinyl alcohol, polyvinyl butyral, polyurethane, saturated polyester, unsaturated polyester, epoxy resin, phenol resin, polycarbonate and polyamide.

The intermediate layer may preferably comprise an UV ray absorber. As the UV ray absorber, both an inorganic and an organic compound may be used. Examples of the organic UV ray absorber include benzotriazoles, benzophenones, salicylates, cyanoacrylates and cinnamic acids. Among these compounds, benzotriazoles are preferred. Further, among benzotriazoles, benzotriazoles in which a hydroxyl group is protected by an adjacent bulky functional group are particularly preferred. Specifical examples of such benzotriazoles include 2-(2'-hydroxy-3',5'-di-t-butylphenyl) benzotriazol, 2-(2'-hydroxy-3'-t-butyl-5'-methylphenyl) benzotriazol, 2-(2'-hydroxy-3',5'-di-t-butylphenyl)-5-chlorobenzotriazol and 2-(2'-hydroxy-3'-t-butyl-5'-methylphenyl)-5-chlorobenzotriazol. A UV ray absorber may be also a compound in which a skeleton having a function of absorbing UV ray is added to a copolymer, such as an acryl resin or a styrene resin.

The amount of the UV ray absorber is preferably 0.5 to 10% by mass, based on the total mass of the resin composition in the intermediate layer.

As an inorganic UV ray absorber, a metal compound having an average particle diameter of 100 nm or less is preferred. Examples of the metal compound include metal oxides or complex metal oxides, such as zinc oxide, indium oxide, alumina, silica, zirconium oxide, tin oxide, cerium oxide, iron oxide, antimony oxide, barium oxide, bismuth oxide, nickel oxide, magnesium oxide, chromium oxide, manganese oxide, tantalum oxide, niobium oxide, thorium oxide, hafnium oxide, molybdenum oxide, iron ferrite, nickel ferrite, cobalt ferrite, barium titanate and potassium titanate; metal sulfides or metal sulfates, such as zinc sulfide and barium sulfate; metal carbides, such as titanium carbide, silicon carbide, molybdenum carbide, tungsten carbide and tantalum carbide; and metal nitride, such as aluminum nitride, silicone nitride, boron nitride, zirconium nitride, vanadium nitride, titanium nitride, niobium nitride and gallium nitride. Among them, more preferred are an ultra fine particle of a metal oxide, such as silica, almina, zinc oxide, titanium oxide and cerium oxide. In addition, the super fine particles of metal oxides may be used of which the surface is treated with silicone, wax, organic silane or silica.

The amount of the UV ray absorbing inorganic compounds is preferably 1 to 95% by volume. These organic or inorganic UV ray absorbers may be incorporated also in the thermosensitive layer.

The film thickness of the intermediate layer is preferably from 0.1 to 20 μm, more preferably from 0.5 to 5 μm. As the apparatus for dispersing the solvent used for the coating liquid of the intermediate layer and the coating liquid, the coating process of the intermediate layer and the drying and curing processes of the intermediate layer, a conventional method used in disposing the back layer, the thermosensitive layer and the protective layer may be used.

For utilizing effectively the applied heat in the present invention, a heat-insulating undercoat layer may be disposed between the support and the thermosensitive layer. Further, the undercoat layer can be disposed by coating a coating liquid comprising a binder resin containing ultra fine hollow particles. An undercoat layer for the purpose of improving the adhesion between the support and the thermosensitive layer and preventing the penetration of a thermosensitive material into the support may be disposed.

For the undercoat layer, the same resin as a resin used for the thermosensitive layer or the protective layer may be used. Further, the thermosensitive layer and the undercoat layer may comprise, not only at least one of an inorganic filler, such as calcium carbonate, magnesium carbonate, titanium oxide, silicon oxide, aluminum hydroxide, kaolin and talc, and an organic filler, but also lubricants, surfactants and dispersants.

In the thermalreversible recording medium of the present invention, for improving a visuality thereof, it is preferred that a coloring layer is disposed between the support and the thermosensitive layer. The coloring layer can be disposed either by coating a solution or dispersion containing a coloring agent and a binder resin on an objective surface and drying the disposed coloring layer or only by applying a coloring sheet on an objective surface.

The recording medium may comprise also a color printing layer. Examples of a coloring agent for the color printing layer include various dyes and pigments which are contained in a color ink used for a conventional color printings and examples of the binder resin for the color printing layer include various thermoplastic resins, thermosetting resins, UV-curing resins and electron beam-curing resins. The thickness of the color printing layer is varied properly depending on a printing color density and may be selected according to a desired printing color density.

The recording medium may comprise also an air layer as a buffer part between the support and the thermosensitive layer. The refraction coefficient of the polymer used in the thermosensitive layer is from 1.4 to 1.6 which differs largely from 1.0 which is the refraction coefficient of the air. Therefore, when the recording medium comprises the air layer, the light is reflected at the interface between the thermosensitive layer and the air layer and when the thermosensitive layer is in a condition of the opaque color, the opaque color can be amplified, so that the visuality can be improved. Therefore, the air layer as the buffer part may be preferably used as a display part.

In addition, the air layer may function also as a heat-insulating layer, thereby improving the thermosensitivity of the recording medium and further as a cushion layer, thereby scattering the pressure of the thermal head, so that a distortion or a surface peeling of the thermosensitive layer by the mechanical force can be prevented and accordingly, the repetition durability of the recording medium can be improved.

The thermoreversible recording medium of the present invention may also comprise a head matching layer. Examples of materials for the head matching layer include a thermoresistant resin and an inorganic pigment. As the thermoresistant resin, the same thermoresistant resin as a thermoresistant resin used for the protective layer may be preferably used. Examples of the inorganic pigment include calcium carbonate, kaolin, silica, aluminum hydroxide, alumina, aluminum silicate, magnesium hydroxide, magnesium carbonate, magnesium oxide, titanium oxide, zinc oxide, barium sulfate and talc. These inorganic pigments may be used individually or in combination. The particle diameter of the inorganic pigment is preferably from 0.01 to 10.0 μm, more preferably from 0.05 to 8.0 μm. The amount of the inorganic pigment is preferably from 0.001 to 2 parts by mass, more preferably from 0.005 to 1 part by mass, relative to 1 part by mass of the thermoresistant resin.

Between the support and the thermosensitive layer, for imparting the recording medium with a function of writing with the laser, a light-heat conversion layer which can convert a light energy into a heat energy by absorbing a laser light may be also disposed.

Further, for improving the design property of the thermosensitve layer, the recording medium may comprise also at least one printing layer.

When a resin comprised in the protective layer, the color printing layer or the head matching layer is cured by means of heat, UV or electro beam, a crosslinker, a photopolymerization initiator or a photopolymerization accelerator used for crosslinking a resin in the back layer or the thermosensitive layer is preferably incorporated.

The thermoreversible recording medium is not restricted and may be shaped into various forms depending on the application, such as a card, a sheet or a roll.

Examples of the applications of the recording medium include a prepaid card, a point card and a credit card. The recording medium shaped into a sheet having a size of a general document, such as A4 size may be applied broadly into temporary output applications, such as normal document, instructing letter for process control, circulation document, and conference data, needless to say trial printings, owing to the wider printable area than the card size when an printing-erasing apparatus is introduced.

The recording medium shaped into the form of a roll may be applied for display board, notice plate and electronic white board by being integrated into an instrument with a printing-erasing part. Such display instruments can be preferably used in a clean room, since dusts and contaminants are not emitted from the display instrument.

The recording medium may also comprise an irreversible thermosensitive layer. In this case, the developed color of the irreversible thermosensitive layer may be either the same as or different from the developed color of the reversible thermosensitive layer. Further, on the surface of the thermosensitive layer or on the opposite surface, a printing such as offset printing and gravure printing or coloring layer with any patterns may be provided partially or entirely by means of an inkjet printer, heat transfer printer, or sublimation type printer. Further, on the entire or part of the coloring layer, an OP varnish layer based on curable resin may be provided. Examples of the above-noted optional pattern include letter, design, figure, photography and infrared-detectable information. Further, any one of the respective layers constituting the recording medium may be colored simply by adding dyes or pigments to the layers.

In addition, the recording medium may be provided with a hologram for the security. For enhancing the design of the recording medium, design such as a personal image, company mark or symbol mark may be provided by applying concaves and convexes of relief or interior (dug or carved patterns).

The forming and erasing of images on the thermorversible recording medium can be performed by means of conventional image processing apparatus, preferably by means of the image processing apparatus as explained below.

Preferred examples of the image processing apparatus include apparatus equipped with an image forming unit for forming images on the recording media and an image erasing unit for erasing images from the recording media. Among them, from the viewpoint of a short processing period, apparatus equipped with a combined unit for forming and erasing image is more preferred. Specific examples thereof include an image processing apparatus equipped with a thermal head in which the images can be processed by changing the energy applied on the thermal head and an image processing apparatus in which the image forming unit is the thermal head and the image erasing unit is one selected from the group consisting of a contact-pressing type unit used by contacting the recording medium with a heating element, such as a thermal head, a ceramic heater (a heating element produced by screen-printing a heating resistance element on an alumina substrate), a hot stamp, a heat roller and a heat block; and a non-contact type unit with using a warm blow or an infrared light.

(Thermoreversible Recording Media)

The thermalreversible recording media according to the present invention comprises an information-memorizing part and a reversible displaying part and the reversible display part comprises the thermoreversible recording medium according to the present invention.

According to the thermoreversible recording medium, the reversibly displayable thermosensitive layer and the information-memorizing part are provided in an identical card (integrated), and a part of the memorized information of the information-memorizing part is displayed on the thermosensitive layer, thereby the owner of the card may be convenient in that the information can be confirmed by only viewing the card without a particular device. Further, in the case that the amount of the information-memorizing part is overwritten, the recording medium may be repeatedly used by overwriting the display of the thermosensitive recording part.

The member comprising the information-memorizing part and the reversible displaying part may be summarily divided into the following two types.

(1) A member in which the thermosensitive layer is disposed on the support which is a part of a member having a information-memorizing part (2) A member in which a member having a information-memorizing part is laminated on a bare surface of the support on which the thermosensitive layer is disposed separately on another surface of the support to form a thermoreversible recording medium In these cases of (1) and (2), it is necessary that the information-memorizing part and the reversible displaying part are so disposed that they can exhibit their own functions and so long as they can exhibit their own functions, the information-memorizing part may be disposed on a surface of the support which is opposite to another surface of the support on which the thermosensitive layer is disposed, between the support and the thermosensitive layer, or on a part of the thermosensitive layer.

The information-memorizing part is not restricted and may be formed of a magnetic thermosensitive layer, magnetic stripe, IC memory, optical memory, hologram, RF-ID tag card and the like. In the sheet medium of which the size is over the card size, an IC memory, RF-ID tag are preferably employed. By the way, the RF-ID tag is composed of an IC chip and an antenna connected to the IC chip.

The magnetic thermosensitive layer may be disposed by coating on the support using coating materials comprising metal compounds used conventionally, such as iron oxide and barium ferrite and resins, such as vinylchloride resins, urethane resins and nylon resins, or by a method, such as vapor deposition or spattering without using resins. The magnetic thermosensitive layer may be disposed on a surface of the support which is opposite to another surface of the support on which the thermosensitive layer is disposed, between the support and the thermosensitive layer, or on a part of the thermosensitive layer. Further, the thermoreversible material for displaying may be employed for the memorizing part in a form of barcode, two dimensional code and the like. Among them, the magnetic recording and IC are further preferred.

As for the hologram, a rewritable type is preferred. Examples of the hologram include the rewritable hologram in which coherent light is written on a liquid crystal film of azobenzene polymer.

General examples of the member comprising the information recording part include a card, a disc, a disc cartridge and a tape cassette. Specifical examples of the member include a thicker card such as IC card and an optical card; a disc cartridge containing an information-rewritable disc, such as optical magnetic disc (MD) and DVD-RAM; a disc in which disc cartridge is not used, e.g. CD-RW; an overwrite type disc such as CD-R; an optical information recording medium with phase-changing recording material (CD-RW); and a videotape cassette.

Further, the member comprising the information-memorizing part and the reversible displaying part may exhibit remarkably increased availability. That is, in case of card for example, the owner of the card can confirm the information only by viewing the card without a particular device through displaying on the thermosensitive layer a part of the information memorized in the information recording part.

The information-memorizing part is not restricted so long as a necessary information can be recorded and may be properly selected depending on the application. Examples thereof include a magnetic recording, a contact type IC, a non-contact type IC and optical memory.

The magnetic thermosensitive layer may be disposed by coating on a support a coating material comprising conventional iron oxide, barium ferrite etc. and vinylchloride resins, urethane resins, nylon resins, otherwise by vapor deposition, spattering etc. without using resins. Further, the thermoreversible material for displaying may be employed for the memorizing part in a form of barcode, two dimensional code and the like.

More specifically, the recording medium may be appropriately employed for the thermoreversible recording medium, thermoreversible recording member, image processing apparatus, and image processing method. In the present invention, "surface of the thermoreversible recording medium" means the surface of the thermosensitive side such as the surface of printing layer or OP layer, not only of the protective layer but all of or part of the surface which contact with the thermal head during the printing and erasing.

Figure 2:
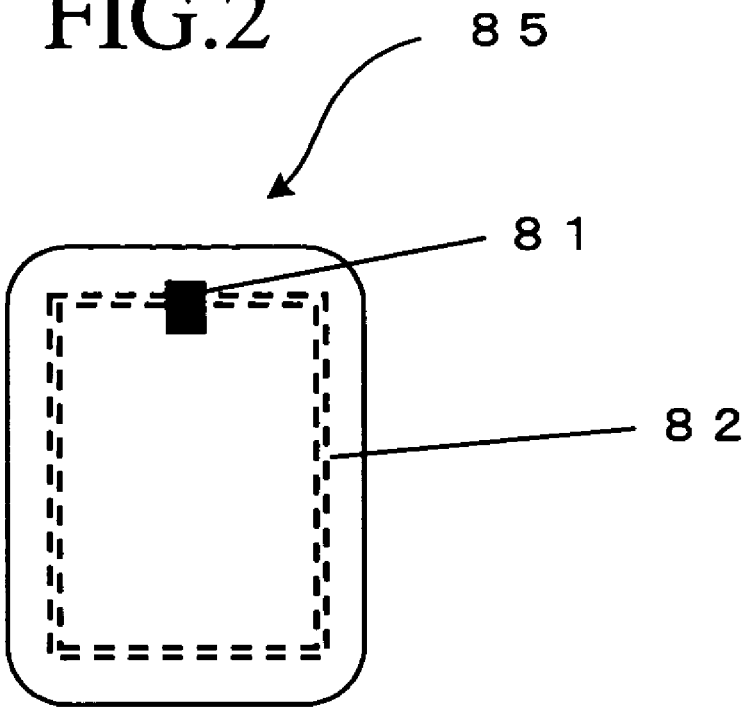
FIG. 2 schematically shows an example of RF-ID tag.

The thermoreversible recording member comprises a reversibly displayable thermosensitive layer and an information recording part, and an RF-ID tag is exemplified as a preferable information recording part. FIG. 2 schematically shows RF-ID tag 85. The RF-ID tag 85 is composed of IC chip 81, and antenna 82 connected to the IC chip. The IC chip 81 is divided into four parts of memorizing part, power supply controlling part, transmitting part and receiving part; the respective part are imposed individual roll, and communications are performed. The communications are achieved through exchanging data using electric waves by means of the antennas of RF-ID tag and the reader-writer. Specifically, the antenna of RF-ID receives electric waves to cause an electromotive force through an induction due to resonance effect. As a result, the IC chip in the RF-ID tag is activated, the information in the chip is turned into signals, followed by the dispatch of the signals from the RF-ID tag. The information is received by the antenna of the reader-writer to recognize it by the data processing apparatus, and then data processing is achieved at the soft side.

The RF-ID tag is formed into label-like or card-like shape. As shown FIG. 3, RF-ID tag 85 may be laminated to the thermoreversible recording medium 90. RF-ID tag 85 may be laminated on the surface of thermosensitive layer or back layer, preferably on the surface of back layer. For the purpose of laminating the RF-ID tag and the recording medium, conventional adhesive agents and tacky agents may be used.

Figure 3:
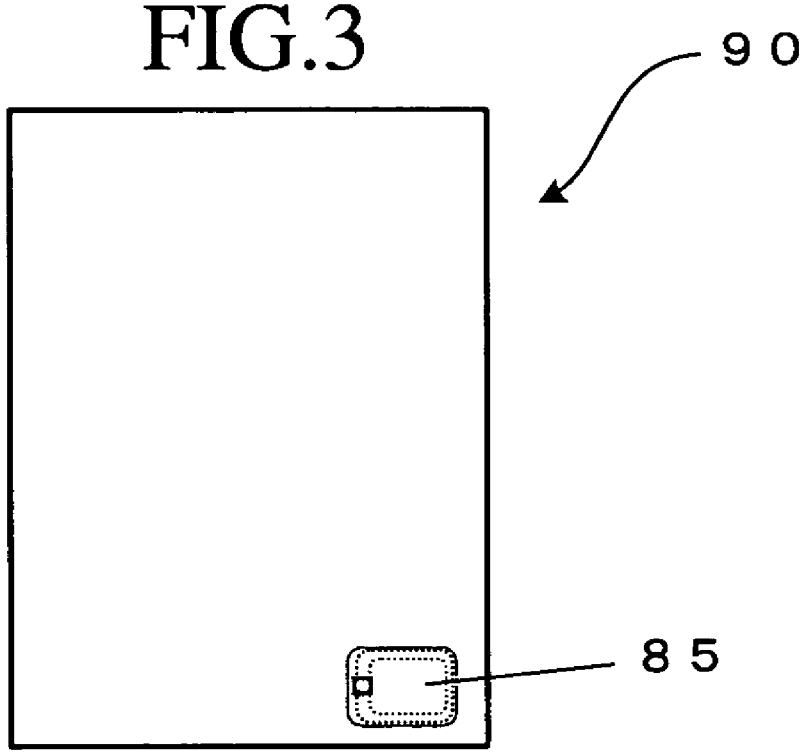
FIG. 3 schematically shows a configuration, in which an RF-ID tag is affixed to the back side of an example of the thermoreversible recording medium.
Figure 4A:
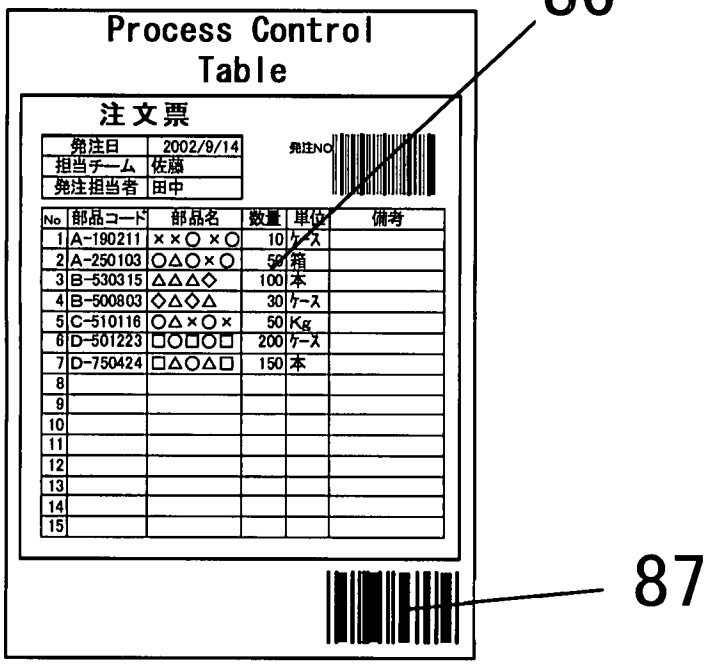
FIGS. 4A and 4B schematically exemplify a commercial rewritable sheet (thermoreversible recording medium according to the present invention).
Figure 4B:
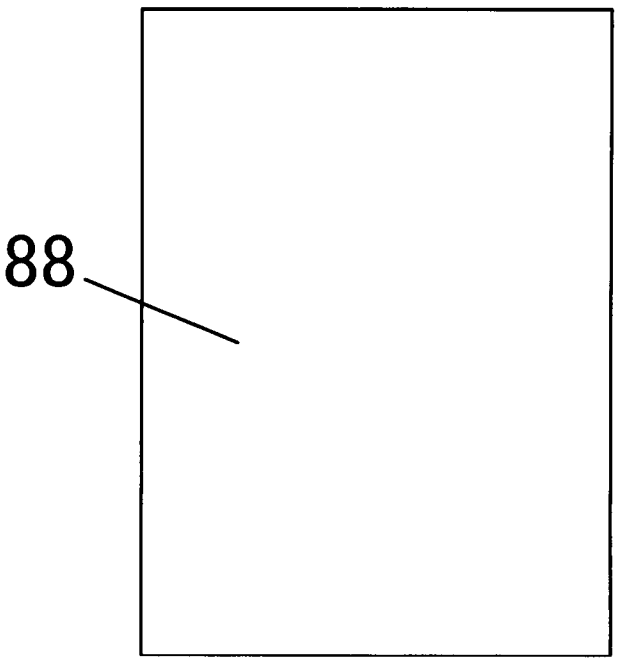

FIGS. 4A and 4B exemplify the thermoreversible recording media applied into commercial rewritable sheet 90 (thermoreversible recording medium). As shown in FIG. 4A, a rewritable displaying part 86 is provided on the thermosensitive layer side where a barcode printing part 87 may be provided. On the behind side (back layer), the RF-ID tag may not be laminated (88) as shown in FIG. 4B, or the RF-ID tag may be laminated as shown in FIG. 3. The application of RF-ID tag is preferable in light of higher availability.

Figure 5:
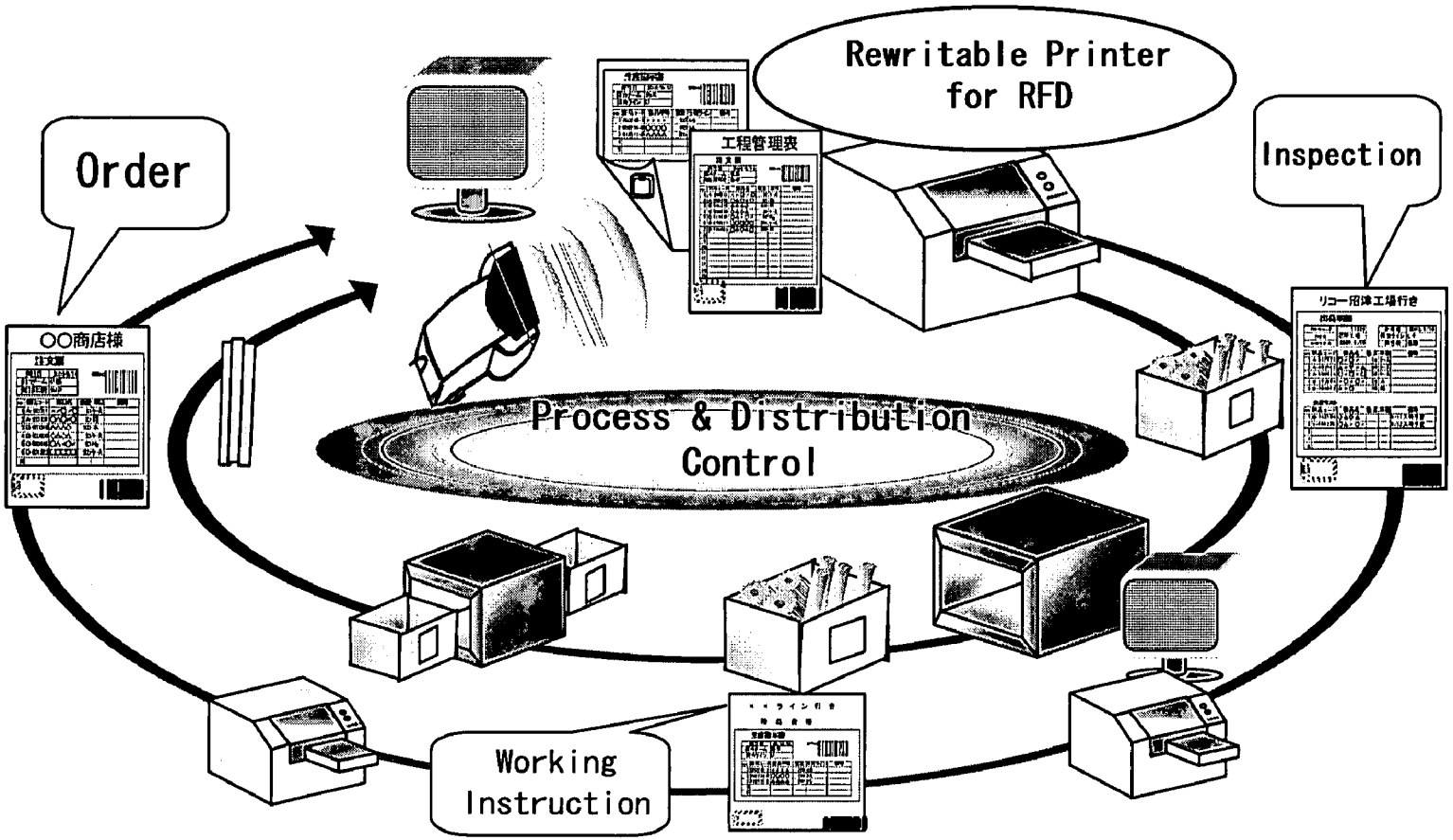
FIG. 5 schematically exemplifies how to use the commercial rewritable sheet (thermoreversible recording medium according to the present invention).

FIG. 5 exemplifies the way in which the commercial rewritable sheet combined with the thermoreversible recording medium (rewritable sheet) and RF-ID tag is used. Initially, such information as an article name and amount is recorded on the rewritable sheet or RF-ID tag with respect to the delivered raw materials, and the raw material are inspected with the information of the rewritable sheet or RF-ID tag contained in a circulating box for example. In the next step, a working instruction is granted on the delivered raw material, the rewritable sheet and RF-ID tag with the recorded information turn to the working instruction letter, and progress to the working step. Then, the rewritable sheet and RF-ID tag recorded with the order information is attached to the worked product as the order instruction letter. The rewritable sheet is recovered after the shipment, the shipment information is subjected to reading, then the rewritable sheet is used as a delivery letter again.

(Thermoreversible Recording Label)

The thermoreversible recording label comprises at least one of an adhesive layer and tacky layer disposed on a surface of the support which is opposite to another surface of the support on which an image forming layer (for example, the thermosensitive layer) of the thermoreversible recording medium is disposed. If desired, the recording label comprises also other layers selected properly depending on the necessity. Further, in the case that the support of the recording medium exhibits thermal fusion bond property, it is not necessary that the adhesive layer or tacky layer is disposed on the surface of the support.

The form, configuration and size of the adhesive layer or tacky layer are not restricted and may be properly selected depending on the application. The form may be sheet-like or film-like; the configuration may be of single layer or laminated layers; and the size may be larger or smaller than the thermosensitive layer.

The material of the adhesive layer or tacky layer is not restricted and may be properly selected depending on the application. Examples of the material include urea resins, melamine resins, phenolic resins, epoxy resins, polyvinyl acetate resins, vinyl acetate-acrylic copolymers, ethylene-vinyl acetate copolymers, acrylic resins, polyvinyl ether resins, vinyl chloride-vinyl acetate copolymers, polystyrene resins, polyester resins, polyurethane resins, polyamide resins, chlorinated polyolefin resins, polyvinyl butyral resins, acrylic ester copolymers, methacrylic ester copolymers, natural rubber, cyanoacrylate resins, silicone resins. These may be used individually or in combination. Further the material may be of hot-melt type, and may be used either with a disposable release paper or without a disposable release paper.

The thermoreversible recording label is generally used in a configuration laminated to a substrate sheet such as a card, in which the thermoreversible recording label may be laminated on the entire or part of the substrate sheet, or on one side or both sides.

The form, configuration and size of the substrate sheet are not restricted and may be properly selected depending on the application. The form may be platelet and the like; the configuration may be of single layer or laminated layers; and the size may be properly selected depending on the size of the thermoreversible recording medium. Examples of the substrate sheet include a sheet and a laminated form of the sheet which are produced from a chlorine-containing polymer, a polyester resin, a biodegradable plastic.

The chlorine-containing polymer is not restricted and may be properly selected depending on the application. Examples of the polymer include polyvinyl chloride, vinyl chloride-vinyl acetate copolymers, vinylchloride-vinylacetate-vinylalcohol copolymers, vinylchloride-vinylacetate-maleicacid copolymers, vinylchloride-acrylate copolymers, polyvinylidenechloride, vinylidenechloride-vinylchloride copolymers, and vinylidenechloride-acrylonitrile copolymers.

Examples of the polyester resins include polyethylene terephthalate (PET), polybutylene terephthalate (PBT), alternatively condensed esters of acid ingredients such as terephthalic acid, isophthalic acid, and alcohol ingredients such as ethylene glycol, cyclohexanedimethanol (e.g. PETG, trade name by Eastman Chemical Co.).

Examples of the biodegradable plastic include natural polymer resins comprising polylactic acid, starch, denaturated polyvinyl alcohol and the like, and microbiological product resins including β-butyric acid and β-valeric acid.

Further, the substrate may be synthetic resin sheet or paper formed of polyacetate resins, polystyrene (PS) resins, epoxy resins, polyvinylchloride (PVC) resins, polycarbonate (PC) resins, polyamide resins, acryl resins, silicone resins and the like. These materials may be properly combined or laminated.

Examples of the laminated form include a form comprising a core sheet formed of laminated two sheets of white polyvinyl chloride resin having a thickness of 250 μm and two laminated oversheets of transparent polyvinyl chloride resin having a thickness of 100 μm, wherein an oversheet is laminated on the upper side of the core sheet and another oversheet is laminated on a lower side of the core sheet; and a form comprising a core sheet formed of laminated two sheets of white PETG having a thickness of 250 μm and two laminated oversheets of transparent PETG having a thickness of 100 μm, wherein an oversheet is laminated on the upper side of the core sheet and another oversheet is laminated on a lower side of the core sheet.

Figure 6:
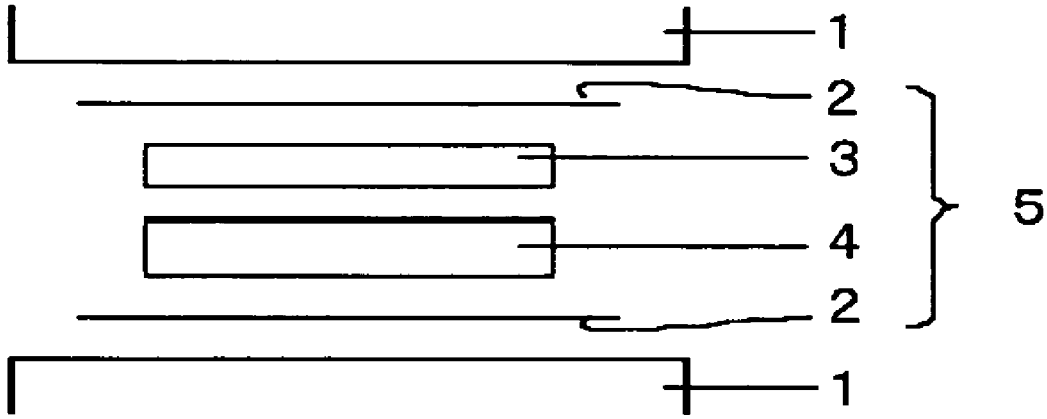
FIG. 6 schematically exemplifies an embodiment, in which a recording medium and substrate sheet are bonded in thermo-compression process.

With respect to the process for laminating the substrate sheet and the thermoreversible recording label, as shown in FIG. 6, the thermoreversible recording label 3 and substrate sheet 4 are superimposed oppositely, and disposed and pressed between two sheets of mirror plate 2, along with being heated through hot plate 1.

Figure 7:
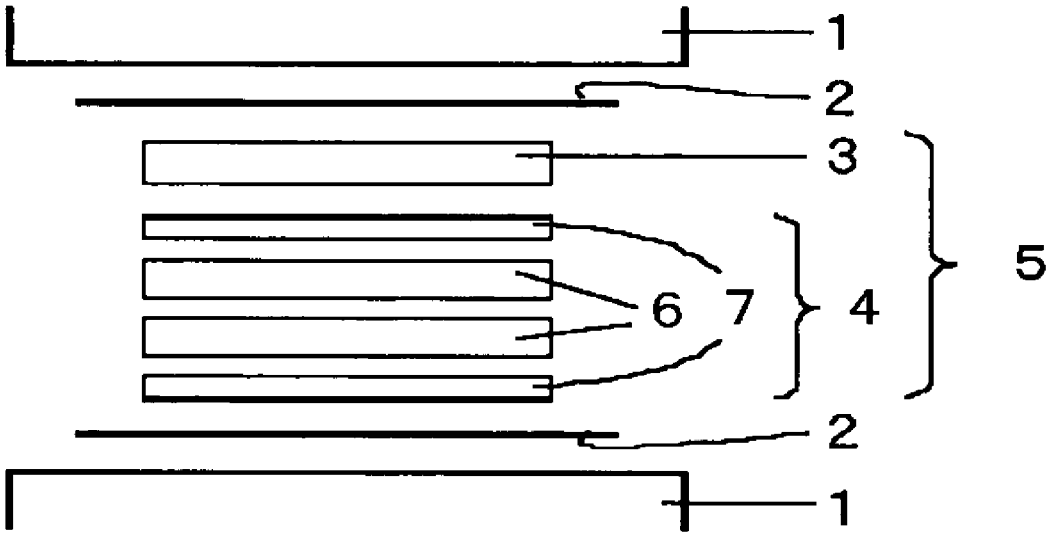
FIG. 7 schematically exemplifies another embodiment, in which a recording medium and substrate sheet are bonded in thermo-compression process.

Further, as shown in FIG. 7, the similar way may be applied toward the substrate sheet 4, which is composed of the superimposed core sheet 6 and over sheet 7.

The adhesion with press and heat may be performed through a conventional way, normally at the pressure of 5 to 70 kgf/cm$^2$, preferably 10 to 50 kgf/cm$^2$, and at the temperature of 80 to 170° C., preferably 90 to 150° C., by means of a hot-pressing apparatus equipped with heating plate 1 (for example).

In the case that the laminate of transparent polyvinyl chloride sheet/white polyvinyl chloride sheet/white polyvinyl chloride sheet/transparent polyvinyl chloride sheet is employed, the heating temperature at the hot pressing is preferably 130 to 150° C. Further, in the case that the laminate of transparent PETG/white PETG/white PETG/transparent PETG is employed, the heating temperature at the hot pressing is preferably 100 to 130° C.

As for another way for laminating the substrate sheet and the thermoreversible recording label, they are adhered with heating previously, then laminated with heating. The adhesion with heating may be achieved by pressing a rubber roll against them followed by laminating with heating.

The optimal condition of the adhesion with heating is not restricted and may be properly selected depending on the substrate sheet in use, normally performed by keeping at 90 to 130° C. for 1 hour or less, preferably 1 to 50 minutes.

In the case that the thermoreversible recording label comprises a protective layer of which surface is roughened by filler and the like, and the recording label is adhered with heating and pressing on a label-like substrate, such matters appear that the filler at the surface of the protective layer is pressed into the protective layer or underlying layer through the heating and pressing, thereby the surface gross increases and the repetition durability decreases due to the lowering of the filler effect, and also that when printing and erasing are repeated in the condition of the increased surface gloss, the gloss at the printed-erased parts is decrease, as a result that the gloss difference from the non-printed-erased parts comes to be recognized as a non-uniformity. The presence of the protective layer in the thermoreversible recording medium may eliminate such matters. In this aspect, the surface roughness 0.15 μm or less of the recording medium is more preferred since higher gloss may be obtained.

When the recording label comprises at least one of an adhesive layer and a tacky layer, the recording medium may be affixed on an entire or part of a thicker substrate such as polyvinylchloride card with magnetic stripe to which the recording medium is usually difficult to be affixed, thereby a part of the information memorized in magnetic may be displayed.

The thermoreversible recording label may be an alternative to a thicker card such as IC card and optical card, flexible disc, disc cartridge containing rewritable disc such as optical magnetic recording disc (MD) and DVD-RAM, disc without disc cartridge such as CD-RW, write-once disc such as CD-R, optical information recording medium (CD-RW) based on phase-change recording material, and display label on videotape cassette.

Figure 8:
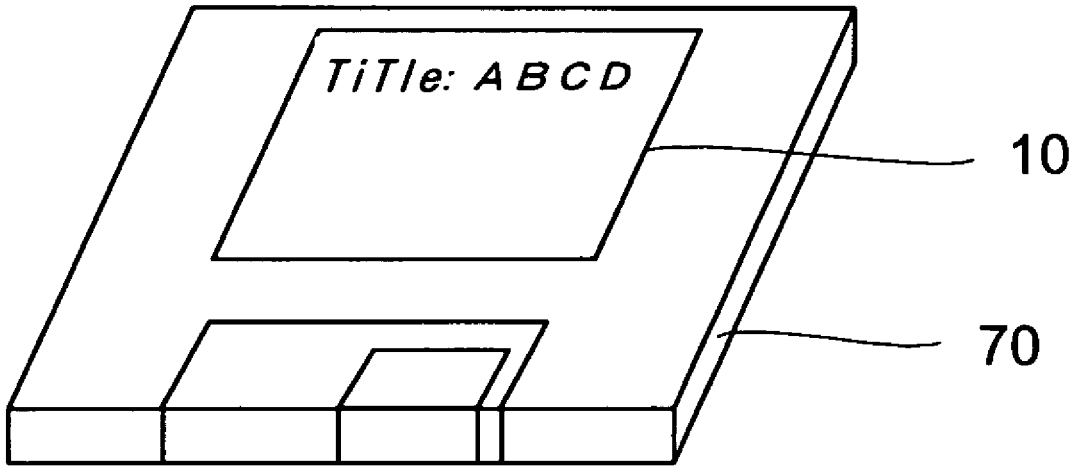
FIG. 8 schematically exemplifies a configuration, in which a recording label is laminated on an MD disc cartridge.

FIG. 8 exemplifies the recording medium 10 affixed to MD disc cartridge 70. In this case, such application is allowable that the displayed amount is automatically altered depending the alternation of the memorized amount in the MD. Further, in a case of disc without disc cartridge such as CD-RW, the recording label may be directly affixed to the disc.

Figure 9:
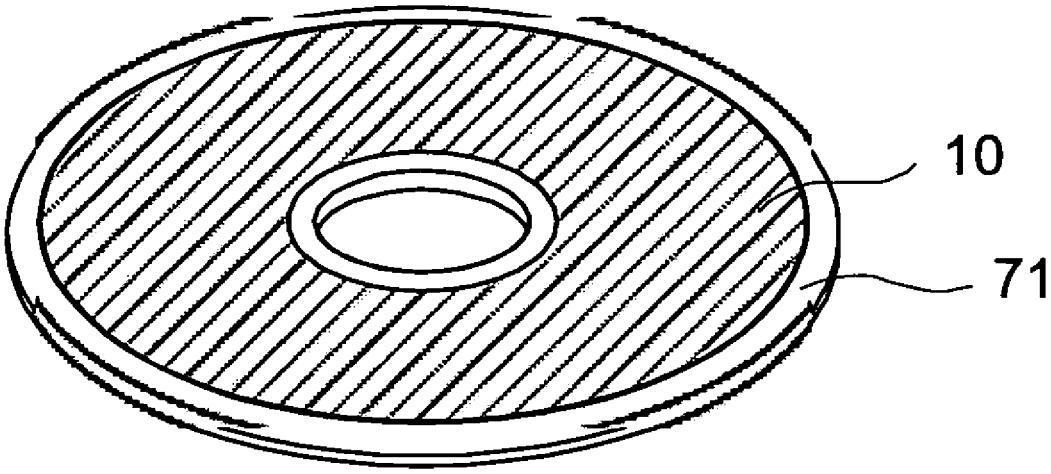
FIG. 9 schematically exemplifies a configuration, in which a recording label is laminated on an optical information recording medium (CD-RW).

FIG. 9 exemplifies the recording medium 10 affixed to CD-RW 71. In this case, the recording label is affixed on a write-once disc such as CD-R in place of CD-RW, then a part of the memorized information in the CD-R may be rewritten and displayed.

Figure 10:
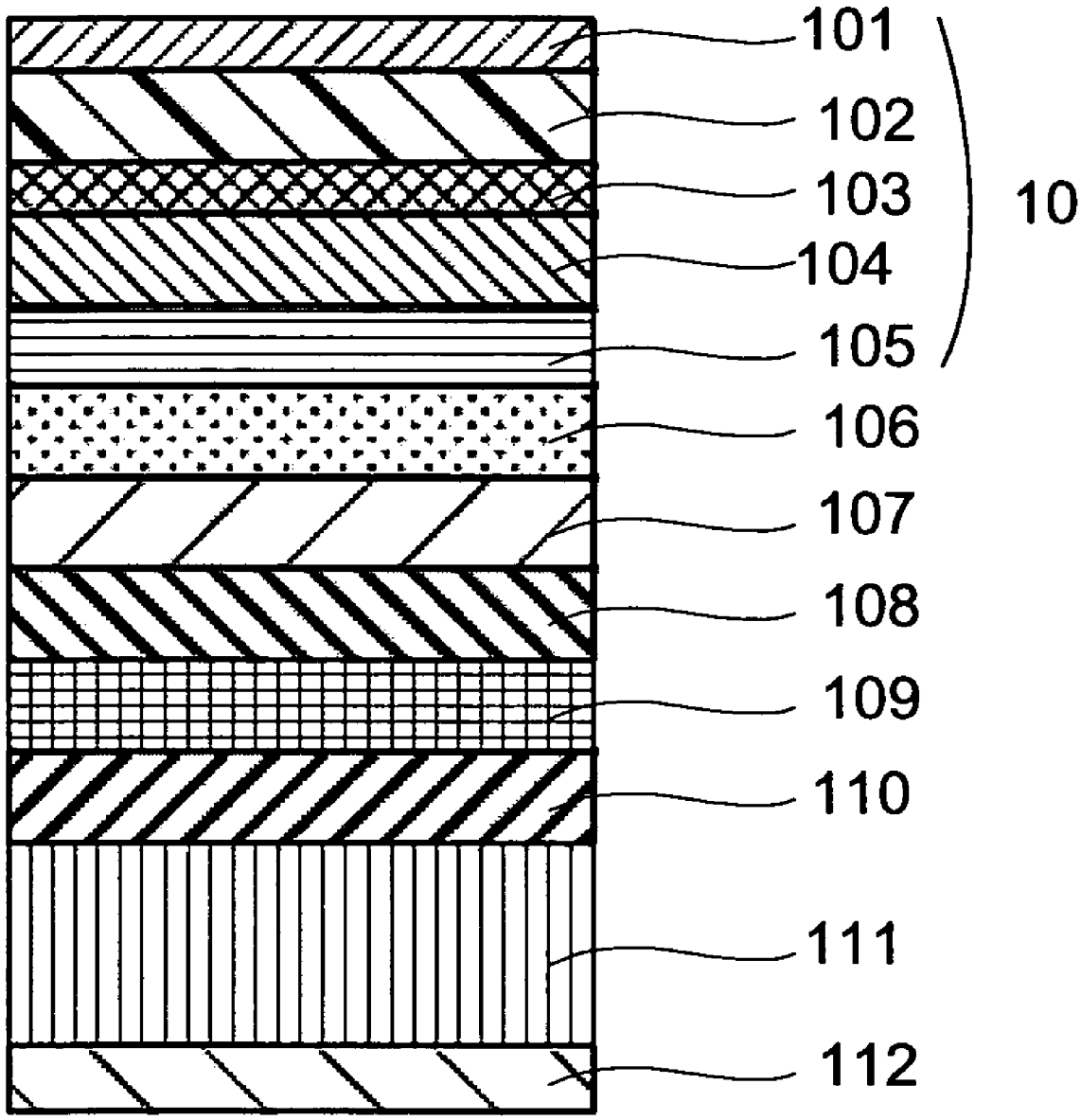
FIG. 10 schematically exemplifies a configuration in a cross-section, in which a recording label is laminated on an optical information recording medium (CD-RW).

FIG. 10 exemplifies the recording medium 10 affixed to an optical information recording medium (CD-RW) with phase-change recording material of AgInSbTe type. As for the fundamental constitution of the CD-RW, the first dielectric layer 110, optical information memorizing layer 109, the second dielectric layer 108, reflecting heat-dissipation layer 107, and intermediate layer 106 is disposed in order on the substrate 111 with guide grooves. A hard coat layer 112 is disposed on the back side of the substrate 111. On the intermediate layer 106 of the CD-RW, the recording label 10 is affixed. The thermoreversible recording medium 10 is composed of an adhesive layer or tacky layer 105, back layer 104, support 103, thermosensitive layer 102, and protective layer 101 in order. The dielectric layer is not necessarily required on both sides of the optical information memorizing layer. When the substrate is formed of lower thermal-resistant material such as polycarbonate resin, preferably the first dielectric layer 110 is disposed.

Figure 11:
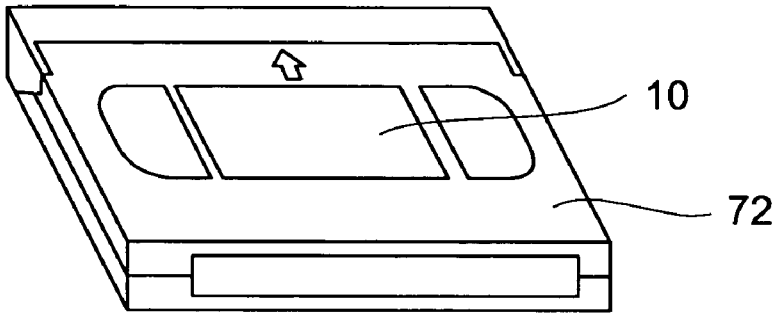
FIG. 11 schematically exemplifies a configuration, in which a recording label is laminated on a videocassette.

FIG. 11 exemplifies the recording medium 10 affixed to a videocassette 72. In this case, such application is allowable that the display is automatically altered depending on the change of the memories in the videocassette.

Examples of providing the function of the thermoreversible recording on a card, a disc, a disc cartridge, and a tape cassette, besides affixing the recording label on the card and the like, coating the thermosensitive layer directly on them and transferring the thermosensitive layer on the card and the like, wherein the thermosensitive layer is disposed on another substrate beforehand. In the transferring the thermosensitive layer, the adhesive or tacky layer of hot-melt type may be disposed on the thermosensitive layer.

When on a stiff material, such as the card, the disc, the disc cartridge and the tape cassette, the recording label is affixed or the thermosensitive layer is disposed, it is preferred that an elastic and cushioning layer or a sheet is disposed between the stiff substrate and the recording label or thermosensitive layer so as to increase the contacting ability with the thermal head and to form an uniform image.

Figure 12:
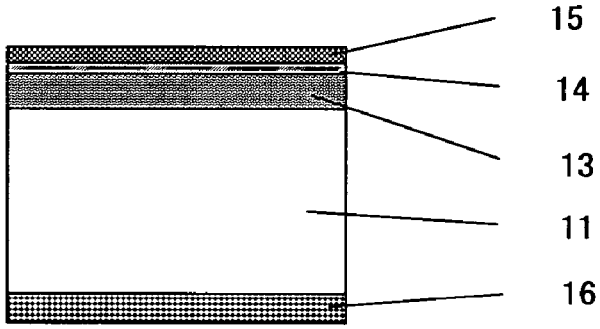
FIG. 12 exemplifies a layer construction of recording label in a schematic cross-section.
Figure 13:
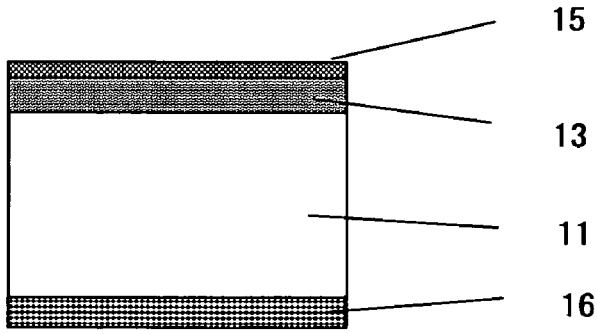
FIG. 13 exemplifies another layer construction of recording label in a schematic cross-section.

In an aspect, the recording medium may be a film, as shown in FIG. 12, comprising thermoreversible layer 13, intermediate layer 14, and protective layer 15 on support 11, and back layer 16 on the back side of support 11. In another aspect, the recording medium may be a film, as shown in FIG. 13, comprising thermoreversible layer 13 and protective layer 15 on support 11, and back layer 16 on the back side of support 11.

Figure 14A:
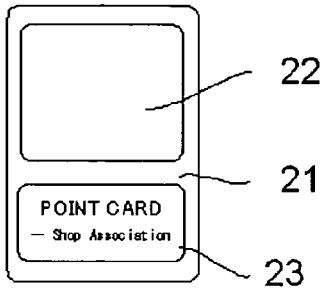
FIG. 14A schematically exemplifies a front side of a recording medium, in which the recording medium is formed into a card shape.
Figure 14B:
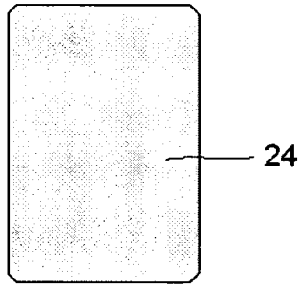
FIG. 14B schematically shows the back side of FIG. 14A.

The films (thermoreversible recording medium) of various aspects may be properly applied to the various commercial rewritable sheet of sheet-like shape provided with RF-ID tag 85 as shown in FIG. 5 for example. In addition, the films may be formed and used in a configuration of thermoreversible recording card 21 having a rewritable recording part 22 (the thermoreversible layer of the thermoreversible recording medium according to the present invention) and a printed display part 23 as shown in FIG. 14A for example, wherein on the back side of the card, there are disposed a magnetic recording part and a back layer 24 on the magnetic recording part.

Figure 15A:
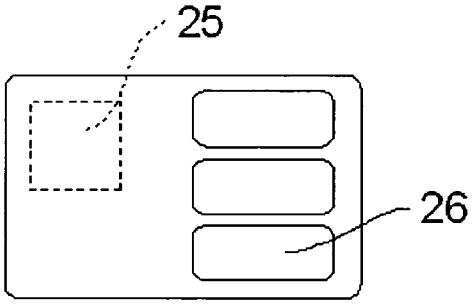
FIG. 15A schematically exemplifies another recording medium, in which the recording medium is formed into another card shape.

The thermoreversible recording member (card) shown in FIG. 15A is obtained by working a film, comprising a thermosensitive layer and protective layer on a support, into a card shape, forming a depression part for enveloping an IC chip. In the aspect shown in FIG. 15A, a rewritable recording part 26 is formed by processing the thermoreversible recording medium in label configuration on the card-like recording member, and on the back side of the card a depression part 25 for enveloping an IC chip is formed.

Figure 15B:
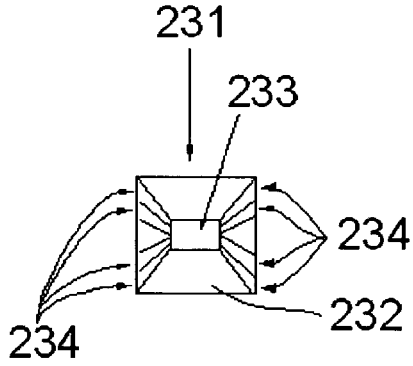
FIG. 15B schematically shows an IC chip to be embedded into the depression part for embedding the IC chip.

A wafer 231 is incorporated and fixed into the depression part 25 as shown in FIG. 15B. In the wafer 231, an integrated circuit 233 is provided on a wafer substrate 232, and a plurality of contacting terminals 234 electrically connected to the integrated circuit 233 are provided on the wafer substrate 232. The contacting terminals 234 are exposed to the back side of the wafer substrate 232 in a configuration that an exclusive printer (reader-writer) may read and write the specific information through the electric contact with the contacting terminals 234.

Figure 16A:
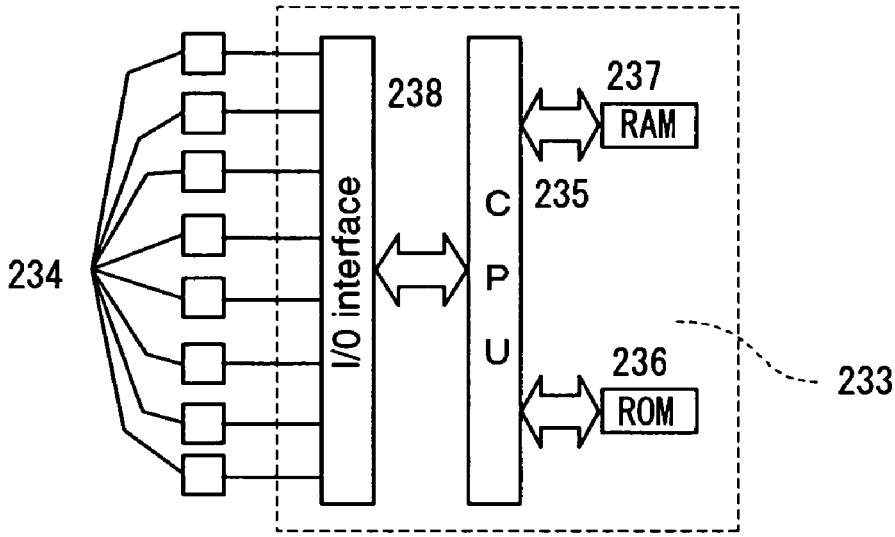
FIG. 16A schematically exemplifies constituent block diagram of an integrated circuit.

The performance of the thermoreversible recording layer will be explained with reference to FIGS. 16A and 16B. FIG. 16A is a schematic constitutional block diagram showing the integrated circuit 233. In addition, FIG. 16B a constitutional block diagram showing an example of memorized data of PAM. The integrated circuit 233 is comprised of LSI, in which CPU 235 that may perform controlling actions in a pre-determined step, ROM 236 that may store the operation program data of CPU 235, and RAM 237 that may write and read the necessary data are included.

In addition, the integrated circuit 233 comprises I/O interface 238 that receives input signals and send the input data to CPU 235 and receives the output signals from CPU 235 and dispatch outside, and also (not shown) power on reset circuit, clock generating circuit, pulse divided perimeter circuit (interruption pulse generating circuit), and address decode circuit CPU 235 may perform the action of interruption control routine depending on the interruption pulse provided periodically by the pulse divided perimeter circuit. Further, the address decode circuit may decode the address data from CPU 235 and send signals to ROM 236, RAM 237, and I/O interface 238. A plurality of contacting terminals 234 (eight in FIG. 16A) are connected to the I/O interface 238, the specific data from the exclusive printer (reader-writer) are inputted to CPU 235 from the contacting terminals 234 through the I/O interface 238. CPU 235 responds the input signals and performs various actions according to the program data stored in ROM 236, as well as outputs predetermined data and signals to the sheet reader-writer through I/O interface 238.

Figure 16B:
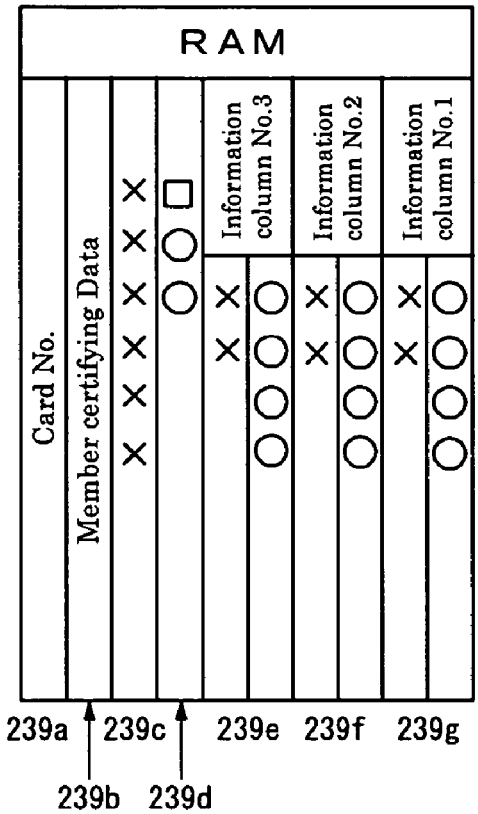
FIG. 16B schematically shows that the RAM comprises a plurality of memory regions.

As shown in FIG. 16B, RAM 237 comprises a plurality of memorizing regions 239*a* to 239*g*. For example, a sheet number is memorized in region 239*a*. For example, in memorizing region 239*b*, ID data of sheet owner such as full name, belonging, telephone number are memorized. For example, memorizing region 239*c* is provided as the remaining blank for the user, or the information concerning handling is memorized. For example, the information concerning the prior manger and prior user is memorized in the memorizing regions 239*d*, 239*e*, 239*f* and 239*g*.

At least one of the thermosensitive recording label and the recording member is not restricted and may be subjected to image processing by various image processing methods and image processing apparatuses, and the images may be preferably formed and erased by the image processing apparatus as explained later.

(Image Processing Method and Image Processing Apparatus)

The image processing apparatus comprises at least one of an image forming unit and image erasing unit, and the other unit properly selected depending on the necessity such as conveying unit, controlling unit and the like.

The image processing method performs at least one of the image forming and the image erasing by heating the thermosensitive recording medium, and comprises the other operations properly selected depending on the necessity, such as conveying and controlling.

The image forming method may be preferably performed by means of the image forming apparatus. At least one of the image forming and the image erasing by the heating of the thermosensitive recording medium may be performed by at least one of the image forming unit and the image erasing unit, and the other operations may be performed by means of the other unit.

Image Forming Unit and Image Erasing Unit

The image forming unit is a unit in which images are formed by heating the thermoreversible recording medium. The image erasing unit is a unit in which images are erased by heating the thermoreversible recording medium.

The image forming unit is not restricted and may be properly selected depending on the application. Examples of the image forming unit include a thermal head and a laser. These may be used individually or in combination.

The image erasing unit is not restricted and may be properly selected depending on the application. Examples of the image erasing unit include a hot stamp, a ceramic heater, a heat roller, a heat block, a hot blow, a thermal head and a laser irradiation apparatus. Among these, the ceramic heater is preferred. By means of the ceramic heater, the apparatus may be miniaturized, the erasing condition may be stabilized, and images with high contrast may be obtained. The operating temperature of the ceramic heater is not restricted and may be properly selected depending on the application. The operating temperature is preferably 110° C. or more, more preferably 112° C. or more, most preferably 115° C. or more.

By using the thermal head, not only the apparatus can be still more miniatuarized, but also the electric power consumption can be lowered so that an apparatus of a handy type which is driven by a battery can be used. For performing the image forming and the image erasing by one thermal head, there is provided 2 systems, such as a so-called usual system and the over write system. In the usual system, all prior images are at once erased and new images are newly formed. In the overwrite system, the image erasing of a prior image and the image forming of a new image are simultaneously performed by alternating a thermal energy (for the image forming and for the image erasing respectively) from the thermal head, so that the total period for the image forming and the image erasing is relatively short, resulting in the speed-up of the recording.

When the thermoreversible recording member (card) comprising the thermosensitive layer and an information-memorizing part is used, the above-noted apparatus comprises a reading unit and rewriting unit for memories in the information-memorizing part.

The conveying unit is not restricted so long as the unit has a function to convey successively the recording media and may be properly selected depending on the application. Examples of the conveying unit include a conveying belt, a conveying roller and a combination of conveying belt and conveying roller.

The controlling unit is not restricted so long as the unit has a function to control the above-noted respective steps and may be properly selected depending on the application. Examples of the controlling unit include a sequencer and a computer.

Figure 17:
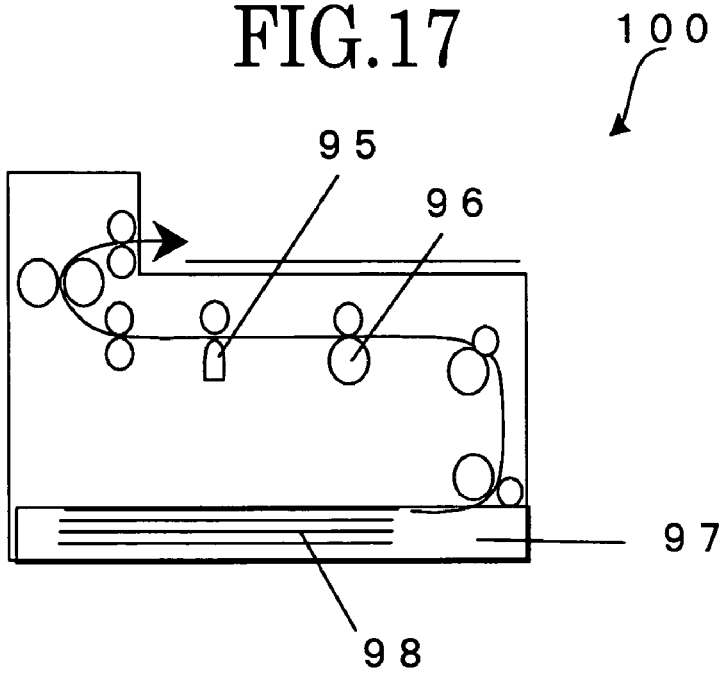
FIG. 17 schematically exemplifies an image processing apparatus used for an image processing method.
Figure 18:
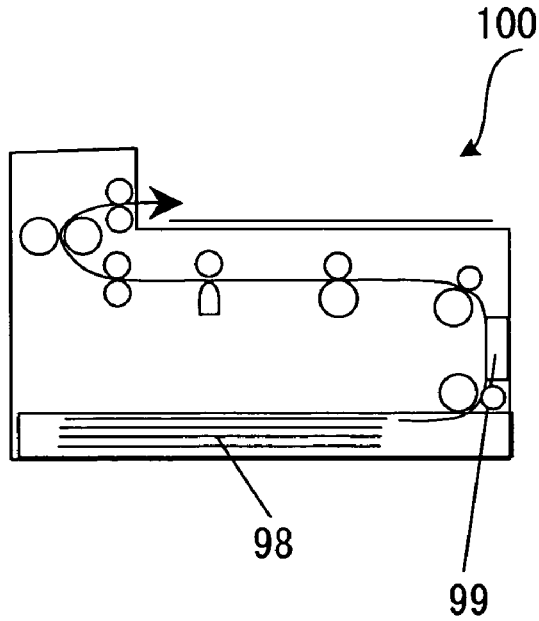
FIG. 18 schematically exemplifies another image processing apparatus used for an image processing method.
Figure 19:
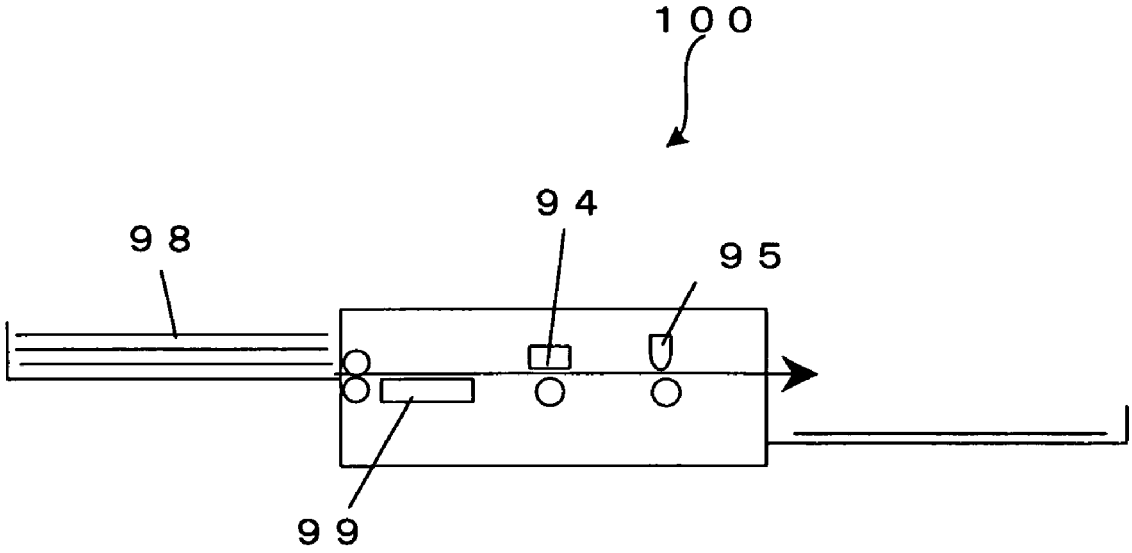
FIG. 19 schematically exemplifies still another image processing apparatus used for an image processing method.

With respect to one aspect of carrying out the image processing method according to the present invention by the image processing apparatus according to the present invention, explanations are given with referring to FIGS. 17 to 19. As shown in FIG. 17, the image processing apparatus 100 is provided with heat-roller 96, thermal head 95, and a conveying roller. In the image processing apparatus, the image recorded on the thermosensitive layer is heated and erased by means of heat-roller 96. Then, the processed new information is recorded by means of thermal head 95 on the thermosensitive layer. In FIG. 17, 97 represent a paper feeding tray and 98 represents a rewritable sheet (thermoreversible recording medium).

When the recording medium comprises the RF-ID tag, as shown in FIGS. 18 to 19, the image processing apparatus comprises further an RF-ID reader-writer 99. In this case, a parallel type of the image processing apparatus may be one aspect thereof, as shown in FIG. 19.

As shown in FIGS. 18 and 19, in the image processing apparatus 100, first, an information in the RF-ID tag which is affixed on the recording medium is read by means of RF-ID reader-writer 99 and after a new information is inputted in the RF-ID, the images recorded in the thermosensitive layer are heated and erased by means of the heat-roller 96. Accoding to the information which has been read and rewritten by the RF-ID reader-writer, a processed new information is recorded in the thermosensitive layer by means of the thermal head 95.

Instead of the RF-ID reader-writer, a bar-code reading device and a magnetic head may be used. In the case of the bar-code reading device, after a bar-code information recorded in the thermosensitive layer is read by the reading device, a bar-code information and a visual information recorded in the thermosensitive layer are erased by means of the heat-roller and a new information processed according to the information read from the bar-code is recorded in the thermosensitive layer as a bar-code information and a visual information by means of the thermal head.

In the image processing apparatus shown in FIGS. 17 to 18, there is a tray 97 for stacking the recording media, from which the recording media may be picked up sheet by sheet by a sheet-feeding method, such as a friction pad type. A fed recording medium is conveyed through the conveying roller to the RF-ID reader-writer and here, the data are read and written. The recording medium is conveyed further by the conveying roller to the heat-roller which is the erasing unit, where a visual information recorded in the recording medium is erased. Then, the recording medium is conveyed to the thermal head, where a new information is recorded in the recording medium. Thereafter, the recording medium is conveyed by the conveying roller and discharged from the upper exit portion. 94 represents a ceramic heater.

It is preferred that a preset temperature of the heat-roll is controlled at a temperature corresponding to a temperature at which the information in the recording medium is erased. For example, the surface temperature of the heat-roller is preferably from 100 to 190° C., more preferably from 110 180° C., still more preferably from 115 to 170° C.

Figure 20A:
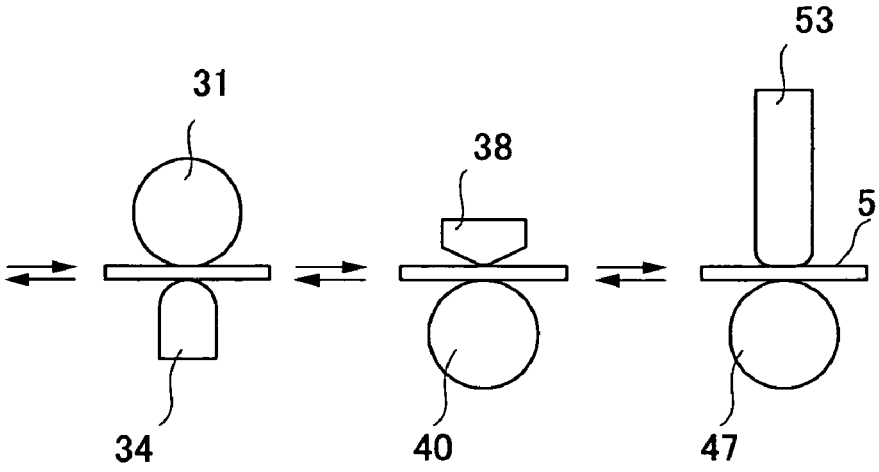
FIG. 20A schematically exemplifies an image processing apparatus, wherein the image erasing is performed by a ceramic heater, and the image forming is performed by a thermal head respectively.
Figure 20B:
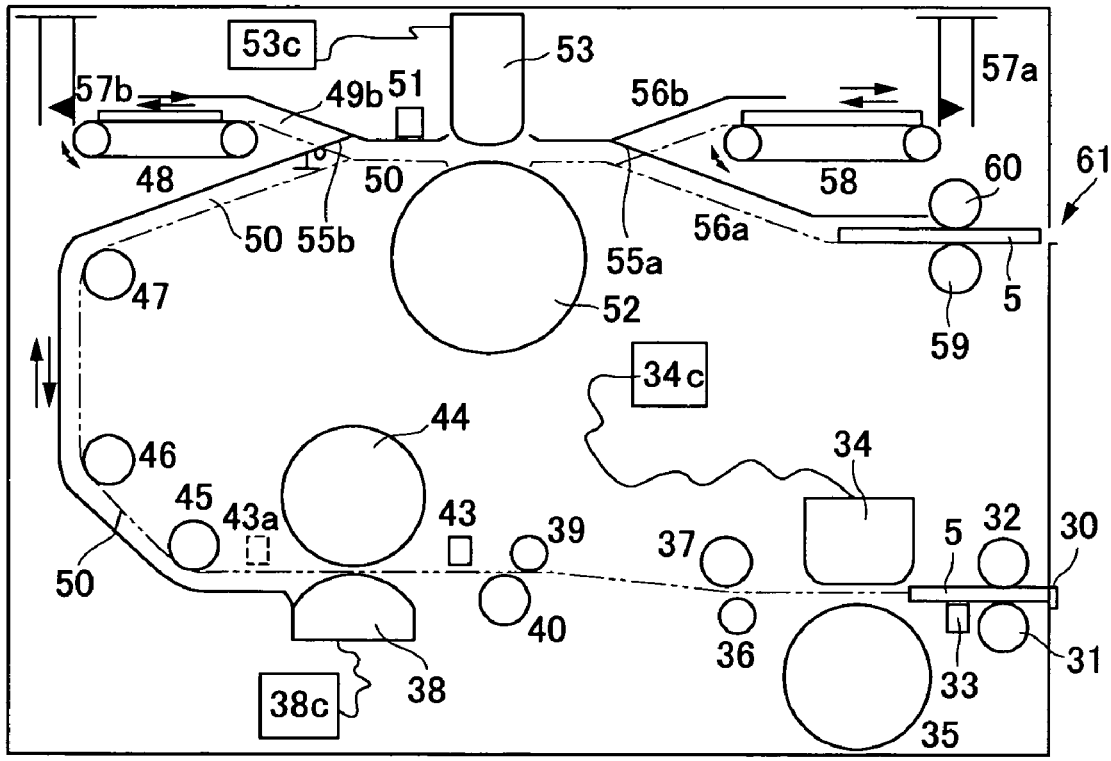
FIG. 20B schematically exemplifies an image processing apparatus.

Further, explanations are given with referring to FIGS. 20A and 20B. The image processing apparatus shown in FIG. 20A is provided with thermal head 53 as the heating unit, ceramic heater 38, magnetic head 34 and conveying rollers 31, 40 and 47.

As shown in FIG. 20A, first, information memorized in the magnetic thermosensitive layer of the recording medium is read by means of the magnetic head. Then, an image recorded in the thermoreversible layer is erased by means of the ceramic heater. Further, a new information processed according to the information read by the magnetic head is recorded in the thermosensitive layer by means of the thermal head. Thereafter, the information in the magnetic thermosensitive layer is rewritten to a new information.

In the image processing apparatus shown in FIG. 20A, the thermoreversible recording medium 5 in which the magnetic thermosensitive layer is disposed on a surface of the support which is opposite to another surface of the support on which the thermosensitive layer is disposed, is conveyed in a direction of "from the left to the right" (shown by an arrow toward to the right) or conveyed in the reverse direction (shown by an arrow toward to the left). The recording medium 5 is subjected to the magnetic recording or erasing in the magnetic thermosensitive layer at magnetic head 34 and conveying roller 31, subjected to a heat treatment for erasing images at ceramic heater 38 and conveying roller 40, and subjected to image forming at thermal head 53 and conveying roller 47, thereafter discharged out of the apparatus. As explained above, a preset temperature of the ceramic heater 38 is preferably 110° C. or more, more preferably 112° C. or more, most preferably 115° C. or more. Rewriting a magnetic-recorded information may be performed, either before or after the image erasing by means of the ceramic heater. If desired, the recording medium is conveyed reversibly either after passing between the ceramic heater 38 and conveying roller 40 or after passing between the thermal head 53 and conveying roller 47, so that the recording medium may be subjected to either the heating process by ceramic heater 38 once more or the recording process by thermal head 53 once more.

In the image processing apparatus shown in FIG. 20B, the thermoreversible recording medium 5 inserted from the entrance 30 is conveyed along the conveying root 50 indicated by a broken line, in either forward or backward direction. The recording medium 5 inserted from the entrance 30 is conveyed in the recording apparatus by means of a conveying roller 31 and a guide roller 32. When the recording medium reaches a sensor 33 which detects the recording medium, the sensor 33 informs a controlling unit 34*c* of the existence of the recording medium, so that the magnetic thermosensitive layer of the recording medium is subjected to magnetic recording or erasing when the recording medium reaches the magnetic head 34 (which is controlled by the information of the controlling unit 34*c*) and the platen roller 35. Further, the recording medium passes through between a guide roller 36 and a conveying roller 37 and between a guide roller 39 and a conveying roller 40. When the recording medium reaches the sensor 43, the sensor 43 informs the ceramic heater controlling unit 38*c* of the existence of the recording medium and when the recording medium reaches the ceramic heater 38 (which is controlled by the information of the controlling unit 38*c*) and the platen roller 44, the recording medium is subjected to the image erasing by the heating. Further, the recording medium is conveyed by conveying rollers 45, 46 and 47 along the route 50. When the recording medium reaches the sensor 51, the sensor 51 informs the thermal head controlling unit 53*c* of the existence of the recording medium and when the recording medium reaches the thermal head 53 (which is controlled by the information of the controlling unit 53*c*) and the platen roller 52, the recording medium is subjected to image forming. Thereafter, the recording medium is conveyed along the conveying route 56*a* and is carried by the conveying roller 59 and the guide roller 60 through the exit 61 out of the apparatus. The preset temperature of the ceramic heater 38 is not restricted and may be properly selected depending on the application. As noted above, the preset temperature of the ceramic heater is preferably 110° C. or more, more preferably 112° C. or more, most preferably 115° C. or more.

If desired, the recording medium is conveyed along the conveying route 56*b* by switching the changing unit of conveying route 55*a* and is conveyed backwards by the conveying belt 58 which is driven by the limit switch 57*a* (which is switched on by a pressure of the recording medium) to convey the recording medium in the backward direction. When the recording medium reaches again the thermal head 53 and the platen roller 52, the recording medium is subjected again to the heating. Further, the recording medium is conveyed along the conveying route 49*b* by switching the changing unit of conveying route 55*b* and through the limit switch 57*b* and the conveying belt 48 in the forward direction. Thereafter, the recording medium is conveyed along the conveying route 56*a* and carried by the conveying roller 59 and the guide roller 60 through the exit 61 out of the apparatus. Further, with respect to a set of the above-noted branched conveying route and changing unit of conveying route, one more set may be also installed between the magnetic head 34 and the ceramic heater 38. In this case, it is desired that a new sensor 43*a* is also installed between the platen roller 44 and the conveying roller 45.

According to the image processing apparatus and image processing method of the present invention, the thermoreversible recording medium of the present invention can be prevented from the electrostatic charge and the curling. Since the recording medium of the present invention has extremely improved conveyability, the curling is not caused during repeating the printing and erasing and a defect in conveyance of the recording medium, such as the multi feeding and the paper jam can be prevented. In addition, the thermoreversible recording medium of the present invention can be processed in high speed and on the recording medium, an image of high contrast can be formed.

Hereinbelow, the present invention will be described in more detail with reference to the following Examples, which should not be construed as limiting the scope of the present invention.

EXAMPLE 1

Preparation of Thermoreversible Recording Medium (1) Support

As the support, an opaque polyester film (manufactured and sold by Teijin Du pont Films Japan Limited: trade name; tetoron film U2L98W) having a thickness of 125 μm was used.

(2) Thermosensitive Layer

Preparation of Coating Liquid for Thermosensitive Layer

3 Parts by mass of a coloring agent represented by the following formula, 1 part by mass of dialkyl urea (manufactured and sold by Nippon Kasei Chemical Co., Ltd.: trade name; Hakreen SB), 9 parts by mass of a 50% by mass solution of acrylpolyol (manufactured and sold by Mitsubishi Rayon Co., Ltd.: trade name; LR 327) and 70 parts by mass of methyl ethyl ketone were ground by a ball mill, so that a particle had an average particle diameter of about 1 μm and was dispersed in the solution.

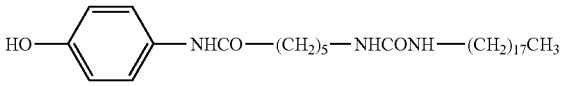

Next, to the dispersion in which the ground coloring agent was dispersed, 1 part by mass of 2-anilino-3-methyl-6-dibutylaminofluoran and 3 parts by mass of isocyanate (manufactured and sold by Nippon Polyurethane Industry Co., Ltd.: trade name; colonate HL) were added and the dispersion was well stirred, thereby preparing a coating liquid for the thermosensitive layer.

Next, the above-prepared coating liquid for the thermosensitive layer was coated on the support by means of a wire bar, dried at 100° C. for 2 minutes and cured at 60° C. for 24 hours, thereby disposing the thermosensitive layer having a film thickness of 11 μm.

(3) Intermediate Layer

Preparation of Coating Liquid for Intermediate Layer

3 Parts by mass of a 50% by mass solution of acrylpolyol (manufactured and sold by Mitsubishi Rayon Co., Ltd.: trade name; LR 327), 7 parts by mass of a 30% by mass dispersion of zinc oxide fine particles (manufactured and sold by Sumitomo Cement Co. Ltd.: trade name; ZS 303), 1.5 parts by mass of isocyanate (manufactured and sold by Nippon Polyurethane Industry Co., Ltd.: trade name; colonate HL) and 7 parts by mass of methyl ethyl ketone were mixed and a resultant mixture was well stirred, thereby preparing a coating liquid for the intermediate layer.

Next, the above-prepared coating liquid for the intermediate layer was coated on the support on which the thermosensitive layer was disposed, as noted above, dried by the heating at 90° C. for 1 minute and heated at 60° C. for 2 hours, thereby disposing the intermediate layer having a film thickness of 2 μm on the support on which the thermosensitive layer was disposed.

(4) Protective Layer

Preparation of Coating Liquid for Protective Layer

3 Parts by mass of pentaerythritolhexaacrylate (manufactured and sold by Nippon Kayaku Co., Ltd.: trade name; KAYARAD DPHA), 3 parts by mass of urethaneacrylate oligomer (manufactured and sold by Negami Chemical Industrial Co., Ltd.: trade name; Art Resin UN-3320HA), 3 parts by mass of acrylic acid ester of dipentaerythritolcaprolactone (manufactured and sold by Nippon Kayaku Co., Ltd.: trade name; KAYARAD DPCA-120), 1 part by mass of silica (manufactured and sold by Mizusawa Industrial Chemicals, Ltd.: trade name; P-526), 0.5 part by mass of a photopolymerization initiator (manufactured and sold by Nihon Chiba Gaigy Co., Ltd.: trade name; Irgacure 184) and 11 parts by mass of isopropyl alcohol were mixed and the resultant mixture was well stirred in a ball mill, so that the particles had an average particle diameter of about 3 μm and were dispersed in the dispersion medium, thereby preparing a coating liquid for the protective layer.

Next, the above-prepared coating liquid for the protective layer was coated by means of a wire bar on the support on which the thermosensitive layer and the intermediate layer were disposed, and dried at 90° C. by the heating for 1 minute. The resultant coated support was subjected to the crosslinking of the protective layer by means of a UV lamp having an irradiation energy of 80 W/cm, thereby disposing the protective layer having a film thickness of 4 μm.

(5) Back Layer

Preparation of Coating Liquid for Back Layer 7.5 Parts by mass of pentaerythritolhexaacrylate (manufactured and sold by Nippon Kayaku Co., Ltd.: trade name; KAYARAD DPHA), 2.5 parts by mass of urethaneacrylate oligomer (manufactured and sold by Negami Chemical Industrial Co., Ltd.: trade name; Art Resin UN-3320HA), 2.5 parts by mass of a conductive whisker (manufactured and sold by Otsuka Chemical Co., Ltd.: trade name; DENTALL WK-200 having a longest diameter of from 10 to 20 μm, a shortest diameter of from 0.4 to 0.7 μm and a composition of $K_2O.nTiO_2/SnO_2Sb_2O_6$), 0.5 part by mass of a photopolymerization initiator (manufactured and sold by Nihon Chiba Gaigy Co., Ltd.: trade name; Irgacure 184) and 13 parts by mass of isopropyl alcohol were mixed and the resultant mixture was well stirred in a ball mill, thereby preparing a coating liquid for the back layer.

Next, the above-prepared coating liquid for the back layer was coated by means of a wire bar on a surface of the support which was opposite to the surface of the support on which the thermosensitive, intermediate and protective layers were disposed, and dried by the heating at 90° C. for 1 minute. The resultant coated support was subjected to the crosslinking of the back layer by means of a UV lamp having an irradiation energy of 80 W/cm, thereby disposing the back layer having a film thickness of 5 μm.

As noted above, the thermoreversible recording medium of Example 1 was produced.

EXAMPLE 2

Preparation of Thermoreversible Recording Medium

The thermoreversible recording medium of Example 2 was produced by disposing the thermosensitive, intermediate, protective and back layers on the support in substantially the same manner as in Example 1, except that the methods for preparing the coating liquid for the back layer and for disposing the back layer, which were used in Example 1 were changed to the methods for preparing the coating liquid for the back layer and for disposing the back layer (respectively), which are noted in the following section.

Preparation of Coating Liquid for Back Layer

7 Parts by mass of pentaerythritolhexaacrylate (manufactured and sold by Nippon Kayake Co., Ltd.: trade name; KAYARAD DPHA), 3 parts by mass of urethaneacrylate oligomer (manufactured and sold by Negami Chemical Industrial Co., Ltd.: trade name; Art Resin UN-3320HA), 2.5 parts by mass of a needle-like conductive titanium oxide (manufactured and sold by Ishihara Sangyo Kaisha, Ltd.: trade name; FT-1000 having a longest diameter of 1.68 μm, a shortest diameter of 0.13 μm and a composition of titanium oxide coated by antimony-tin-oxide), 0.5 part by mass of a photopolymerization initiator (manufactured and sold by Nihon Chiba Gaigy Co., Ltd.: trade name; Irgacure 184) and 13 parts by mass of isopropyl alcohol were mixed and the resultant mixture was well stirred in a ball mill, thereby preparing a coating liquid for the back layer.

Next, the above-prepared coating liquid for the back layer was coated by means of a wire bar on a surface of the support which was opposite to the surface of the support on which the thermosensitive, intermediate and protective layers were disposed, and dried by the heating at 90° C. for 1 minute. The resultant coated support was subjected to the crosslinking of the back layer by means of a UV lamp having an irradiation energy of 80 W/cm, thereby disposing the back layer having a film thickness of 4 μm.

EXAMPLE 3

Preparation of Thermoreversible Recording Medium

The thermoreversible recording medium of Example 3 was produced by disposing the thermosensitive, intermediate, protective and back layers on the support in substantially the same manner as in Example 1, except that the methods for preparing the coating liquid for the back layer and for disposing the back layer, which were used in Example 1 were changed to the methods for preparing the coating liquid for the back layer and for disposing the back layer (respectively), which are noted in the following section.

Preparation of Coating Liquid for Back Layer 7.5 Parts by mass of urethaneacrylate (manufactured and sold by Shin-Nakamura Chemical Co., Ltd.: trade name; U-15HA), 2.5 parts by mass of urethaneacrylate oligomer (manufactured and sold by Negami Chemical Industrial Co., Ltd.: trade name; Art Resin UN-3320HA), 2.5 parts by mass of a needle-like conductive titanium oxide (manufactured and sold by Ishihara Sangyo Kaisha, Ltd.: trade name; FT-1000 having a longest diameter of 2.86 μm, a shortest diameter of 0.21 μm and a composition of titanium oxide coated by antimony-tin-oxide), 0.5 part by mass of a photopolymerization initiator (manufactured and sold by Nihon Chiba Gaigy Co., Ltd.: trade name; Irgacure 184) and 13 parts by mass of isopropyl alcohol were mixed and the resultant mixture was well stirred in a ball mill, thereby preparing a coating liquid for the back layer.

Next, the above-prepared coating liquid for the back layer was coated by means of a wire bar on a surface of the support which was opposite to the surface of the support on which the thermosensitive, intermediate and protective layers were disposed, and dried by the heating at 90° C. for 1 minute. The resultant coated support was subjected to the crosslinking of the back layer by means of a UV lamp having an irradiation energy of 80 W/cm, thereby disposing the back layer having a film thickness of 4 μm.

EXAMPLE 4

Preparation of Thermoreversible Recording Medium

The thermoreversible recording medium of Example 4 was produced by disposing the thermosensitive, intermediate, protective and back layers on the support in substantially the same manner as in Example 1, except that the methods for preparing the coating liquid for the back layer and for disposing the back layer, which were used in Example 1 were changed to the methods for preparing the coating liquid for the back layer and for disposing the back layer (respectively), which are noted in the following section.

Preparation of Coating Liquid for Back Layer 6.5 Parts by mass of pentaerythritolhexaacrylate (manufactured and sold by Nippon Kayaku Co., Ltd.: trade name; KAYARAD DPHA), 3.5 parts by mass of urethaneacrylate oligomer (manufactured and sold by Negami Chemical Industrial Co., Ltd.: trade name; Art Resin UN-3320HA), 3.5 parts by mass of a needle-like conductive titanium oxide (manufactured and sold by Ishihara Sangyo Kaisha, Ltd.: trade name; FT-3000 having a longest diameter of 5.15 μm, a shortest diameter of 0.27 μm and a composition of titanium oxide coated by antimony-tin-oxide), 0.5 part by mass of a photopolymerization initiator (manufactured and sold by Nihon Chiba Gaigy Co., Ltd.: trade name; Irgacure 184), 0.5 part by mass of silica (manufactured and sold by Mizusawa Industrial Chemicals, Ltd.: trade name; P-526) and 14 parts by mass of isopropyl alcohol were mixed and the resultant mixture was well stirred in a ball mill, thereby preparing a coating liquid for the back layer.

Next, the above-prepared coating liquid for the back layer was coated by means of a wire bar on a surface of the support which was opposite to the surface of the support on which the thermosensitive, intermediate and protective layers were disposed, and dried by the heating at 90° C. for 1 minute. The resultant coated support was subjected to the crosslinking of the back layer by means of a UV lamp having an irradiation energy of 80 W/cm, thereby disposing the back layer having a film thickness of 4 μm.

EXAMPLE 5

Preparation of Thermoreversible Recording Medium

The thermoreversible recording medium of Example 5 was produced by disposing the thermosensitive, intermediate, protective and back layers on the support in substantially the same manner as in Example 1, except that the methods for preparing the coating liquid for the back layer and for disposing the back layer, which were used in Example 1 were changed to the methods for preparing the coating liquid for the back layer and for disposing the back layer (respectively), which are noted in the following section.

Preparation of Coating Liquid for Back Layer 7.5 Parts by mass of pentaerythritolhexaacrylate (manufactured and sold by Nippon Kayaku Co., Ltd.: trade name; KAYARAD DPHA), 2.5 parts by mass of urethaneacrylate oligomer (manufactured and sold by Negami Chemical Industrial Co., Ltd.: trade name; Art Resin UN-3320HA), 2.5 parts by mass of a needle-like conductive titanium oxide (manufactured and sold by Ishihara Sangyo Kaisha, Ltd.: trade name; FT-3000 having a longest diameter of 5.15 μm, a shortest diameter of 0.27 μm and a composition of titanium oxide coated by antimony-tin-oxide), 0.5 part by mass of a photopolymerization initiator (manufactured and sold by Nihon Chiba Gaigy Co., Ltd.: trade name; Irgacure 184) and 13 parts by mass of isopropyl alcohol were mixed and the resultant mixture was well stirred in a ball mill, thereby preparing a coating liquid for the back layer.

Next, the above-prepared coating liquid for the back layer was coated by means of a wire bar on a surface of the support which was opposite to the surface of the support on which the thermosensitive, intermediate and protective layers were disposed, and dried by the heating at 90° C. for 1 minute. The resultant coated support was subjected to the crosslinking of the back layer by means of a UV lamp having an irradiation energy of 80 W/cm, thereby disposing the back layer having a film thickness of 4 μm.

EXAMPLE 6

Preparation of Thermoreversible Recording Medium

The thermoreversible recording medium of Example 6 was produced by disposing the thermosensitive, intermediate, protective and back layers on the support in substantially the same manner as in Example 1, except that the methods for preparing the coating liquid for the back layer and for disposing the back layer, which were used in Example 1 were changed to the methods for preparing the coating liquid for the back layer and for disposing the back layer (respectively), which are noted in the following section.

Preparation of Coating Liquid for Back Layer

8 Parts by mass of pentaerythritolhexaacrylate (manufactured and sold by Nippon Kayaku Co., Ltd.: trade name; KAYARAD DPHA), 2 parts by mass of urethaneacrylate oligomer (manufactured and sold by Negami Chemical Industrial Co., Ltd.: trade name; Art Resin UN-3320HA), 7 parts by mass of a needle-like conductive titanium oxide (manufactured and sold by Ishihara Sangyo Kaisha, Ltd.: trade name; FT-3000 having a longest diameter of 5.15 μm, a shortest diameter of 0.27 μm and a composition of titanium oxide coated by antimony-tin-oxide), 0.5 part by mass of a photopolymerization initiator (manufactured and sold by Nihon Chiba Gaigy Co., Ltd.: trade name; Irgacure 184) and 17.5 parts by mass of isopropyl alcohol were mixed and the resultant mixture was well stirred in a ball mill, thereby preparing a coating liquid for the back layer.

Next, the above-prepared coating liquid for the back layer was coated by means of a wire bar on a surface of the support which was opposite to the surface of the support on which the thermosensitive, intermediate and protective layers were disposed, and dried by the heating at 90° C. for 1 minute. The resultant coated support was subjected to the crosslinking of the back layer by means of a UV lamp having an irradiation energy of 80 W/cm, thereby disposing the back layer having a film thickness of 4 μm.

EXAMPLE 7

Preparation of Thermoreversible Recording Medium

The thermoreversible recording medium of Example 7 was produced by disposing the thermosensitive, intermediate, protective and back layers on the support in substantially the same manner as in Example 1, except that the methods for preparing the coating liquids for the protective and back layers which were used in Example 1 were changed to the methods for preparing the coating liquids for the protective and back layers (respectively) which are noted in the following sections (—Preparation of Coating Liquid for Protective layer—and—Preparation of Coating Liquid for Back layer—), and the method for disposing the back layer which was used in Example 1 was changed to the method for disposing the back layer which is noted in the following section.

Preparation of Coating Liquid for Protective Layer

3 Parts by mass of pentaerythritolhexaacrylate (manufactured and sold by Nippon Kayaku Co., Ltd.: trade name; KAYARAD DPHA), 3 parts by mass of urethaneacrylate oligomer (manufactured and sold by Negami Chemical Industrial Co., Ltd.: trade name; Art Resin UN-3320HA), 3 parts by mass of acrylic acid ester of dipentaerythritolcaprolactone (manufactured and sold by Nippon Kayaku Co., Ltd.: trade name; KAYARAD DPCA-120), 2.5 parts by mass of a needle-like conductive titanium oxide (manufactured and sold by Ishihara Sangyo Kaisha, Ltd.: trade name; FT-3000 having a longest diameter of 5.15 μm, a shortest diameter of 0.27 μm and a composition of titanium oxide coated by antimony-tin-oxide), 0.5 part by mass of a photopolymerization initiator (manufactured and sold by Nihon Chiba Gaigy Co., Ltd.: trade name; Irgacure 184) and 11 parts by mass of isopropyl alcohol were mixed and the resultant mixture was well stirred in a ball mill, so that the particles had an average particle diameter of back layer 3 μm and were dispersed in the dispersion medium, thereby preparing a coating liquid for the protective layer.

Next, the above-prepared coating liquid for the protective layer was coated by means of a wire bar on the support on which the thermosensitive layer and the intermediate layer were disposed, and dried at 90° C. by the heating for 1 minute. The resultant coated support was subjected to the crosslinking of the protective layer by means of a UV lamp having an irradiation energy of 80 W/cm, thereby disposing the protective layer having a film thickness of 4 μm.

Preparation of Coating Liquid for Back Layer 7.5 Parts by mass of pentaerythritolhexaacrylate (manufactured and sold by Nippon Kayaku Co., Ltd.: trade name; KAYARAD DPHA), 2.5 parts by mass of urethaneacrylate oligomer (manufactured and sold by Negami Chemical Industrial Co., Ltd.: trade name; Art Resin UN-3320HA), 2.5 parts by mass of a needle-like conductive titanium oxide (manufactured and sold by Ishihara Sangyo Kaisha, Ltd.: trade name; FT-3000 having a longest diameter of 5.15 μm, a shortest diameter of 0.27 μm and a composition of titanium oxide coated by antimony-tin-oxide), 0.5 part by mass of a photopolymerization initiator (manufactured and sold by Nihon Chiba Gaigy Co., Ltd.: trade name; Irgacure 184) and 13 parts by mass of isopropyl alcohol were mixed and the resultant mixture was well stirred in a ball mill, thereby preparing a coating liquid for the back layer.

Next, the above-prepared coating liquid for the back layer was coated by means of a wire bar on a surface of the support which was opposite to the surface of the support on which the thermosensitive, intermediate and protective layers were disposed, and dried by the heating at 90° C. for 1 minute. The resultant coated support was subjected to the crosslinking of the back layer by means of a UV lamp having an irradiation energy of 80 W/cm, thereby disposing the back layer having a film thickness of 4 μm.

EXAMPLE 8

Preparation of Thermoreversible Recording Medium

The thermoreversible recording medium of Example 8 was produced by disposing the thermosensitive, intermediate, protective and back layers on the support in substantially the same manner as in Example 1, except that the methods for preparing the coating liquids for the protective and back layers which were used in Example 1 were changed to the methods for preparing the coating liquids for the protective and back layers (respectively) which are noted in the following sections ("Preparation of Coating Liquid for Protective layer" and "Preparation of Coating Liquid for Back layer"), and the methods for disposing the protective and back layers which were used in Example 1 were changed to the methods for disposing the protective and back layers (respectively) which are noted in the following sections.

Preparation of Coating Liquid for Protective Layer

10 Parts by mass of a 50% by mass solution of acrylpolyol (manufactured and sold by Mitsubishi Rayon Co., Ltd.: trade name; LR 327), 3 parts by mass of isocyanate (manufactured and sold by Nippon Polyurethane Industry Co., Ltd.: trade name; colonate HL), 1 part by mass of silica (manufactured and sold by Mizusawa Industrial Chemicals, Ltd.: trade name; P-526) and 16 parts by mass of methyl ethyl ketone were mixed and the resultant mixture was well stirred, thereby preparing a coating liquid for the protective layer.

Next, the above-prepared coating liquid for the protective layer was coated on the support on which the thermosensitive and intermediate layers were disposed, and dried by the heating at 100° C. for 2 minutes. The coated support was subjected to the curing of the protective layer at 60° C. for 24 hours, thereby disposing the protective layer having a film thickness of 4 μm on the support on which the thermosensitive and intermediate layers were disposed.

Preparation of Coating Liquid for Back Layer

10 Parts by mass of a 50% by mass solution of acrylpolyol (manufactured and sold by Mitsubishi Rayon Co., Ltd.: trade name; LR 327), 2 parts by mass of isocyanate (manufactured and sold by Nippon Polyurethane Industry Co., Ltd.: trade name; colonate HL), 2 parts by mass of a needle-like conductive titanium oxide (manufactured and sold by Ishihara Sangyo Kaisha, Ltd.: trade name; FT-3000 having a longest diameter of 5.15 μm, a shortest diameter of 0.27 μm and a composition of titanium oxide coated by antimony-tin-oxide) and 6 parts by mass of methyl ethyl ketone were mixed and the resultant mixture was well stirred in a ball mill, thereby preparing a coating liquid for the back layer.

Next, the above-prepared coating liquid for the back layer was coated by means of a wire bar on a surface of the support which was opposite to the surface of the support on which the thermosensitive, intermediate and protective layers were disposed, and dried by the heating at 100° C. for 2 minutes. The resultant coated support was subjected to the curing of the back layer at 60° C. for 24 hours, thereby disposing the back layer having a film thickness of 9 μm.

Comparative Example 1

Preparation of Thermoreversible Recording Medium

The thermoreversible recording medium of Comparative Example 1 was produced by disposing the thermosensitive, intermediate, protective and back layers on the support in substantially the same manner as in Example 5, except that the needle-like conductive filler of the coating liquid for the back layer in Example 5 was changed to silica (manufactured and sold by Mizusawa Industrial Chemicals, Ltd.: trade name; P-526 having an indeterminate form and an average particle diameter of 3 μm).

Comparative Example 2

Preparation of Thermoreversible Recording Medium

The thermoreversible recording medium of Comparative Example 2 was produced by disposing the thermosensitive, intermediate, protective and back layers on the support in substantially the same manner as in Example 5, except that the needle-like conductive filler of the coating liquid for the back layer in Example 5 was changed to white conductive titanium oxide (manufactured and sold by Ishihara Sangyo Kaisha, Ltd.: trade name; ET-500 W having a form of sphere and an average particle diameter of from 0.2 to 0.3 μm).

Comparative Example 3

The thermoreversible recording medium of Comparative Example 3 was produced by disposing the thermosensitive, intermediate, protective and back layers on the support in substantially the same manner as in Example 1, except that the methods for preparing the coating liquid for the back layer and for disposing the back layer, which were used in Example 1 were changed to the methods for preparing the coating liquid for the back layer and for disposing the back layer (respectively), which are noted in the following section.

Preparation of Coating Liquid for Back Layer 7.5 Parts by mass of pentaerythritolhexaacrylate (manufactured and sold by Nippon Kayaku Co., Ltd.: trade name; KAYARAD DPHA), 2.5 parts by mass of urethaneacrylate oligomer (manufactured and sold by Negami Chemical Industrial Co., Ltd.: trade name; Art Resin UN-3320HA), 2.5 parts by mass of a transparent conducting agent (manufactured and sold by Ishihara Sangyo Kaisha, Ltd.: trade name; SNS-10M having a solid content of 30% by mass, a particle diameter (which 50% of all particles in the agent have) of 0.115±0.015 μm, a composition of antimony-tin-oxide and a form of sphere), 0.5 part by mass of a photopolymerization initiator (manufactured and sold by Nihon Chiba Gaigy Co., Ltd.: trade name; Irgacure 184) and 24.5 parts by mass of isopropyl alcohol were mixed and a coating liquid for the back layer was prepared according to a conventional method.

Next, the above-prepared coating liquid for the back layer was coated by means of a wire bar on a surface of the support which was opposite to the surface of the support on which the thermosensitive, intermediate and protective layers were disposed, and dried by the heating at 100° C. for 2 minutes. The resultant coated support was subjected to the curing of the back layer at 60° C. for 24 hours, thereby disposing the back layer having a film thickness of 9 μm.

Comparative Example 4

Preparation of Thermoreversible Recording Medium

The thermoreversible recording medium of Comparative Example 4 was produced by disposing the thermosensitive, intermediate, protective and back layers on the support in substantially the same manner as in Example 8, except that the methods for preparing the coating liquid for the back layer and for disposing the back layer, which were used in Example 8 were changed to the methods for preparing the coating liquid for the back layer and for disposing the back layer (respectively), which are noted in the following section.

Preparation of Coating Liquid for Back Layer

10 Parts by mass of a 50% by mass solution of acrylpolyol (manufactured and sold by Mitsubishi Rayon Co., Ltd.: trade name; LR 327), 2 parts by mass of isocyanate (manufactured and sold by Nippon Polyurethane Industry Co., Ltd.: trade name; colonate HL), 7 parts by mass of a cationic antistatic agent of acryl type (manufactured and sold by Mitsubishi Chemical Corporation: trade name; Suftomer ST-2100) and 16 parts by mass of methyl ethyl ketone were mixed and the coating liquid for the protective layer was prepared according to a conventional method.

Next, the above-prepared coating liquid for the back layer was coated by means of a wire bar on a surface of the support which was opposite to the surface of the support on which the thermosensitive, intermediate and protective layers were disposed, and dried by the heating at 100° C. for 2 minutes. The resultant coated support was subjected to the curing of the back layer at 60° C. for 24 hours, thereby disposing the back layer having a film thickness of 9 μm.

Comparative Example 5

The thermoreversible recording medium of Comparative Example 5 was produced by disposing the thermosensitive, intermediate, protective and back layers on the support in substantially the same manner as in Example 1, except that the methods for preparing the coating liquid for the back layer and for disposing the back layer, which were used in Example 1 were changed to the methods for preparing the coating liquid for the back layer and for disposing the back layer (respectively), which are noted in the following section.

Preparation of Coating Liquid for Back Layer

3 Parts by mass of pentaerythritolhexaacrylate (manufactured and sold by Nippon Kayaku Co., Ltd.: trade name; KAYARAD DPHA), 7 parts by mass of a UV-curing antistatic agent (manufactured and sold by Shin-Nakamura Chemical Co., Ltd.: trade name; U-201PA-60, 0.5 parts by mass of a photopolymerization initiator (manufactured and sold by Nihon Chiba Gaigy Co., Ltd.: trade name; Irgacure 184), 1 part by mass of silica (manufactured and sold by Mizusawa Industrial Chemicals, Ltd.: trade name; P-526) and 17.5 parts by mass of isopropyl alcohol were mixed and the coating liquid for the back layer was prepared according to a conventional method.

Next, the above-prepared coating liquid for the back layer was coated by means of a wire bar on a surface of the support which was opposite to the surface of the support on which the thermosensitive, intermediate and protective layers were disposed, and dried by the heating at 100° C. for 2 minutes. The resultant coated support was subjected to the curing of the back layer at 60° C. for 24 hours, thereby disposing the back layer having a film thickness of 9 μm.

Comparative Example 6

The thermoreversible recording medium of Comparative Example 6 was produced by both disposing the thermosensitive, intermediate and protective layers on the support in same manner as in Example 1, and disposing the conductive layer and the back layer on a surface of the support which was opposite to the surface of the support on which the thermosensitive, intermediate and protective layers were disposed.

Preparation of Coating Liquid for Conductive Layer

20 Parts by mass of polyurethane (manufactured and sold by Nippon Polyurethane Industry Co., Ltd.: trade name; Nipporan N-5199), 20 parts by mass of a needle-like conductive titanium oxide (manufactured and sold by Ishihara Sangyo Kaisha, Ltd.: trade name; FT-3000 having a longest diameter of 5.15 μm, a shortest diameter of 0.27 μm and a composition of titanium oxide coated by antimony-tin-oxide), 25 parts by mass of methyl ethyl ketone, 25 parts by mass of toluene and 10 parts by mass of isopropyl alcohol were mixed and the resultant mixture was well stirred in a ball mill, thereby preparing a coating liquid for the conductive layer.

Next, the above-prepared coating liquid for the conductive layer was coated by means of a wire bar on a surface of the support which was opposite to the surface of the support on which the thermosensitive, intermediate and protective layers were disposed, and dried by the heating at 90° C. for 1 minute, thereby disposing the conductive layer having a film thickness of 1.5 μm.

Preparation of Coating Liquid for Back Layer

20 Parts by mass of acryl resin (manufactured and sold by Mitsubishi Rayon Co., Ltd.: trade name; BR-85), 0.6 part by mass of nylon filler (manufactured and sold by Shinto Paint Co., Ltd.: trade name; MW-330), 39 parts by mass of methyl ethyl ketone and 39 parts by mass of toluene were mixed and the resultant mixture was well stirred in a ball mill, thereby preparing a coating liquid for the back layer.

Next, the above-prepared coating liquid for the back layer was coated by means of a wire bar on the surface of the conductive layer which was disposed as noted above and dried by the heating at 90° C. for 1 minute, thereby disposing the back layer having a film thickness of 5 μm.

Next, with respect to thermoreversible recording media produced in Examples 1 to 8 and Comparative Examples 1 to 6, tests for repeating the printing and erasing and measurements of the curling property and the surface resistivity were performed as follows.

<Test for Repeating the Printing and Erasing by Means of Rewritable Printer for Sheets>

A rewritable printer for sheets used for the test consists of a part for erasing and a part for printing. The part for erasing consists of a heat roller and the part for printing consists of a thermal head. The heat roller was preset at 130° C. at which the thermoreversible recording medium can be erased. As the thermal head, a thermal head manufactured by Kyocera Corporation (specification: of 8 dot/mm and for the A4 size) was used and the printing by the thermal head was performed at 24 V (applied voltage). The recording medium was conveyed at a conveying rate of 30 mm/sec.

50 Sheets of each thermoreversible recording medium were stacked in a paper feeding tray. Sheets were conveyed one by one by, by a friction pad paper feeder and were subjected to the erasing of a recorded image at the part for erasing and to the printing an image at the part for printing. After all of stacked 50 sheets of the recording medium were printed, printed 50 sheets were stacked in the tray again and were subjected to a set of the erasing and printing. The set of the printing and erasing was repeated 100 times. The results of the test are shown in Table 1.

[Test Conditions]

The test for 100 times repeating the printing and erasing was performed with respect to the repetition durability under 3 conditions, such as conditions of 5° C.-30 RH %, 20° C.-50 RH % and 35° C.-85 RH % which were prepared by setting a rewritable printer in a large thermo-hygrostat.

[Evaluation Criteria]

During the test for repeating the printing and erasing under the above-noted conditions, the conveyability of the recording medium was measured visually. The conveyability was evaluated according to the following criteria.

"Superior" - - - No defect in conveyance (such as the multi feeding of the recording medium) was caused during the test.

"Passable" - - - No multi feeding but a shear of a printed image was caused.

"Defect of multi feeding" - - - The multi feeding was caused.

"Defect of paper jam" - - - The paper jam was caused at the feeding part of the printer, so that the recording medium could not be conveyed out of the feeding part.

<Evaluation for Curling Property>

The size of the curling was measured with respect to a thermoreversible recording medium which was already subjected to the 100 times repeating the printing and erasing test and was laid on a horizontal surface by measuring directly the size of the curling caused in the 4 corners of the above-noted thermoreversible recording medium. As a measured value for the evaluation, an average value was employed.

[Evaluation Criteria]

The curling property was evaluated according to the following criteria.

A - - - a size of the curling was less than 5 mm

B - - - a size of the curling was 5 mm or more and less than 10 mm

C - - - a size of the curling was 10 mm or more and less than 15 mm

D - - - a size of the curling was 15 mm or more

<Measurement of Surface Resistivity>

The surface resistivity of the back layer (the bare, most outer layer disposed on a surface of the support which is opposite to another surface of the support on which the thermosensitive layer is disposed) was measured by means of a surface resistivity measuring apparatus (manufactured and sold by Dia Instruments Co., Ltd.: trade name; Hiresta UP) at 10 V (voltage for the measurement). The measurement was performed under 3 conditions, such as 5° C.-30 RH %, 20° C.-50 RH % and 35° C.-85 RH %. The results of the measurement are shown in Table 3. In addition, the results of the measurement of the surface resistivity measured with respect to the recording medium which was already subjected to the 100 times repeating the printing and erasing test are similar to the results shown in Table 3.

TABLE 1

| | After 100 Times Repeating the Printing and Erasing | | |
|---|---|---|---|
| | 5° C., 30RH % | 20° C., 50RH % | 35° C., 85RH % |
| Example 1 | passable | superior | superior |
| Example 2 | passable | passable | passable |
| Example 3 | superior | superior | superior |
| Example 4 | passable | superior | passable |
| Example 5 | superior | superior | superior |
| Example 6 | superior | superior | superior |
| Example 7 | superior | superior | superior |
| Example 8 | superior | superior | superior |
| Compara. Ex. 1 | defect of multi feeding | defect of multi feeding | defect of multi feeding |
| Compara. Ex. 2 | defect of paper jam | passable | passable |
| Compara. Ex. 3 | defect of paper jam | defect of paper jam | defect of paper jam |
| Compara. Ex. 4 | defect of paper jam | defect of paper jam | defect of paper jam |
| Compara. Ex. 5 | multi feeding and paper jam | defect of paper jam | defect of paper jam |
| Compara. Ex. 6 | multi feeding and paper jam | defect of paper jam | defect of paper jam |

TABLE 2

| | Size of Curling (mm) | Evaluation |
|---|---|---|
| Example 1 | 4.5 | A |
| Example 2 | 8.0 | B |
| Example 3 | 5.0 | A |
| Example 4 | 3.0 | A |
| Example 5 | 4.0 | A |
| Example 6 | 8.0 | B |
| Example 7 | 3.0 | A |
| Example 8 | 8.0 | B |
| Compara. Ex. 1 | 5.0 | A |
| Compara. Ex. 2 | 6.0 | B |
| Compara. Ex. 3 | 18.0 | D |
| Compara. Ex. 4 | 25.0 | D |
| Compara. Ex. 5 | 13.0 | C |
| Compara. Ex. 6 | 16.0 | D |

TABLE 3

| | Surface Resistivity (ohm/square) | | |
|---|---|---|---|
| | 5° C., 30RH % | 20° C., 50RH % | 35° C., 85RH % |
| Example 1 | $2.1 \times 10^{8}$ | $1.8 \times 10^{8}$ | $2.0 \times 10^{8}$ |
| Example 2 | $6.3 \times 10^{10}$ | $5.5 \times 10^{10}$ | $5.1 \times 10^{10}$ |
| Example 3 | $1.9 \times 10^{9}$ | $1.8 \times 10^{9}$ | $1.8 \times 10^{9}$ |
| Example 4 | $3.2 \times 10^{11}$ | $1.5 \times 10^{11}$ | $1.5 \times 10^{11}$ |
| Example 5 | $2.0 \times 10^{8}$ | $1.8 \times 10^{8}$ | $1.6 \times 10^{8}$ |
| Example 6 | $1.3 \times 10^{7}$ | $1.3 \times 10^{7}$ | $1.2 \times 10^{7}$ |
| Example 7 | $2.2 \times 10^{8}$ | $1.5 \times 10^{8}$ | $1.4 \times 10^{8}$ |
| Example 8 | $3.1 \times 10^{8}$ | $2.5 \times 10^{8}$ | $2.3 \times 10^{8}$ |
| Compara. Ex. 1 | $1.0 \times 10^{13}$ or more | $1.0 \times 10^{13}$ or more | $1.0 \times 10^{13}$ or more |
| Compara. Ex. 2 | $2.0 \times 10^{12}$ | $1.5 \times 10^{11}$ | $1.5 \times 10^{11}$ |
| Compara. Ex. 3 | $5.4 \times 10^{8}$ | $3.0 \times 10^{8}$ | $2.5 \times 10^{8}$ |
| Compara. Ex. 4 | $2.5 \times 10^{12}$ | $3.0 \times 10^{9}$ | $1.2 \times 10^{9}$ |
| Compara. Ex. 5 | $1.2 \times 10^{12}$ | $5.5 \times 10^{9}$ | $5.5 \times 10^{9}$ |
| Compara. Ex. 6 | $1.8 \times 10^{12}$ | $2.5 \times 10^{11}$ | $2.0 \times 10^{11}$ |

From the results of the tests and measurements shown in Tables 1 to 3, it is confirmed that the thermoreversible recording medium produced in Examples 1 to 8 can be prevented from the curling, the defect in the conveyance, such as the multi feeding and the paper jam due to such a defect that the recording medium cannot be conveyed in the paper feeding part of the printer.

On the other hand, in Comparative Example 1, during repeating the printing and erasing, the electrostatic charge was generated on the recording medium and the recording media stuck to each other, so that the multi feeding was caused.

In Comparative Example 2, under a condition of relatively low temperature—relatively low relative humidity, the recording media stuck to each other, so that the multi feeding was caused. Under the other conditions, a shear of a printed image on the recording medium was caused.

In Comparative Examples 3 and 4, due to the heat generated by repeating the printing and erasing, the curling became large, so that the recording medium could not be conveyed in the paper feeding part of the printer and the paper jam was caused.

In Comparative Examples 5 and 6, due to the curling of the recording medium, a defect in conveyance was caused and under a condition of relatively low temperature—relatively low relative humidity, the recording media stuck to each other due to the electrostatic charge, so that a defect of the multi feeding was caused.

With respect to the thermoreversible recording medium according to the present invention, a recording medium shaped in the form of a card is used in applications, such as a prepaid card, a point card and a credit card. The recording medium having the sheet size which is larger than the card size has a wider printing area and then, can be used in applications of a general document and an instruction for a process control. Therefore, the thermoreversible recording medium according to the present invention can be used in an enter-exit ticket, stickers for containers of frozen foods, industrial products and various medicines and wide screens indicating various informations for controls of product distribution and production process.

What is claimed is:

1. A thermoreversible recording medium comprising:

a support, a thermosensitive layer disposed on the support, a protective layer disposed on the thermosensitive layer, and a back layer disposed on a surface of the support which is opposite to another surface of the support on which the thermosensitive layer is disposed, wherein the thermosensitive layer reversibly changes the color depending on the temperature and the back layer comprises a needle-like conductive filler, wherein the needle-like conductive filler has a longest diameter of from 1 to 10 μm and a shortest diameter of from 0.1 to 0.5 μm, and wherein the amount of the needle-like conductive filler in a layer comprising the needle-like conductive filler is from 10 to 40% by mass.

2. The thermoreversible recording medium according to claim 1, wherein the protective layer comprises a needle-like conductive filler.

3. The thermoreversible recording medium according to claim 1, wherein the needle-like conductive filler is produced by treating the surface of a needle-like crystal with a conducting agent.

4. The thermoreversible recording medium according to claim 3, wherein the needle-like conductive filler is titanium oxide of which surface is coated with antimony doped tin oxide.

5. The thermoreversible recording medium according to claim 1, wherein the value of the surface resistance of the most outer layer of the thermoreversible recording medium is $1\times10^{11}$ ohm/square or less.

6. The thermoreversible recording medium according to claim 1, wherein the back layer and the protective layer comprise a binder resin and the binder resin comprised in the back layer is the same binder resin as the binder resin comprised in the protective layer.

7. The thermoreversible recording medium according to claim 6, wherein the binder resin is at least one of a thermosetting resin and an ultra violet-curing resin.

8. The thermoreversible recording medium according to claim 1, wherein the thermosensitive layer comprises an electron-donating coloring compound and an electron-accepting compound.

9. The thermoreversible recording medium according to claim 8, wherein the electron-accepting compound is a phenol compound having an alkyl group which comprises 8 or more carbon atoms.

10. The thermoreversible recording medium according to claim 8, wherein the electron-donating coloring compound is a leuco dye.

11. The thermoreversible recording medium according to claim 1, wherein the thermoreversible recording medium comprises an intermediate layer between the thermosensitive layer and the protective layer, and the intermediate layer comprises an ultraviolet absorber and a curable resin.

12. The thermoreversible recording medium according to claim 1, wherein the thermoreversible recording medium is shaped in the form of at least one of a card, a label, a sheet and a roll.

13. The thermoreversible recording label comprising:

a support, a thermosensitive layer disposed on the support, a protective layer disposed on the thermosensitive layer, a back layer disposed on a surface of the support which is opposite to another surface of the support on which the thermosensitive layer is disposed, and one of an adhesive layer and a tacky layer disposed on a surface of the back layer which is opposite to another surface of the back layer on which a layer for forming the image which is comprised in the thermoreversible recording medium, is disposed, wherein the thermosensitive layer reversibly changes the color depending on the temperature and the back layer comprises a needle-like conductive filler, wherein the needle-like conductive filler has a longest diameter of from 1 to 10 μm and a shortest diameter of from 0.1 to 0.5 μm, and wherein the amount of the needle-like conductive filler in a layer comprising the needle-like conductive filler is from 10 to 40% by mass.

14. A thermoreversible recording member comprising:

an information-memorizing part and a reversible displaying part comprised of a thermoreversible recording medium, wherein the thermoreversible recording medium comprises a support, a thermosensitive layer disposed on the support, a protective layer disposed on the thermosensitive layer, and a back layer disposed on a surface of the support which is opposite to another surface of the support on which the thermosensitive layer is disposed, wherein the thermosensitive layer reversibly changes the color depending on the temperature and the back layer comprises a needle-like conductive filler, wherein the needle-like conductive filler has a longest diameter of from 1 to 10 μm and a shortest diameter of from 0.1 to 0.5 μm, and wherein the amount of the needle-like conductive filler in a layer comprising the needle-like conductive filler is from 10 to 40% by mass.

15. The thermoreversible recording member according to claim 14, wherein the information-memorizing part and the reversible displaying part are integrated.

16. The thermoreversible recording member according to claim 15, wherein the information-memorizing part is one selected from the group consisting of magnetic recording layer, magnetic stripe, IC memory, optical memory, RF-ID tag card, disc, disc cartridge and tape cassette.

17. The thermoreversible recording member according to claim 14, wherein the thermoreversible recording member comprises a printable part.

18. An image processing method comprising:

at least one of an image forming by heating a thermoreversible recording medium and an image erasing by heating a thermoreversible recording medium, wherein the image forming is performed on the thermoreversible recording medium, the image erasing is performed from the thermoreversible recording medium, and the thermoreversible recording medium comprises a support, a thermosensitive layer disposed on the support, a protective layer disposed on the thermosensitive layer, and a back layer disposed on a surface of the support which is opposite to another surface of the support on which the thermosensitive layer is disposed, wherein the thermosensitive layer reversibly changes the color depending on the temperature and the back layer comprises a needle-like conductive filler, and wherein the needle-like conductive filler has a longest diameter of from 1 to 10 μm and a shortest diameter of from 0.1 to 0.5 μm, and wherein the amount of the needle-like conductive filler in a layer comprising the needle-like conductive filler is from 10 to 40% by mass.

19. The image processing method according to claim 18, wherein the image forming is performed by one of a thermal head and a laser irradiation apparatus.

20. The image processing method according to claim 18, wherein the image erasing is performed by means of one selected from the group consisting of a thermal head, a ceramic heater, a heat roll, a hot stamp, a heat block and a laser irradiation apparatus.

21. The image processing method according to claim 18, wherein the forming new images is performed by means of a thermal head, while the erasing images is performed by means of a thermal head.

* * * * *